US012108879B2

(12) United States Patent
Smiderle

(10) Patent No.: US 12,108,879 B2
(45) Date of Patent: Oct. 8, 2024

(54) COOLING MATTRESSES, PADS OR MATS, AND MATTRESS PROTECTORS

(71) Applicant: Soft-Tex International, Inc., Waterford, NY (US)

(72) Inventor: Mark Smiderle, Midhurst (CA)

( * ) Notice: Subject to any disclaimer, the term of this patent is extended or adjusted under 35 U.S.C. 154(b) by 263 days.

(21) Appl. No.: 17/172,349

(22) Filed: Feb. 10, 2021

(65) Prior Publication Data

US 2021/0161301 A1 Jun. 3, 2021

Related U.S. Application Data

(63) Continuation-in-part of application No. PCT/US2019/048215, filed on Aug. 26, 2019.
(Continued)

(51) Int. Cl.
*A47C 21/04* (2006.01)
*A47C 21/06* (2006.01)
*A47C 27/15* (2006.01)

(52) U.S. Cl.
CPC ..... *A47C 21/046* (2013.01); *A47C 21/06* (2013.01); *A47C 27/15* (2013.01)

(58) Field of Classification Search
CPC ..... A47C 27/15; A47C 21/046; A47C 21/042; A47C 21/04; A47C 27/14; A47C 21/06
See application file for complete search history.

(56) References Cited

U.S. PATENT DOCUMENTS 5,722,482 A 3/1998 Buckley
6,319,599 B1 * 11/2001 Buckley ..... C09K 5/063 36/83
(Continued)

FOREIGN PATENT DOCUMENTS

CN 102173114 9/2011
CN 104869869 8/2015
(Continued)

OTHER PUBLICATIONS

Written Opinion of International Application No. PCT/US2019/048215 dated Nov. 8, 2019.
(Continued)

*Primary Examiner* — Justin C Mikowski
*Assistant Examiner* — Ifeolu A Adeboyejo
(74) *Attorney, Agent, or Firm* — D'Ambrosio & Menon, PLLC; Usha Menon

(57) ABSTRACT

Body support cushions, such as mattresses, are disclosed. The cushions comprise a plurality of separate and distinct consecutive layers overlying over each other in a depth direction. Each layer includes thermal effusivity enhancing material with a thermal effusivity greater than or equal to 2,500 $Ws^{0.5}/(m^2K)$ and a solid-to-liquid phase change material (PCM) with a phase change temperature within the range of about 6 to about 45 degrees Celsius. The total thermal effusivity of each of the cooling layers increases with respect to each other in the depth direction, and the total mass of the PCM of each of the cooling layers increases with respect to each other along the depth direction. At least one layer of the cooling layers includes a gradient distribution of the mass of the PCM and the amount of the thermal effusivity enhancing material thereof that increases in the depth direction.

44 Claims, 19 Drawing Sheets

Related U.S. Application Data

(60) Provisional application No. 62/981,922, filed on Feb. 26, 2020, provisional application No. 62/770,707, filed on Nov. 21, 2018, provisional application No. 62/726,270, filed on Sep. 2, 2018, provisional application No. 62/722,177, filed on Aug. 24, 2018.

(56) References Cited

U.S. PATENT DOCUMENTS

| | | | | |
|---|---|---|---|---|
| 9,980,578 | B2 | 5/2018 | Mikkelsen et al. | |
| 10,765,228 | B2 | 9/2020 | Mikkelsen et al. | |
| 11,248,153 | B2 * | 2/2022 | Lalouette | A61G 5/1048 |
| 2006/0260058 | A1 * | 11/2006 | Schmidt | A47C 21/046 5/636 |
| 2009/0142551 | A1 * | 6/2009 | Fox | B32B 5/245 427/331 |
| 2014/0141233 | A1 * | 5/2014 | Crawford | C08K 5/01 5/636 |
| 2014/0165292 | A1 * | 6/2014 | Gladney | A47C 27/05 5/717 |
| 2014/0183403 | A1 * | 7/2014 | Peterson | A47C 27/15 252/75 |
| 2014/0208517 | A1 * | 7/2014 | Gross | A47C 27/15 5/691 |
| 2015/0040327 | A1 * | 2/2015 | Mikkelsen | A47C 27/15 5/652 |
| 2015/0296994 | A1 * | 10/2015 | Mikkelsen | A47C 21/046 5/655.4 |
| 2015/0351557 | A1 * | 12/2015 | Allen | A47C 27/085 5/652 |
| 2017/0055719 | A1 | 3/2017 | Jacquart | |
| 2019/0038040 | A1 * | 2/2019 | Mason | A47C 27/085 |
| 2019/0053633 | A1 * | 2/2019 | Rensink | A47C 27/148 |
| 2021/0267382 | A1 * | 9/2021 | Aou | A47G 9/1036 |
| 2022/0061544 | A1 * | 3/2022 | Gladney | B32B 5/245 |
| 2022/0061545 | A1 * | 3/2022 | Sieber | A47C 27/148 |
| 2022/0061546 | A1 * | 3/2022 | Gladney | A47C 27/064 |

FOREIGN PATENT DOCUMENTS

| | | |
|---|---|---|
| CN | 105578928 | 5/2016 |
| CN | 107454827 | 12/2017 |
| CN | 107924027 | 4/2018 |

OTHER PUBLICATIONS

Search Report of International Application No. PCT/US2019/048215 dated Nov. 8, 2019.

Written Opinion of International Application No. PCT/US2019/046242 dated Nov. 7, 2019.

Search Report of International Application No. PCT/US2019/046242 dated Nov. 7, 2019.

* cited by examiner

COOLING MATTRESSES, PADS OR MATS, AND MATTRESS PROTECTORS

CROSS-REFERENCE TO RELATED APPLICATIONS

The application claims priority benefit of U.S. Provisional Patent Application No. 62/722,177, filed on Aug. 24, 2018, entitled Bedding Component with Multiple Layers, U.S. Provisional Patent Application No. 62/726,270, filed on Sep. 2, 2018, entitled Automotive Components Gradient Cooling with Multiple Layers, U.S. Provisional Patent Application No. 62/770,707, filed on Nov. 21, 2018, entitled Bedding Component with Multiple Layers, PCT Patent Application No. PCT/US2019/046242, filed on Aug. 12, 2019, entitled Cooling Body Support Cushions and Methods of Manufacturing Same, U.S. Provisional Patent Application No. 62/981,922, filed Feb. 26, 2020, entitled Cooling Body Support Cushions, Mattresses and Methods of Manufacturing Same, and is a continuation-in-part of PCT Patent Application No. PCT/US2019/048215, filed on Aug. 26, 2019, entitled Cooling Body Support Cushions, Mattresses and Methods of Manufacturing Same the entire contents of all of which are hereby expressly incorporated herein by reference in their entireties.

FIELD OF THE DISCLOSURE

The present disclosure generally relates to cooling cushions, such as cooling bedding cushions, that include phase change material (PCM) and thermal effusivity enhancing material and provide a relatively high level of long lasting cooling to a user during use. The present disclosure also relates to methods of manufacturing such cooling cushions.

BACKGROUND

Many factors affect the amount and quality of sleep of a person. The type and quality of bedding, as well as climatic conditions at the bed or other sleeping space, can all affect a person's sleeping experience. Individuals having difficulty sleeping or enjoying a sound, uninterrupted sleep may experience physical discomfort. Such discomfort may arise as body-generated heat accumulates in the bedding cushions (e.g., a mattress and pillow(s)) on which the person is resting/laying, as air cannot circulate through the bedding to dissipate the person's emitted heat. It has been estimated that a resting human adult gives off about 100 Watts of energy. The heat absorbed or present in the bedding eventually radiates back to the user.

For example, in response to pillows becoming warm as body-generated heat accumulates in the pillow, sleepers often flip the pillow over in search of a "cool" side of the pillow. As another example, in response to a mattress becoming warm as body-generated heat accumulates in the mattress, sleepers often roll over or otherwise shift their position to a "cool" portion of the mattress and/or remove layers of bedding layers covering the sleeper (e.g., sheets, blankets, comforters and the like). Such activities thereby interrupt a period of sleep.

In prior bedding, body-generated heat accumulates in the bedding due to the nature and geometry of the materials used in bedding which have a tendency to store rather than dissipate heat. As the body of a sleeper contacts the surface of the bedding, body-generated heat is transferred to and stored in the immediate contact area of the bedding, resulting in a local temperature rise, which may cause sleeper discomfort. The heat that collects in the bedding (e.g., in the immediate contact area of the bedding) takes a significant amount of time to radiate to the environment, and thereby radiates back to the sleeper and warms the sleeper.

Traditionally, bedding has essentially consisted of layers or envelopes formed of various usually-dense natural materials, and/or synthetic foams and/or fibers, which store rather than dissipate heat. For example, various types of mattresses (and accessories therefore, such as mattress protectors and mattress pads) utilize layers of cotton, synthetic fiber, viscoelastic foam, poly urethane foam, latex foam, green bean shells and/or other stuffing materials in particular configurations in attempts to dissipate heat. However, such mattress constructs have only been able to dissipate relatively small amounts of heat for relatively short lengths of time and/or have been uncomfortable. For example, some such constructs may actually store heat over relatively long periods of time, resulting in higher temperatures, which make the user uncomfortable. The prior art thereby does not offer a simple, efficient, economical and comfortable bedding solutions that effectively deal with the heat-generated discomfort of a sleeper.

Other non-bedding body support cushions, such as furniture cushions, automobile/plane/boat seats (adult and child), child carriers, neck supports, leg spacers, apparel (e.g., shoes, hats, backpacks and clothing), pet accessories (e.g., pet beds, pet carrier inserts and pet apparel), exercise equipment cushions, blankets, pads, mats, construction materials (e.g., insulation, wall panels and flooring) and the like, suffer from the same heat-generated discomfort issues as bedding (as described above).

Therefore, there remains a need in the art for bedding products, such as mattresses, mattress components and accessories, and other body support cushions and mats/pads that dissipate at least a substantial portion of body-generated heat for a substantial amount of time to prevent sleeper discomfort (or provide sleeper comfort).

While certain aspects of conventional technologies have been discussed to facilitate disclosure of the invention, Applicants in no way disclaim these technical aspects, and it is contemplated that the claimed invention may encompass one or more of the conventional technical aspects discussed herein.

In this specification, where a document, act or item of knowledge is referred to or discussed, this reference or discussion is not an admission that the document, act or item of knowledge or any combination thereof was, at the priority date, publicly available, known to the public, part of common general knowledge, or otherwise constitutes prior art under the applicable statutory provisions; or is known to be relevant to an attempt to solve any problem with which this specification is concerned.

SUMMARY

Briefly, the present inventions satisfy the need for improved bedding cushions (such as mattresses, mattress cartridges, mattress covers, mattress fire resistant socks/caps, mattress protectors, mattress pads, mattress components, mattress accessories, pillows and the like), and other body support cushions, with phase change material (PCM) and relatively high thermal effusivity material that increase in heat dissipation effectiveness (e.g., heat storage/capacity, thermal effusivity, etc.) in a depth direction extending away from a user. The present cooling bedding cushions (such as mattresses, mattress components, and mattress accessories), mats/pads and other cushions address one or more of the problems and deficiencies of the art discussed above. However, it is contemplated that the cooling cushions may prove useful in addressing other problems and deficiencies in a number of technical areas. Therefore, the disclosed cooling cushions and claimed inventions should not necessarily be construed as limited to addressing any of the particular problems or deficiencies discussed herein.

Certain embodiments of the presently-disclosed cooling cushions, and methods for forming the cushions and aspects or components thereof, have several features, no single one of which is solely responsible for their desirable attributes. Without limiting the scope of the cooling cushions and methods as defined by the claims that follow, their more prominent features will now be discussed briefly. After considering this discussion, and particularly after reading the section of this specification entitled "Detailed Description," one will understand how the features of the various embodiments disclosed herein provide a number of advantages over the current state of the art.

The present disclosure provides a mattress, comprising: a plurality of separate and distinct consecutive cooling layers overlying over each other in a depth direction that extends from a proximal portion of the mattress that is proximate to a user to a distal portion of the mattress that is distal to the user, wherein each layer of the cooling layers includes thermal effusivity enhancing material (TEEM) with a thermal effusivity greater than or equal to 2,500 $Ws^{0.5}/(m^2K)$ and a solid-to-liquid phase change material (PCM) with a phase change temperature within the range of about 6 to about 45 degrees Celsius, wherein the total thermal effusivity of each of the cooling layers increases with respect to each other in the depth direction, wherein the total mass of the PCM of each of the cooling layers increases with respect to each other along the depth direction, and wherein at least one layer of the cooling layers includes a gradient distribution of the mass of the PCM and the amount of the TEEM thereof that increases in the depth direction.

A plurality of the cooling layers include the gradient distribution of the mass of the PCM thereof. Each of the cooling layers includes the gradient distribution of the mass of the PCM thereof. A plurality of the cooling layers include the gradient distribution of the mass of the TEEM thereof. Each of the cooling layers includes the gradient distribution of the mass of the TEEM thereof.

The at least one layer of the cooling layers that includes the gradient distribution of the mass of the PCM and the amount of the TEEM thereof that increases in the depth direction comprises: a proximal portion or segment that is proximate to the proximal portion of the mattress, the proximal portion or segment having a first total mass of the PCM and a first total mass of the TEEM of the layer; and a distal portion or segment that is proximate to the distal portion of the mattress, the distal portion or segment having a second total mass of the PCM and a second total mass of the TEEM of the layer, the second total mass of the PCM being greater than the first total mass of the PCM, and the second total mass of the TEEM being greater than the first total mass of the TEEM. According to one embodiment, the second total mass of the PCM is at least 3% greater than the first total mass of the PCM, and the second total mass of the TEEM is at least 3% greater than the first total mass of the TEEM. The second total mass of the PCM is greater than the first total mass of the PCM by an amount within the range of about 3% to about 100% thereof, and the second total mass of the TEEM is greater than the first total mass of the TEEM by an amount within the range of about 3% to about 100% thereof. The second total mass of the PCM is greater than the first total mass of the PCM by an amount within the range of about 10% to about 50% thereof, and the second total mass of the TEEM is greater than the first total mass of the TEEM by an amount within the range of about 10% to about 50% thereof. According to one specific embodiment, the first total mass of the PCM may be about 29,000 J/m2 and the second total mass of the PCM may be about 38,000 J/m2.

The at least one layer of the cooling layers that includes the gradient distribution of the mass of the PCM and the amount of the TEEM thereof that increases in the depth direction further comprises: a medial portion positioned between the proximal and distal portions of the layer in the depth direction having a third total mass of the PCM and a third total mass of the TEEM of the layer, the third total mass of the PCM being greater than the first total mass of the PCM and less than the second total mass of the PCM, and the third total mass of the TEEM being greater than the first total mass of the TEEM and less than the second total mass of the TEEM. The third total mass of the PCM is at least 3% greater than the first total mass of the PCM and at least 3% less than the second total mass of the PCM, and the third total mass of the TEEM is at least 3% greater than the first total mass of the TEEM and at least 3% less than the second total mass of the TEEM. The third total mass of the PCM is at least greater than the first total mass of the PCM and less than the second total mass of the PCM by an amount within the range of about 3% to about 100% thereof, and the third total mass of the TEEM is greater than the first total mass of the TEEM and less than the second total mass of the TEEM by an amount within the range of about 3% to about 100% thereof. The third total mass of the PCM is at least greater than the first total mass of the PCM and less than the second total mass of the PCM by an amount within the range of about 10% to about 50% thereof, and the third total mass of the TEEM is greater than the first total mass of the TEEM and less than the second total mass of the TEEM by an amount within the range of about 10% to about 50% thereof.

The gradient distribution of the mass of the PCM and the amount of the TEEM of at least one layer of the cooling layers comprises an irregular gradient distribution of the mass of the PCM and the amount of the TEEM along the depth direction.

The gradient distribution of the mass of the PCM and the amount of the TEEM of at least one layer of the cooling layers comprises a consistent gradient distribution of the mass of the PCM and the amount of the TEEM along the depth direction.

The total mass of the PCM of each of the cooling layers increases with respect to each other along the depth direction by at least 3%.

The total mass of the PCM of each of the cooling layers increases with respect to each other along the depth direction by an amount within the range of about 3% to about 100%.

The total mass of the PCM of each of the cooling layers increases with respect to each other along the depth direction by an amount within the range of about 10% to about 50%.

The total thermal effusivity of each of the cooling layers increases with respect to each other in the depth direction by about at least about 3%.

The total thermal effusivity of each of the cooling layers increases with respect to each other in the depth direction by an amount within the range of about 3% to about 100%.

The total thermal effusivity of each of the cooling layers increases with respect to each other in the depth direction by an amount within the range of about 10% to about 50%.

The cooling layers comprise a first scrim layer, a first foam layer underlying the first scrim layer in the depth direction, a second foam layer underlying the first foam layer in the depth direction, and a second scrim layer underlying the second foam layer in the depth direction.

The first foam layer directly underlies the first scrim layer in the depth direction. The second foam layer directly underlies the first foam layer in the depth direction. The second scrim layer directly underlies the second foam layer in the depth direction. The first foam layer comprises a viscoelastic polyurethane foam layer, and the second foam layer comprises a latex foam layer. The first foam layer comprises a latex foam layer, and the second foam layer comprises a viscoelastic polyurethane foam layer. The first scrim layer and the second scrim layer are separate and distinct scrim layers. The first scrim layer and the second scrim layer are proximal and distal portions, respectively, of an integral scrim layer. The integral scrim layer extends fully about at least a portion of the first and second foam layers. The integral scrim layer extends fully about the entirety of the first and second foam layers. The cooling layers further comprise a batting layer underlying the second scrim layer in the depth direction.

Further comprising a base portion underlying the cooling layers in the depth direction, wherein the base portion is void of the PCM and the TEEM. The second scrim layer underlies the base portion in the depth direction. The cooling layers further comprise a proximal fabric cover layer, the first scrim layer underlying the proximal fabric cover layer in the depth direction.

The proximal fabric cover layer defines a proximal side surface of the mattress. The cooling layers further comprise a fire resistant sock layer comprising a fire resistant or fire proof material, the first scrim layer underlying the fire resistant sock layer in the depth direction. The first scrim layer directly underlies the fire resistant sock layer in the depth direction. The fire resistant sock layer is formed of the TEEM.

These and other features and advantages of the disclosure and inventions will become apparent from the following detailed description of the various aspects of the invention taken in conjunction with the appended claims and the accompanying drawings.

BRIEF DESCRIPTION OF THE DRAWINGS

The subject matter, which is regarded as the invention(s), is particularly pointed out and distinctly claimed in the claims at the conclusion of the specification. The foregoing and other features, aspects, and advantages of the disclosure will be readily understood from the following detailed description taken in conjunction with the accompanying drawings, which are not necessarily drawn to scale, wherein:

DETAILED DESCRIPTION OF THE INVENTION

Aspects of the present disclosure and certain features, advantages, and details thereof, are explained more fully below with reference to the non-limiting embodiments illustrated in the accompanying drawings. Descriptions of well-known materials, fabrication tools, processing techniques, etc., are omitted so as to not unnecessarily obscure the details of the inventions. It should be understood, however, that the detailed description and the specific example(s), while indicating embodiments of inventions of the present disclosure, are given by way of illustration only, and are not by way of limitation. Various substitutions, modifications, additions and/or arrangements within the spirit and/or scope of the underlying inventive concepts will be apparent to those skilled in the art from this disclosure.

Approximating language, as used herein throughout disclosure, may be applied to modify any quantitative representation that could permissibly vary without resulting in a change in the basic function to which it is related. Accordingly, a value modified by a term or terms, such as "about" or "substantially," is not limited to the precise value specified. For example, these terms can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%. In some instances, the approximating language may correspond to the precision of an instrument for measuring the value.

Thermal energy storage is the temporary storage of high or low temperature energy for later use. It bridges the time gap between energy requirements and energy use. Among the various heat storage techniques, latent heat storage is particularly attractive due to its ability to provide a high storage density at nearly isothermal conditions. Phase change material (referred to herein as "PCM") takes advantage of latent heat that can be stored or released from the material over a relatively narrow temperature range. PCM possesses the ability to change its state with a certain temperature range. These materials absorb energy during a heating process as phase change takes place, and release energy to the environment during a reverse cooling process and phase change. The absorbed or released heat content is the latent heat. In general, PCM can thereby be used as a barrier to heat, since a quantity of latent heat must be absorbed by the PCM before its temperature can rise. Similarly, the PCM may be used a barrier to cold, as a quantity of latent heat must be removed from the PCM before its temperature can begin to drop.

Figure 1:
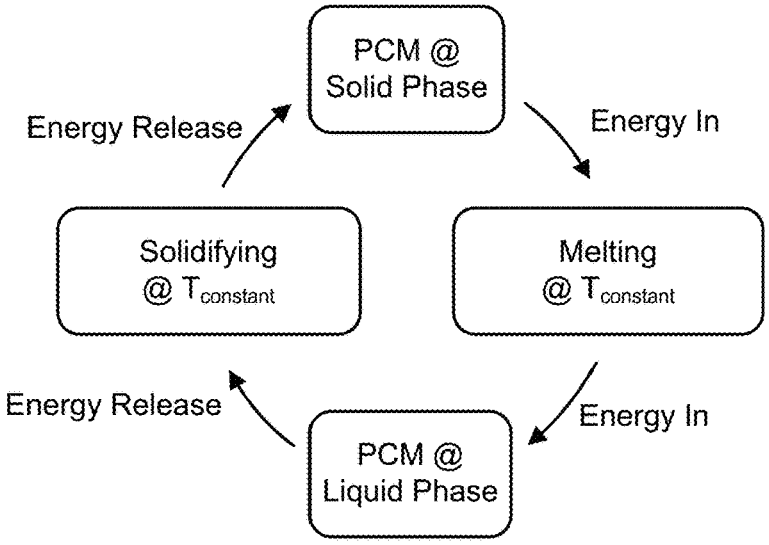
Prior Art FIG. 1
FIG. 1 is a schematic illustrating the phase change cycle of a solid-liquid phase transitioning phase change material (PCM)

PCM which can convert from solid to liquid state or from liquid to solid state is the most frequently used latent heat storage material, and suitable for the manufacturing of heat-storage and thermo-regulated textiles and clothing. As shown in FIG. 1, these PCMs absorb energy during a heating or melting process at a substantially constant phase change or transition temperature as a solid to liquid phase change takes, and release energy during a cooling or freezing/crystalizing/solidifying process at the substantially constant transition temperature as a liquid to solid phase change takes place.

Figure 2:
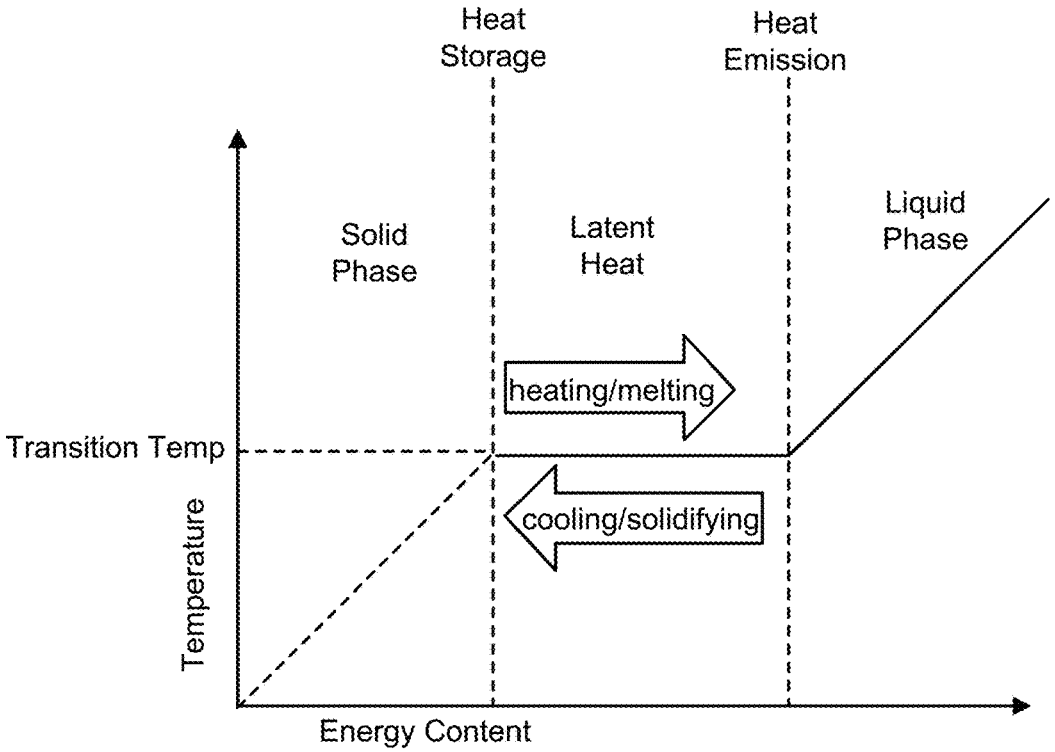
Prior Art FIG. 2
FIG. 2 is a graph illustrating the temperature and energy content profile of a solid-liquid phase transitioning PCM.
Figure 3:
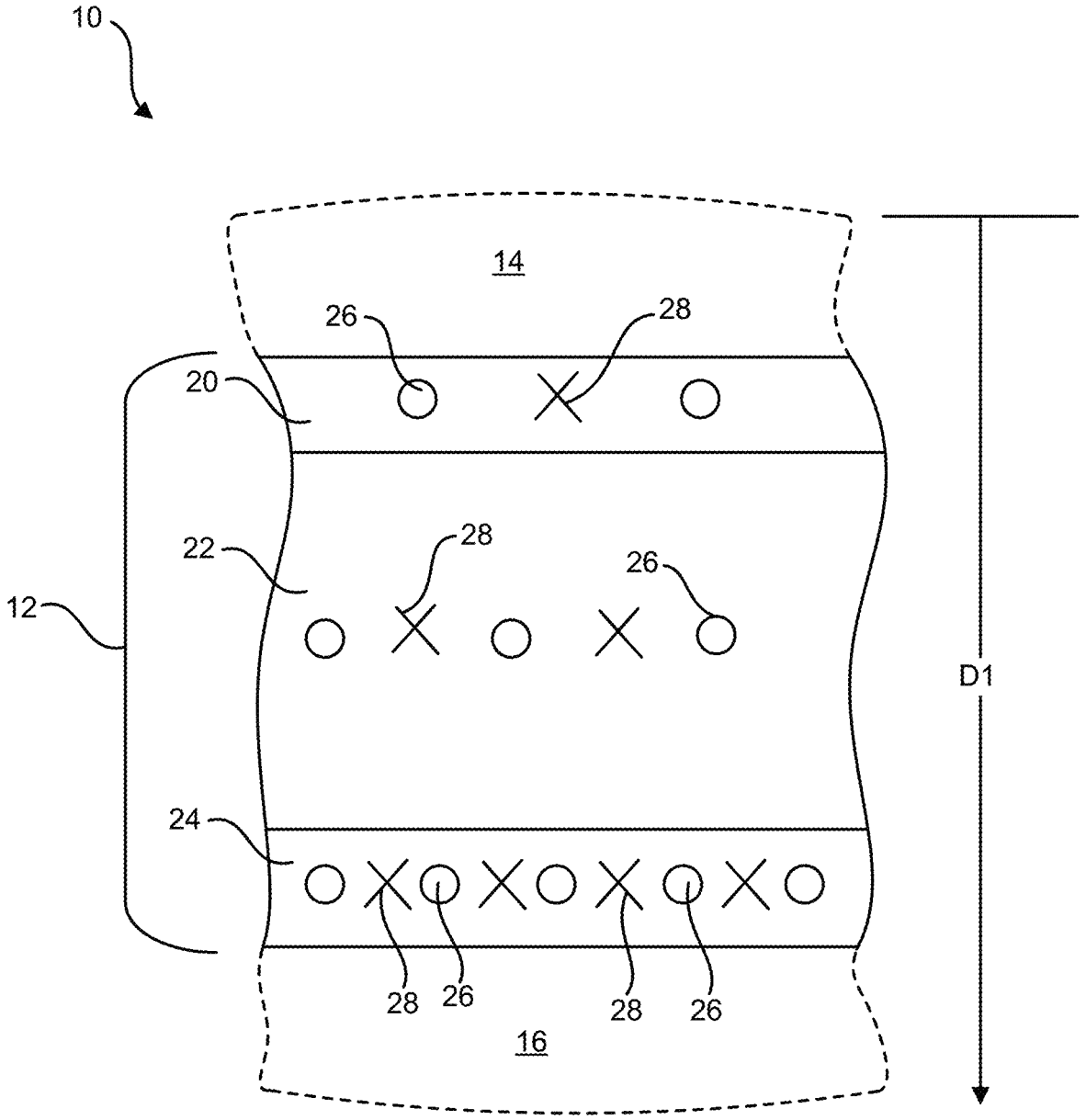
FIG. 3 illustrates a cross-sectional view of a plurality of separate and distinct exemplary layers of a cooling cushion with an inter-layer gradient distribution of phase change material and effusivity enhancing material according to the present disclosure.

FIG. 2 shows a typical solid-liquid phase transitioning PCM. From an initial solid state at a solid-state temperature, the PCM initially absorbs energy in the form of sensible heat. In contrast to latent heat, sensible energy is the heat released or absorbed by a body or a thermodynamic system during processes that result in a change of the temperature of the system. As shown in FIG. 2, when the PCM absorbs enough energy such that the ambient temperature of the PCM reaches the transition temperature of the PCM, it melts and absorbs large amounts of energy while staying at an almost constant temperature (i.e., the transition temperature)—i.e., latent heat/energy storage. The PCM continues to absorb energy while staying at the transition temperature until all of the PCM is transformed to the liquid phase, from which the PCM absorbs energy in the form of sensible heat, as shown in FIG. 3. In this way, heat is removed from the environment about the PCM and stored while the temperature is maintained at an "optimum" level during the solid to liquid phase change. In the reverse process, when the environmental temperature/energy about the liquid PCM falls to the transition temperature, it solidifies again, releasing/emitting its stored latent heat energy to the environment while staying at the transition temperature until all of the PCM is transformed to the solid phase. Thus, the managed temperature again remains consistent.

As such, during the complete melting process, the temperature of a typical solid-liquid phase transitioning PCM as well as its surrounding area remains nearly constant. The same is true for the solidification (e.g., crystallization) process; during the entire solidification process, the temperature of the PCM does not change significantly. The large heat transfer during the melting process as well as the solidification process, without significant temperature change, makes these PCMs interesting as a source of heat storage material in practical textile applications.

However, the insulation effect reached by a PCM is dependent on temperature and time; it takes place only during the phase change and thereby only in the temperature range of the phase change, and terminates when the phase change in all of the PCM is complete. Since, this type of thermal insulation is temporary; therefore, it can be referred to as dynamic thermal insulation. In addition, modes of heat transfer are strongly dependent on the phase of the material involve in the heat transfer processes. For materials that are solid, conduction is the predominate mode of heat transfer. While for liquid materials, convection heat transfer predominates. Unfortunately, some PCMs have a relatively low heat-conductivity, which fails to provide a sufficient heat exchange rate between the PCM itself and/or a surrounding environment medium or environment. As such, incorporation of PCM in a cushion will not result in a large amount of cooling for an extended period of time (e.g., hours) as the PCM (and the cushion as a whole) will relatively quickly reach is maximum heat absorption ability, and them emit or radiate the heat back to the user.

The phrases "body support cushion," "support cushion" and "cushion" are used herein to refer to any and all such objects having any size and shape, and that are otherwise capable of or are generally used to support the body of a user or a portion thereof. Although some exemplary embodiments of the disclosed body support cushions of the present disclosure are illustrated and/or described in the form of mattresses, mattress protectors, mattress pads and mats/pads, and thereby may be dimensionally sized to support the entire or the majority of the body of a user, it is contemplated that the aspects and features described therewith are equally applicable to pillows, seat cushions, seat backs, furniture, infant carriers, neck supports, leg spacers, apparel (e.g., shoes, hats, backpacks and clothing), pet accessories (e.g., pet beds, pet carrier inserts and pet apparel), blankets, exercise equipment cushions, construction materials (e.g., insulation, wall panels and flooring) and the like.

In one aspect, the disclosure provides body support cushions that include a plurality of separate and distinct (i.e., differing) layers 10, as shown in FIG. 3. The plurality of layers 10 include a plurality of separate and distinct consecutive layers 12 overlying over each other in a depth direction D1 that extends from an outer or top (or proximate) portion 14 of the cushion that is proximate to a user to an inner or bottom (or distal) portion 16 of the cushion that is distal to the user along the thickness of the cushion.

As shown in FIG. 3, the outer portion 14 of the cushion may be defined or include one or more additional layers of material(s) formed over or overlying a top layer 20 of the plurality of layers 10, or may be a top or exterior surface or surface portion of the top layer 20 in the depth direction D1. In other words, the top or upper-most layer 20 of the plurality of layers 10 (in the thickness and/or the depth direction D1) may define the outer portion 14 of the cushion, or the outer portion 14 of the cushion may be defined by a layer overlying the top or upper-most layer 20 of the plurality of layers 10 in the depth direction D1.

Similarly, as also shown in FIG. 3, the inner portion 16 of the cushion may be defined or include one or more additional layers of material(s) formed under or underlying a bottom layer 24 of the plurality of layers 10, or may be a bottom or exterior surface or surface portion of the bottom layer 24 in the depth direction D1. In other words, the bottom or lowest layer 24 of the plurality of layers 10 (in the thickness and/or the depth direction D1) may define the bottom or inner portion 16 of the cushion, or the inner portion 16 of the cushion may be defined by a layer underlying the bottom or lowest layer 24 of the plurality of layers 10 in the depth direction D1. The depth direction D1 may thereby extend from the top exterior surface or surface portion of the outer portion 14 to the bottom or inner exterior surface or surface portion of the inner or bottom portion 16 (and through a middle or medial portion) of the cushion.

The plurality of layers 10 may include two or more layers. For example, while a top layer 20, a medial layer 22 and a bottom layer 24 are shown and described herein with respect to FIG. 3, the plurality of layers 10 may only include two separate and distinct consecutive (and potentially contiguous) layers, or may include four or more layers separate and distinct consecutive (and potentially contiguous) layers 12. Further, although the plurality of layers 10 are separate and distinct layers, at least one of the plurality of layers 10 may be coupled (removably or fixedly coupled) to at least one other layer of the plurality of layers 10 (or another layer of the cushion), or the plurality of layers 10 may not be coupled to each other (but may be contiguous). For example, the outer layer 20 and the inner layer 24 of the plurality of layers 10 may comprise portions of, or form, an enclosure or bag that surrounds (fully or partially) or encloses at least the medial layer 22 (and additional layer, potentially), and may (or may not) be directly coupled to each other. As another example, the plurality of layers 10 may be separate components and extend over each other (freely stacked or coupled to each other), and another additional layer (or a pair or layers) may enclose or surround (fully or partially) (or sandwich) the plurality of layers 10.

The plurality of differing consecutive layers 12 comprise "active" layers that are effective in cooling a user (e.g., a human user or a non-human/animal user) who rests on or otherwise contacts the top or outer portion 14 of the cushion by drawing a substantial amount of heat (energy) away from the user substantially quickly and for a relatively long period of time, and storing and/or dissipating the heat remotely from the user for a substantial amount of time. As shown in FIG. 3, the plurality of differing consecutive layers 10 are "active" in that they each include PCM 26 and/or a material with a relatively high thermal effusivity (e) 28 (generally referred to herein as "thermal effusivity enhancing material" and "TEEM"). In some embodiments, the material with a relatively high thermal effusivity of a particular layer may include a thermal effusivity that is substantially higher than a base material of the layer (to which the TEEM may be coupled to) and, thereby, enhances the thermal effusivity of the layer as a whole. In some other embodiments, the material with a relatively high thermal effusivity (TEEM) of a particular layer may define the layer itself (i.e., may be the base material of the layer).

The PCM 26 of a layer of the plurality of layers 10 may comprise a plurality of pieces, particles, bits or relatively small quantities of phase change material(s). The TEEM 28 of a layer of the plurality of layers 10 may comprise a plurality of pieces, particles, bits or relatively small quantities of material having a relatively high thermal effusivity, or the layer itself may be comprised of the material having a relatively high thermal effusivity (i.e., the material having a relatively high thermal effusivity the (base) material of the layer).

Each of the plurality of layers 10 thereby includes a mass of PCM 26, a mass of TEEM 28, or a mass of PCM 26 and a mass of TEEM 28, as shown in FIG. 3. As shown in FIG. 3, in some embodiments some or all of the plurality layers 10 may comprise the PCM 26 and the TEEM 28. In some other embodiments, all of the plurality of layers 10 may include the TEEM 28, but one or more layer may be void of the PCM 26. In some other embodiments, all of the plurality of layers 10 may include the PCM 26, but one or more layer may be void of the TEEM 28.

In some embodiments, one or more layers of the plurality of layers 10 that include the PCM 28 and the TEEM 28 may comprise a coating that couples the PCM 28 and the TEEM 28 to a base material thereof. In some such embodiments, the PCM 28 may comprises about 50% to about 80% of the mass of the coating, and the TEEM 28 may comprise about 5% to about 8% of the mass of the coating, after the coating has hardened, cured or is otherwise stable. In some such embodiments, the PCM 28 may comprises about 30% to about 65% of the mass of the coating, and the TEEM 28 may comprise about 3% to about 5% of the mass of the coating, when the coating is initially applied (i.e., the pre-hardened, cured or applied coating mixture) (and prior to application). The coating (as-applied and after curing) may further include a binder material that acts to chemically and/or physically couple or bond the PCM 26 and/or the TEEM 28 to the base material of the respective layer.

The PCM 26 may be coupled to a base material forming a respective layer 20, 22, 24 of the plurality of layers 10, or may be incorporated in/with the base material of the respective layer 20, 22, 24. The PCM 26 may be any phase change material(s). In some embodiments, the PCM 26 may comprise any solid-to-liquid phase change material(s) with a phase change temperature within the range of about 6 to about 45 degrees Celsius, or within the range of about 15 to about 45 degrees Celsius, or within the range of 20 to about 37 degrees Celsius, or within the range of 25 to about 32 degrees Celsius. In some embodiments, the PCM 26 may be or include at least one hydrocarbon, wax, beeswax, oil, fatty acid, fatty acid ester, stearic anhydride, long-chain alcohol or a combination thereof. In some embodiments, the PCM 26 may be paraffin. However, as noted above, the PCM 26 may be any phase change material(s), such as any solid-to-liquid phase change material(s) with a phase change temperature within the range of about 6 to about 45 degrees Celsius.

In some embodiments, the PCM 26 may be in the form of microspheres. For example, in some embodiments, the PCM 26 may be packaged or contained in microcapsules or microspheres and applied to or otherwise integrated with the plurality of layers 10. In some such embodiments, the PCM 26 may be a paraffinic hydrocarbon, and contained or encapsulated within microspheres (also referred to as "micro-capsules"), which may range in diameter from 1 to 100 microns for example. In some embodiments, the PCM 26 may be polymeric microspheres containing paraffinic wax or n-octadecane or n-eicosane. The paraffinic wax can be selected or blended to have a desired melt temperature or range. The polymer for the microspheres may be selected for compatibility with the material of the respective layer of the plurality of layers 10. However, the PCM 26 may be in any form or structure.

The layers of the plurality of layers 10 that include the PCM 26 may each include the same PCM material, or may each include a differing PCM material. For example, each layer of the plurality of layers 10 that includes the PCM 26 may include the same PCM material, and/or at least one layer of the plurality of layers 10 that includes the PCM 26 may include a differing PCM material than at least one other layer of the plurality of layers 10 that includes the PCM 26. The PCM 26 of at least one layer of the plurality of layers 10 may thereby be the same material or a different material than the PCM 26 of at least one other layer of the plurality of layers 10. In this way, the latent heat storage capacity (typically referred to as "latent heat," an expressed in J/g) of the PCM 26 of at least one layer of the plurality of layers 10 may thereby be the same material or a different latent heat storage capacity than the PCM 26 of at least one other layer of the plurality of layers 10. In some embodiments that include two or layers with differing PCM 26 and/or differing latent heat storage capacities, the PCM material 26 with the lowest latent heat storage capacity may include a latent heat storage capacity that is within 200%, 100%, within 50%, within 25%, within 10% or within 5% the PCM material 26 with the greatest latent heat storage capacity.

A respective layer 20, 22, 24 of the plurality of layers 10 that includes the PCM 26 material may include any total amount (e.g., mass) of the PCM 26. However, the total mass of the PCM 26 each of the plurality of layers 10, and/or the total latent heat (absorption) potential of each of the plurality of layers 10 (as a whole) including the PCM 26 (i.e., the total latent heat (e.g., Joules) that can be absorbed by the PCM 26 thereof (during full phase change)) increases with respect to each other along the depth direction D1, as illustrated graphically in FIG. 3 by the increasing number of X's in the outer layer 20, the medial layer 22 and the inner layer 24. Stated differently, the consecutive layers 12 of the plurality of layers 10 that contain the PCM 26 include an inter-layer gradient distribution of the total mass and/or the total latent heat (absorption) potential of the PCM 26 that increases in the depth direction D1, as illustrated graphically in FIG. 3. In some embodiments, the outermost layer(s) 20 of the plurality of phase change layers 10 may include at least 25 $J/m^2$ (e.g., assuming the layers are flat) of the PCM 26, at least 50 $J/m^2$ of the PCM 26, or at least 100 $J/m^2$ of the PCM 26.

The plurality of layers 20 can thereby include differing loadings (e.g., differing PCM materials) and/or amounts (by mass) of the PCM 26 such that the total latent heat (absorption) potential of the PCM 26 increases from consecutive layer to layer including the PCM 26 in the depth direction D1 within the cushion (i.e., away from the user), as shown in FIG. 3. The cushion can thus include differing loading and/or amounts (by mass) of PCM along the thickness of the cushion. As noted above, in some embodiments two or more layers of the plurality of layers 10 may include the PCM 26 (which may or may not be contiguous), or each/all of the layers of the plurality of layers 10 may include the PCM 26 (which may or may not be contiguous). The bottom-most layer in the depth direction D1 thereby contains the highest loading or amount of the PCM 26 (i.e., the largest mass of the PCM 26 and/or the greatest latent heat potential) as shown in FIG. 3.

In some embodiments, the inter-layer gradient distribution of the total mass of the PCM 26, and/or the total latent heat potential, of the plurality of layers 10 comprises an increase thereof along the depth direction D1 between consecutive PCM-containing layers of at least 3%, within the range of about 3% to about 100%, or within the range of about 10% to about 50%. Stated differently, the total mass of the PCM 26, and/or the total latent heat potential, of each of the plurality of layers 10 that contains PCM 26 increases with respect to each other along the depth direction by at least 3%, within the range of about 3% to about 100%, or within the range of about 10% to about 50%.

Figure 4:
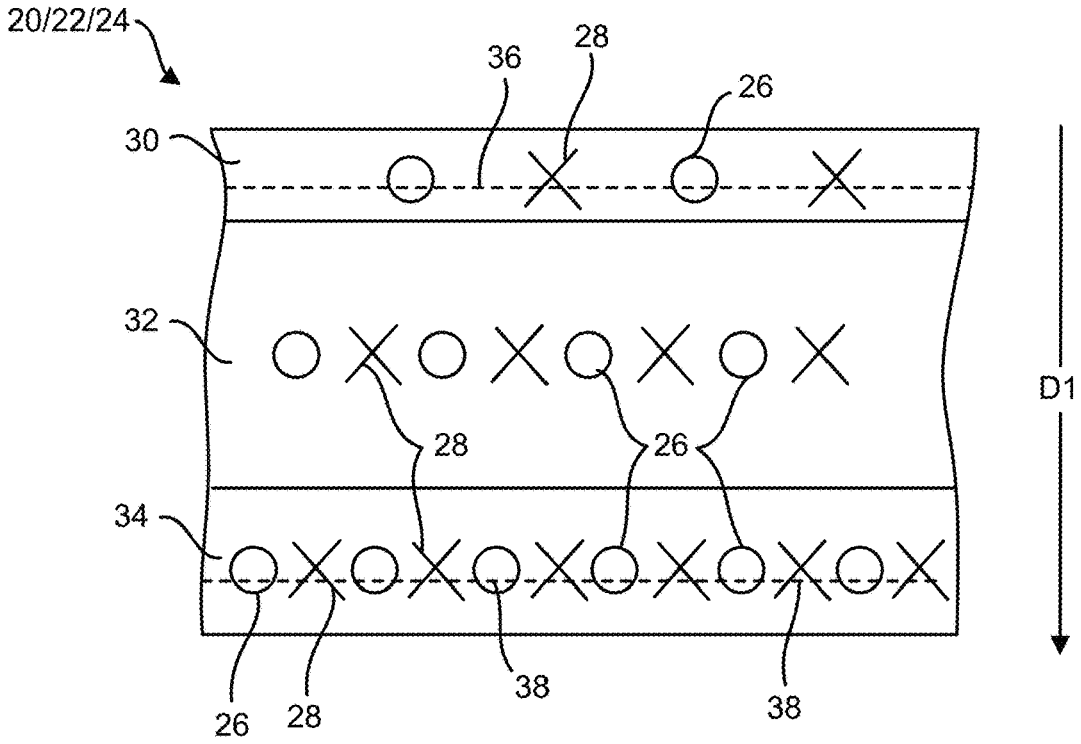
FIG. 4 illustrates a cross-sectional view of an exemplary layer of a cooling cushion with an intra-layer gradient distribution of phase change material and effusivity enhancing material according to the present disclosure.
Figure 5:
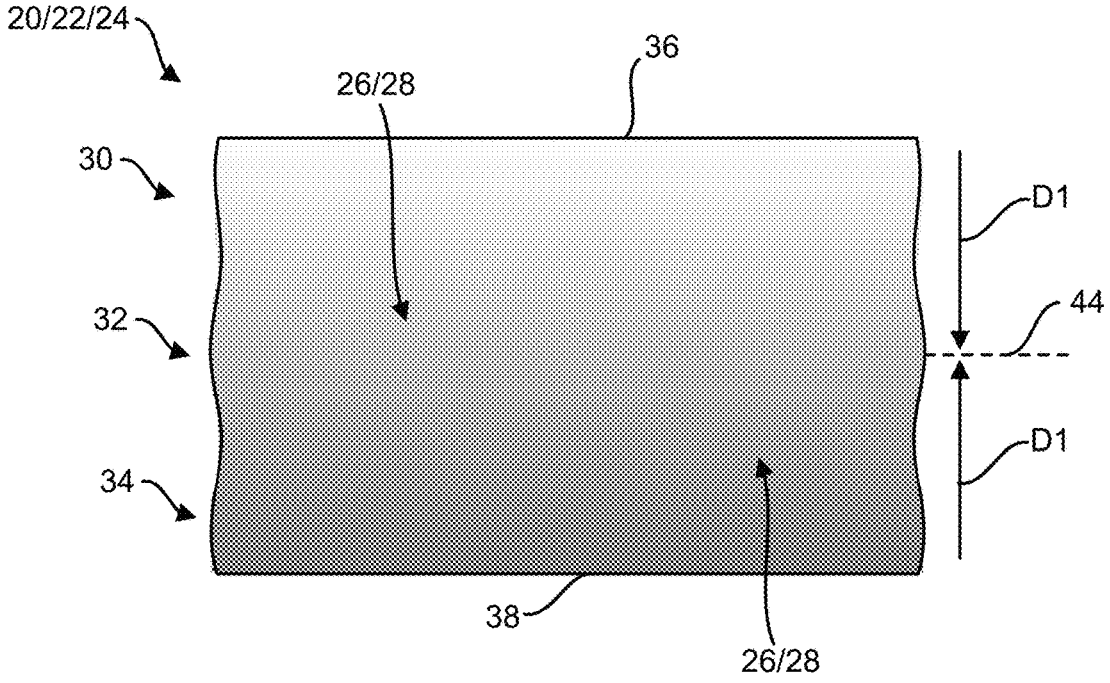
FIG. 5 illustrates a cross-sectional view of another exemplary layer of a cooling cushion with an intra-layer gradient distribution of phase change material and effusivity enhancing material according to the present disclosure.

As shown in FIGS. 4 and 5, at least one layer 20, 22, 24 of the plurality of layers 10 includes a gradient distribution of the mass of the and/or the latent heat potential of the PCM 26 thereof that increases in the depth direction D (i.e., away from the user). Stated differently, at least one layer 20, 22, 24 of the plurality of layers 10 includes an intra-layer gradient distribution of the mass and/or the latent heat potential of the PCM 26 thereof that increases in the depth direction D1.

For example, as shown in FIG. 4, at least one layer 20, 22, 24 of the of the plurality of layers 10 includes a first lesser amount (e.g., mass) of the PCM 26 and/or total latent heat potential of the PCM 26 in/on a proximal portion 30 of the layer this is proximal to the exterior portion 14 of the cushion (and the user) along the depth direction D1, and a second greater amount (e.g., mass) of the PCM 26 and/or total latent heat potential of the PCM 26 on/in a distal portion 34 of the layer 20, 22, 24 that is distal to the exterior portion 14 of the cushion (and the user) along the depth direction D (i.e., the second amount (e.g., mass) and/or total latent heat potential of the PCM 26 being greater than the first amount (e.g., mass) and/or total latent heat potential of the PCM 26, respectively). The second total amount (e.g., total mass) and/or total latent heat potential of the PCM 26 of the distal portion 34 of the layer 20, 22, 24 may be greater than the first total amount (e.g., total mass) and/or total latent heat potential of the distal portion 30 thereof by at least 3%, within the range of about 3% to about 100%, or within the range of about 10% to about 50%.

As also shown in FIG. 4, a layer 20, 22, 24 of the plurality of layers 10 including the gradient PCM 26 along the depth direction D1 may further include a medial portion 32 positioned between the proximal portion 30 and the distal portion 34 along the depth direction D1 that includes a third total amount (e.g., mass) and/or total latent heat potential of the total PCM 26 thereof that is greater than the first total amount (e.g., mass) and/or total latent heat potential of the total PCM 26 of the proximal portion 30 but less than the second amount (e.g., mass) and/or total latent heat potential of the total PCM 26 of the distal portion 34, as shown in FIG. 4. The third total amount (e.g., total mass) and/or total latent heat potential of the PCM 26 of the medial portion 32 may be greater than the first total amount (e.g., total mass) and/or total latent heat potential of the PCM 26 of the proximal portion 30 by at least 3%, within the range of about 3% to about 100%, or within the range of about 10% to about 50%, and less than the second total amount (e.g., total mass) and/or total latent heat potential of the PCM 26 of the distal portion 34 by at least 3%, within the range of about 3% to about 100%, or within the range of about 10% to about 50%. However, a layer of the plurality of layers 10 including an intra-layer gradient distribution of the amount (e.g., mass) and/or total latent heat potential of the total PCM 26 thereof may include any number of portions along the depth direction D1 that increase in total amount (e.g., mass) and/or total latent heat potential of the PCM 26 along the depth direction D1.

The intra-layer gradient of the PCM 26 of one or more layers of the plurality of layers 10 (potentially the plurality of consecutive layers 12) that increases in the depth direction D1 may comprise an irregular gradient distribution of the amount (e.g., mass) and/or total latent heat potential of the PCM 26 along the depth direction D1, as shown in FIG.

4. In some such embodiments, a layer 20, 22, 24 of the plurality of layers 10 may include two or more distinct bands or zones 30, 32, 34 of progressively increasing loading of the PCM 26 in the depth direction D1 (i.e., away from the user) by at least 3%, within the range of about 3% to about 100%, or within the range of about 10% to about 50%, as shown in FIG. 4. For example, as shown in FIG. 4, the outer side portion 30, the medial portion 32 and the inner side portion 34 may be distinct zones of the thickness of the respective layer 20, 22, 24 with distinct differing amounts (e.g., masses) and/or total latent heat potentials of the PCM 26 along the depth direction D1 (such as amount that increase by at least 3%, within the range of about 3% to about 100%, or within the range of about 10% to about 50% from layer to layer in the depth direction D1).

Alternatively, as shown in FIG. 5, the intra-layer gradient of the PCM 26 of one or more layers of the plurality of layers 10 (potentially the plurality of consecutive layers 12) that increases in the depth direction D1 may comprise a smooth or regular gradient distribution of at least a portion of the mass and/or total latent heat potential of the PCM 26 thereof along the depth direction D1. As shown in FIG. 5, at least one layer 20, 22, 24 of the plurality of layers 10 may include a relatively constant/consistent progressive gradient of at least a portion of the loading of the mass and/or the total latent heat potential of the PCM 26 along the depth direction D1 within the cushion (i.e., away from the user). Such a layer with the relatively constant/consistent progressive gradient of at least a portion of the loading of the mass and/or total latent heat potential of the PCM 26 along the depth direction D1 may include the top/proximal portion 30 (of the thickness of the layer) that is proximate to the outer portion 14 of the cushion and the user that contains less total mass and/or total latent heat potential of the PCM 26 than the bottom/distal portion 32 (of the thickness of the layer) proximate to the distal portion 16 of the cushion (such as by at least 3%, within the range of about 3% to about 100%, or within the range of about 10% to about 50%), as shown in FIG. 5.

In some embodiments (not shown), a layer 20, 22, 24 of the plurality of layers 10 may include an intra-layer gradient of the PCM 26 thereof that includes a medial portion 32 that is positioned at or proximate to a middle or medial portion of the thickness of the cushion and contains the greatest total mass and/or total latent heat potential of the PCM 26 as compared to the proximal portion 30 and the distal portion 34 of the layer. The layer itself may thereby be positioned at or proximate to a middle or medial portion of the thickness of the cushion. In such embodiments, the cushion may comprise a two-sided cushion that provides cooling to a user from either the proximal side or the distal side of the cushion.

The TEEM 26 may be coupled to a base material forming a respective layer 20, 22, 24 of the plurality of layers 10, or may be incorporated in/with the base material or form the base material of the respective layer 20, 22, 24. The TEEM 28 includes a thermal effusivity that is greater than or equal to 1,500 $Ws^{0.5}/(m^2K)$, greater than or equal to 2,000 $Ws^{0.5}/(m^2K)$, greater than or equal to 2,500 $Ws^{0.5}/(m^2K)$, greater than or equal to 3,500 $Ws^{0.5}/(m^2K)$, greater than or equal to 5,000 $Ws^{0.5}/(m^2K)$, greater than or equal to 7,500 $Ws^{0.5}/(m^2K)$, greater than or equal to 10,000 $Ws^{0.5}/(m^2K)$, greater than or equal to 10,000 $Ws^{0.5}/(m^2K)$, greater than or equal to 12,500 $Ws^{0.5}/(m^2K)$, or greater than or equal to 15,000 $Ws^{0.5}/(m^2K)$. In some embodiments, the TEEM 28 includes a thermal effusivity that is greater than or equal to 2,500 $Ws^{0.5}/(m^2K)$.

In some embodiments, the TEEM 28 includes a thermal effusivity that is greater than or equal to 5,000 $Ws^{0.5}/(m^2K)$. In some embodiments, the TEEM 28 includes a thermal effusivity that is greater than or equal to 7,500 $Ws^{0.5}/(m^2K)$. In some embodiments, the TEEM 28 includes a thermal effusivity that is greater than or equal to 15,000 $Ws^{0.5}/(m^2K)$. It is noted that the greater the thermal effusivity of the TEEM 28 (for the same mass or volume thereto), the faster the plurality of layers 10 can pull or transfer heat energy away from the user (or proximate to the user) and to the PCM 26 or otherwise distal to the user, such as in the depth direction D1.

The TEEM 28 may comprise any material(s) with a thermal effusivity that is greater than or equal to 1,500 $Ws^{0.5}/(m^2K)$, or that is greater than or equal to 1,500 $Ws^{0.5}/(m^2K)$. For example, the TEEM 28 may comprise copper, an alloy of copper, graphite, an alloy of graphite, aluminum, an alloy of aluminum, zinc, an alloy of zinc, a ceramic, graphene, polyurethane gel (e.g., polyurethane elastomer gel) or a combination thereof. In some embodiments, the TEEM 28 may comprise pieces or particles of at least one metal material.

At least one of the plurality of layers 10 may be formed of a base material, and the TEEM 28 thereof may be attached, integrated or otherwise coupled to the base material. In such embodiments, the thermal effusivity of the TEEM 28 of a respective layer 20, 22, 24 of the plurality of layers 10 may be at least about 10%, at least about 25%, at least about 50%, at least about 100%, at least about 200%, at least about 300%, at least about 400%, at least about 500%, at least about 600%, at least about 700%, at least about 800%, at least about 900%, or at least about 1,000% greater than the thermal effusivity of the respective base material. In some embodiments, the thermal effusivity of the TEEM 28 may be at least 100% greater than the thermal effusivity of the base material of its respective layer 20, 22, 24. In some embodiments, the thermal effusivity of the TEEM 28 may be at least 1,000% greater than the thermal effusivity of the base material of its respective layer 20, 22, 24. In some other embodiments, the TEEM 28 may form or comprise the base material of at least one layer of the plurality of layers 10.

The layers of the plurality of layers 10 that include the TEEM 28 may each include the same TEEM material, or may each include a differing TEEM material. For example, each layer of the plurality of layers 10 that includes the TEEM 28 may include the same TEEM material, and/or at least one layer of the plurality of layers 10 that includes the TEEM 28 may include a differing TEEM material than at least one other layer of the plurality of layers 10 that includes the TEEM 28. In some embodiments that include two or more layers with TEEM 28 of differing TEEM materials, the TEEM material with the lowest thermal effusivity may include a thermal effusivity that is within 100%, within 50%, within 25%, within 10% or within 5% of the thermal effusivity of the TEEM material with the greatest thermal effusivity.

A respective layer 20, 22, 24 of the plurality of layers 10 that includes the TEEM 28 material may include any total amount (e.g., mass and/or volume) of the TEEM 28. However, the total mass and/or volume and/or to total thermal effusivity of the TEEM 28 increases with respect to each other along the depth direction D1, as illustrated graphically in FIG. 3 by the increasing number of O's in the proximal layer 20, the medial layer 22 and the distal layer 24. Stated differently, the consecutive layers 12 of the plurality of layers 10 that contain the TEEM 28 may include an inter-layer gradient distribution of the total mass and/or volume of the TEEM 28 (and/or the total thermal effusivity thereof) that increases in the depth direction D1, as illustrated graphically in FIG. 3.

The plurality of layers 20 can thereby include differing loadings or amounts of the TEEM 28, by mass and/or volume, and/or total thermal effusivities of the TEEM 28, such that the TEEM 28 loading increases from consecutive layer to layer including the TEEM 28 in the depth direction D1 within the cushion (i.e., away from the user), as shown in FIG. 3. The cushion can thus include differing loading or amounts of TEEM, by mass and/or volume, along the thickness of the cushion. As noted above, in some embodiments two or more layers of the plurality of layers 10 may include the TEEM 28 (which may or may not be contiguous consecutive layers 12), or each/all of the layers of the plurality of layers 10 may include the TEEM 28. The distal layer 24 and/or distal portion 16 of the plurality of layers 10 may thus include the highest loading of the TEEM 28 (i.e., the largest mass and/or volume of the TEEM 28 and/or the greatest total thermal effusivity) as shown in FIG. 3.

The inter-layer gradient distribution of the total mass and/or volume of the TEEM 28 (and/or the total thermal effusivity) of the plurality of layers 10 comprises an increase along the depth direction D1 between consecutive TEEM-containing layers of at least 3%, within the range of about 3% to about 100%, or within the range of about 10% to about 50%. Stated differently, the total mass and/or volume of the TEEM 28 (and/or the total thermal effusivity) of each of the plurality of layers 10 that contains TEEM 28 increases with respect to each other along the depth direction by at least 3%, within the range of about 3% to about 100%, or within the range of about 10% to about 50%.

As shown in FIGS. 4 and 5, at least one layer 20, 22, 24 of the plurality of layers 10 includes a gradient distribution of the mass and/or volume of the TEEM 28 thereof (and/or the thermal effusivity thereof) that increases in the depth direction D1 (i.e., away from the user). Stated differently, at least one layer 20, 22, 24 of the plurality of layers 10 includes an intra-layer gradient distribution of the mass and/or volume of the TEEM 28 thereof (and/or the total thermal effusivity of the layer) that increases in the depth direction D1 as it extends away from the user.

For example, as shown in FIG. 4, at least one layer 20, 22, 24 of the plurality of layers 10 includes a first lesser amount (e.g., mass and/or volume) and/or lower total thermal effusivity of the TEEM 28 in/on the proximal portion 30 of the layer this is proximate to the exterior portion 14 of the cushion and the user along the depth direction D1, and a second greater amount (e.g., mass and/or volume) and/or higher total thermal effusivity of the TEEM 28 on/in a distal portion 34 of the layer 20, 22, 24 that is proximate to the distal portion 16 of the cushion and distal to the user along the depth direction D1 (i.e., the second loading of the TEEM 28 being a greater amount (e.g., total mass and/or volume) and/or lower total thermal effusivity than the first loading of the TEEM 28). The second total amount (e.g., total mass and/or volume) and/or total thermal effusivity of the TEEM 28 of the distal portion 34 of the layer may be greater than the amount (e.g., total mass and/or volume) and/or total thermal effusivity of the first amount and/or total thermal effusivity of the TEEM 28 of the proximal portion 30 along the depth direction D1 by at least 3%, within the range of about 3% to about 100%, or within the range of about 10% to about 50%.

As also shown in FIG. 4, such a layer including the gradient TEEM 28 along the depth direction D1 may further include a medial portion 32 positioned between the proximal portion 30 and the distal portion 34 along the depth direction D1 that includes a third total amount (e.g., mass and/or volume) and/or total thermal effusivity of TEEM 28 that is greater than the first total amount (e.g., mass and/or volume) and/or total thermal effusivity of the TEEM 28 of the proximal portion 30 but that is less than the second amount (e.g., mass and/or volume) and/or total thermal effusivity of the TEEM 28 of distal portion 34, as shown in FIG. 4. The third total amount (e.g., total mass and/or volume) and/or total thermal effusivity of the TEEM 28 of the medial portion 32 may be greater than the first total amount (e.g., total mass and/or volume) and/or total thermal effusivity of the TEEM 28 of the proximal portion 30 by at least 3%, within the range of about 3% to about 100%, or within the range of about 10% to about 50%, and less than the second total amount (e.g., total mass and/or volume) and/or total thermal effusivity of the TEEM 28 of the distal portion 34 by at least 3%, within the range of about 3% to about 100%, or within the range of about 10% to about 50%. However, a layer of the plurality of layers 10 including an intra-layer gradient distribution of the amount (e.g., mass and/or volume) and/or total thermal effusivity of the TEEM 28 thereof may include any number of portions along the depth direction D1 that increase in the total amount (e.g., mass and/or volume) and/or total thermal effusivity of the TEEM 28 thereof along the depth direction D1.

The intra-layer gradient of the TEEM 28 of one or more layers of the plurality of layers 10 (potentially the plurality of consecutive layers 12) that increases in the depth direction D1 may comprise an irregular gradient distribution of the amount (e.g., mass and/or volume) and/or total thermal effusivity of the TEEM 28 along the depth direction D1, as shown in FIG. 4. In some such embodiments, a layer may include two or more distinct bands or zones 30, 32, 34 of progressively increasing loading of the TEEM 28 in the depth direction D1 (i.e., away from the user) by at least 3%, within the range of about 3% to about 100%, or within the range of about 10% to about 50%, as shown in FIG. 4. For example, as shown in FIG. 4, the proximal portion 30, the medial portion 32 and the distal portion 34 may comprise distinct zones of the thickness of the respective layer 20, 22, 24 with distinct differing amounts (e.g., mass and/or volumes) and/or total thermal effusivities of the TEEM 28 along the depth direction D1 (such as amounts and/or total thermal effusivities that increase by at least 3%, within the range of about 3% to about 100%, or within the range of about 10% to about 50% from layer to layer in the depth direction D1).

Alternatively, as shown in FIG. 5, the intra-layer gradient of the TEEM 28 of one or more layers of the plurality of layers 10 (potentially the plurality of consecutive layers 12) that increases in the depth direction D1 may comprise a smooth or regular gradient distribution of at least a portion of the mass and/or volume and/or total thermal effusivity of the TEEM 28 along the depth direction D1. As shown in FIG. 5, at least one layer 20, 22, 24 of the plurality of layers 10 may include a relatively constant/consistent progressive gradient of at least a portion of the loading of the mass and/or volume and/or total thermal effusivity of the TEEM 28 thereof along the depth direction D1 within the cushion (i.e., away from the user). Such a layer with a relatively constant/consistent progressive gradient of at least a portion of the loading of TEEM 28 thereof along the depth direction D1 may include the proximal portion 30 (of the thickness of the layer) that is proximate to the outer portion 14 of the cushion containing less total mass and/or volume and/or total thermal effusivity of the TEEM 28 than a bottom/distal portion 32 (of the thickness of the layer) that is proximate to the distal portion 16 of the cushion and distal to the user (such as by at least 3%, within the range of about 3% to about 100%, or within the range of about 10% to about 50%), as shown in FIG. 5.

In some embodiments (not shown), a layer of the plurality of layers 10 may include an intra-layer gradient of the TEEM 28 thereof that includes a medial portion 32 that is positioned at or proximate to a middle or medial portion of the thickness of the cushion and contains the greatest total mass and/or volume of the TEEM 28 as compared to the proximal portion 30 and the distal portion 34 of the layer, for example. The layer itself may thereby be positioned at or proximate to a middle or medial portion 44 of the thickness of the cushion. As explained above, such a cushion can form a two-sided cushion that provides cooling to a user from either the top/proximal side or the bottom/distal side of the cushion.

In some embodiments, the inter-layer and/or intra-layer gradient loading of the PCM 26 and the TEEM 28 of the plurality of layers 10 along the depth direction D1, such as the plurality of consecutive layers 12, may correspond or match each other. For example, a first layer containing more (or a greater latent heat potential) of the PCM 26 than that of an adjacent/neighboring consecutive (and potentially contiguous) second layer in the depth direction D1 may also include more (or a greater total thermal effusivity) of the TEEM 28 than that of the second layer. Similarly, a first layer of the plurality of layers 10 along the depth direction D1, such as the plurality of consecutive layers 12, containing a first portion or zone thereof (e.g., an exterior portion) with more (or a greater latent heat potential) of the PCM 26 than that of a second portion or zone thereof (e.g., an inner portion) may also include more (or a greater total thermal effusivity) of the TEEM 28 than that of the second portion. However, in some embodiments, the inter-layer and/or intra-layer gradient loading of the PCM 26 and the TEEM 28 of the plurality of layers 10 along the depth direction D1, such as the plurality of consecutive layers 12, may differ from each other. For example, the plurality of layers 10 along the depth direction D1, such as the plurality of consecutive layers 12, may include a layer that does not include the PCM 26 but includes the TEEM 28 (or does not include the TEEM 28 but includes the PCM 26). As another example, a layer of the plurality of layers 10, such as the plurality of consecutive layers 12, may include an intra-layer gradient of the PCM 26 but not the TEEM 28, or of the TEEM 28 but not the PCM 26.

The inter-layer and intra-layer gradient loadings/distributions of the PCM 26 and the TEEM 28 of the plurality of layers 10 (i.e., inter-layer PCM 26 and TEEM 28 gradients of consecutive layers, and the intra-layer PCM 26 and TEEM 28 gradients of at least one layer thereof), and in particular the plurality of consecutive layers 12, provides an unexpectedly large amount of heat storage for an unexpectedly long timeframe.

The layers of the plurality of layers 10 may be formed of any material(s) and include any configuration. For example, in some embodiments the plurality of layers 10 may comprise a flexible and/or compressible layer, potentially formed of a woven fabric, non-woven fabric, wool, cotton, linen, rayon (e.g., inherent rayon), silica, glass fibers, ceramic fibers, para-aramids, scrim, batting, polyurethane foam (e.g., viscoelastic polyurethane foam), latex foam, memory foam, loose fiber fill, polyurethane gel, thermoplastic polyurethane (TPU), or organic material (leather, animal hide, goat skin, etc.). In some embodiments, at least one of the layers of the plurality of layers 10 may be comprised of a flexible foam that is capable of supporting a user's body or portion thereof. Such flexible foams include, but are not limited to, latex foam, reticulated or non-reticulated viscoelastic foam (sometimes referred to as memory foam or low-resilience foam), reticulated or non-reticulated non-viscoelastic foam, polyurethane high-resilience foam, expanded polymer foams (e.g., expanded ethylene vinyl acetate, polypropylene, polystyrene, or polyethylene), and the like. In some embodiments, the layers comprise flexible layers, and at least some of the layers may compress along the thickness thereof (in the depth direction D1) under the weight of the user when the user rests, at least partially, on the cushion.

As noted above, the PCM 26 and/or the TEEM 28 may be coupled to a base material of at least one layer of the plurality of layers 10. For example, the PCM 26 and/or the TEEM 28 may be coupled to an exterior surface/side portion of a respective layer, within an internal portion of the respective layer, and/or incorporated in/within the base material forming the layer. As also described above, in some embodiments, the TEEM 28 material may form at least one layer of the plurality of layers 10. For example, one layer of the plurality of layers 10 may comprise a liquid and moisture (i.e., liquid vapor) barrier layer that is formed of the TEEM material 28 (e.g., a vinyl layer, polyurethane layer (e.g., thermoplastic polyurethane layer), rubberized flannel layer or plastic layer, for example), and it may comprise the PCM material 26 coupled thereto (e.g., applied to/on an inner distal surface thereof). The liquid and moisture barrier layer may include additional TEEM material 28 coupled to the base TEEM material 28. As another example, one layer of the plurality of layers 10 may comprise a gel layer that extends directly about, on or over a foam layer that includes the PCM material 26 and/or the TEEM material 28 coupled or otherwise integrated therein. The gel layer may thereby comprise a coating on the foam layer, and may be formed of the TEEM 28 material (e.g., comprise a polyurethane gel). While the as-formed gel layer may not include additional TEEM 28, and potentially any PCM material 26, the TEEM 28 and/or PCM 26 of an overlying and/or underlying layer (e.g., the foam layer) may migrate or otherwise translate from the overlying and/or underlying layer into the gel layer. As such, the gel layer, at some point in time after formation, may include or comprise the PCM 26 and/or the TEEM 28.

The PCM 26 and/or TEEM 28 of a layer may be coupled, integrated or otherwise contained in/on a respective layer via any method or methods. As non-limiting examples, a respective layer may be formed with the PCM 26 and/or TEEM 28, and/or the PCM 26 and/or TEEM 28 may be coupled integrated or otherwise contained in/on a respective layer, via at least one of air knifing, spraying, compression, submersion/dipping, printing (e.g. computer aided printing), roll coating, vacuuming, padding, molding, injecting, extruding, for example. However, as noted above, any other method or methods may equally be employed to apply or couple the PCM 26 and/or TEEM 28 to a layer.

In some exemplary embodiments, a respective layer of the plurality of layers 10 with an intra-layer gradient of the PCM 26 and/or the TEEM 28 thereof may be formed by applying the PCM 26 and/or the TEEM 28 to the layer via a first operation, step or process (e.g., a first air knifing, spraying, compression, submersion/dipping, printing, roll coating, vacuuming, padding, or injecting process or operation), and then applying the PCM 26 and/or the TEEM 28 to the layer in at least one second operation with at least one parameter of the operation altered as compared to the first operation such that the PCM 26 and/or the TEEM 28 applied in the at least one second operation is coupled to a differing portion of the layer as compared to the first operation (potentially as well as to at least a portion of the same portion of the layer as compared to the first operation). In this way, the intra-layer gradient of the PCM 26 and/or the TEEM 28 may be created.

For example, with respect to a fiber scrim or batting layer (or another relatively porous and/or open structure layer), a first mass of the PCM 26 and/or the TEEM 28 may be applied to proximal side of the layer via at least one first operation (e.g., via air knifing, spraying, roll coating, printing, padding or an injection operation, for example), and a second mass of the PCM 26 and/or the TEEM 28 that is greater than the first mass may similarly be applied to a distal side of the layer opposing the proximal side thereof via at least one second operation. Some of the first mass of PCM 26 and/or the TEEM 28 and the second mass of PCM 26 and/or the TEEM 28 may penetrate or pass through the proximal and distal sides and into a medial portion of the layer between the proximal and distal side portions (via the at least one first and second operations). The distal side portion may thereby include the highest mass of the PCM 26 and/or the TEEM 28, the proximal side portion may thereby include the lowest mass of the PCM 26 and/or the TEEM 28, and the medial portion may include less mass of the PCM 26 and/or the TEEM 28 than the distal side portion but less mass of the PCM 26 and/or the TEEM 28 than the proximal side portion.

As another example, a first mass of PCM 26 and/or the TEEM 28 may be applied to a distal side portion of a layer (such as a relatively porous and/or open structured layer) via at least one first operation (e.g., dipping, vacuuming, injecting, compressing, etc.), and a second mass of the PCM 26 and/or the TEEM 28 may similarly be applied to the distal side portion and a more-proximal portion of the layer via at least one second operation (e.g., by dipping the layer deeper, vacuuming longer and/or at a higher vacuum pressure, injecting longer and/or at a higher pressure, etc.). The distal side portion may thereby include a larger mass of the PCM 26 and/or the TEEM 28 as the more-proximal portion.

The inter-layer and intra-layer gradient distributions of the PCM 26 and the TEEM 28 of the plurality of layers 10 provides for a cushion that is able to absorb or draw an unexpectedly large amount of heat away from a user for an unexpectedly long timeframe. The cushion unexpectedly feels "cold" to a user for a substantial timeframe. For example, in some embodiments, a cushion with the inter-layer and intra-layer gradient distributions of the PCM 26 and the TEEM 28 of the plurality of layers 10 thereof can be capable of absorbing of at least 24 $W/m^2$ per hour for at least 3 hours, such as from a portion of a user that physically contacts the proximal portion 14 of the cushion and at least a portion of the weight of the user is supported by the cushion such that the user at least partially compresses the plurality of layers 10 along the thickness of the cushion (and along the depth direction D1).

Unexpectedly, depending upon the particular loadings of the PCM 26 and TEEM 28 thereof, the cushions can absorb at least 24 $W/m^2$/hr., or at least 30 $W/m^2$/hr., or at least 35 $W/m^2$/hr., or at least 40, or at least 50 $W/m^2$/hr. for at least 3 hours, at least 3½ hours, at least 4 hours, at least 4½ hours, at least 5 hours, at least 5½ hours, or at least 6 hours.

FIGS. 6-10 illustrate a cooling mattress 100 according to the present disclosure. The cooling mattress 100 incorporates a plurality of layers 110 (consecutive layers) to absorb or draw an unexpectedly large amount of heat away from a user for an unexpectedly long timeframe. The mattress 100 may comprise and/to be similar to the cushion described above with respect to FIGS. 3-5, and/or the plurality of layers 110 may comprise and/to be similar to the plurality of layers 10 described above with respect to FIGS. 3-5, and the description contained herein directed thereto equally applies but may not be repeated herein below for brevity sake. Like components and aspects of the mattress 100 and the cushion of FIGS. 3-5, and/or the plurality of layers 110 and the plurality of layers 10 of FIGS. 3-5, are thereby indicated by like reference numerals preceded with "1."

Figure 6:
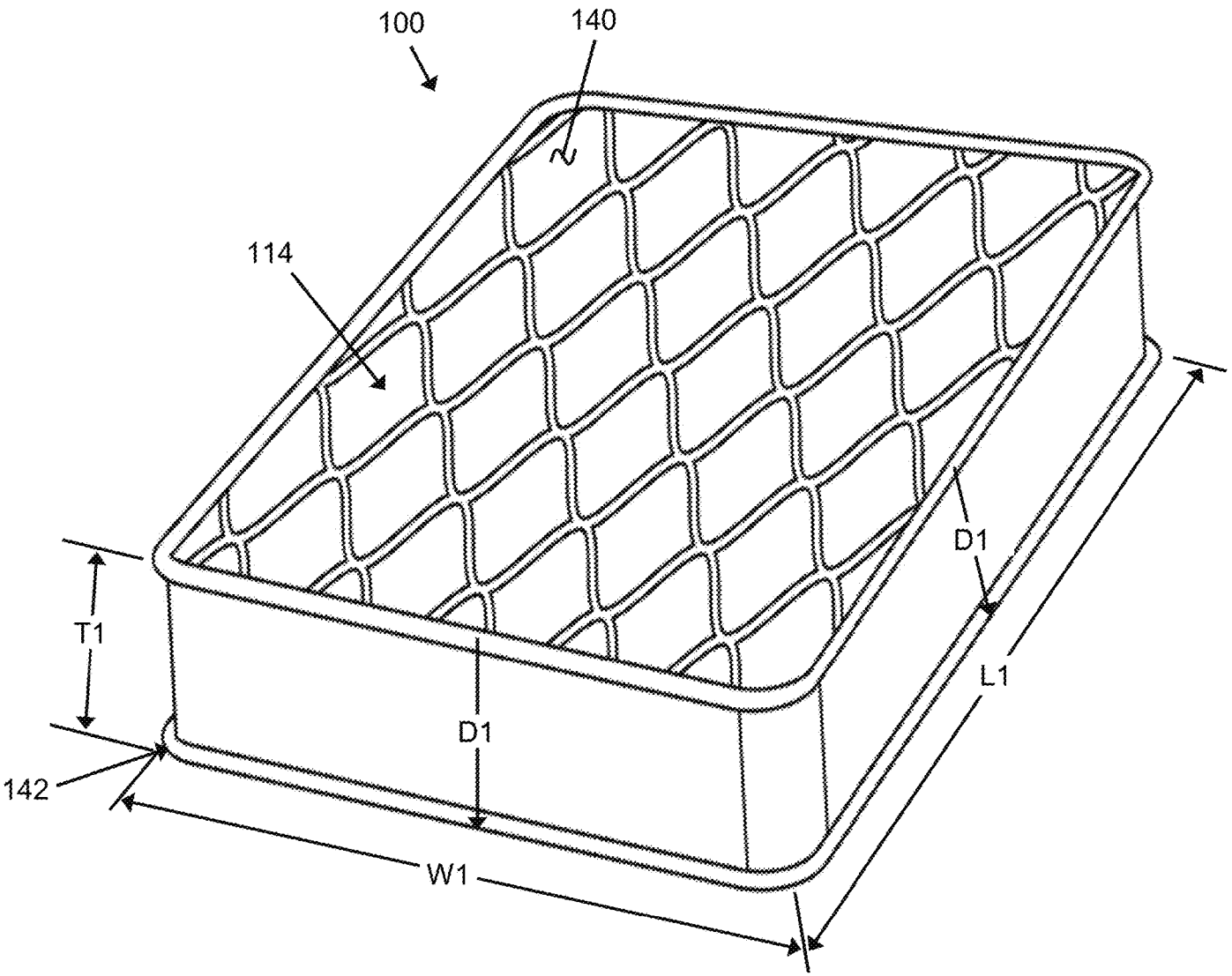
FIG. 6 illustrates an elevational perspective view of an exemplary cooling mattress according to the present disclosure.
Figure 7:
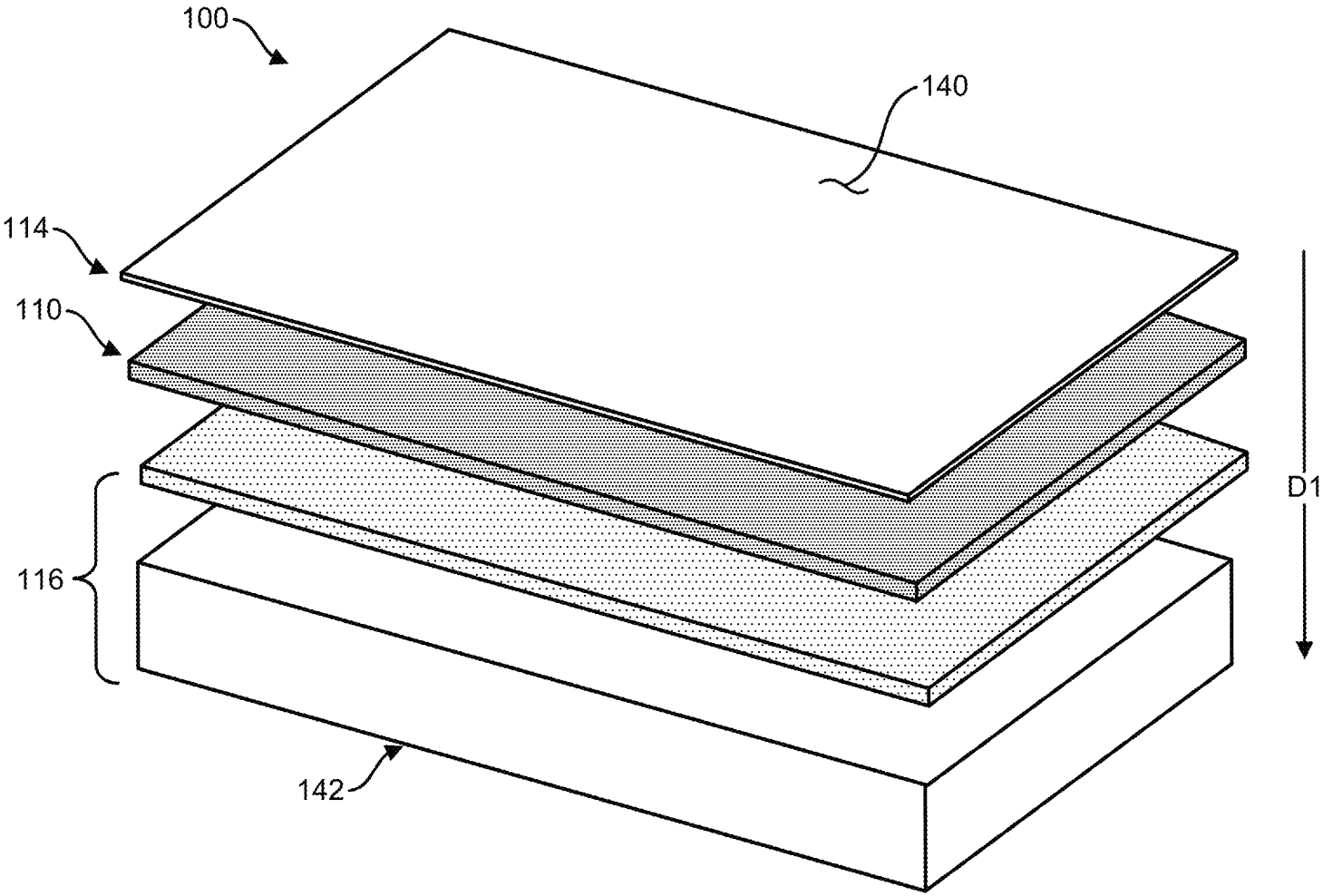
FIG. 7 illustrates a sectional perspective view of the exemplary cooling mattress of FIG. 6.
Figure 10:
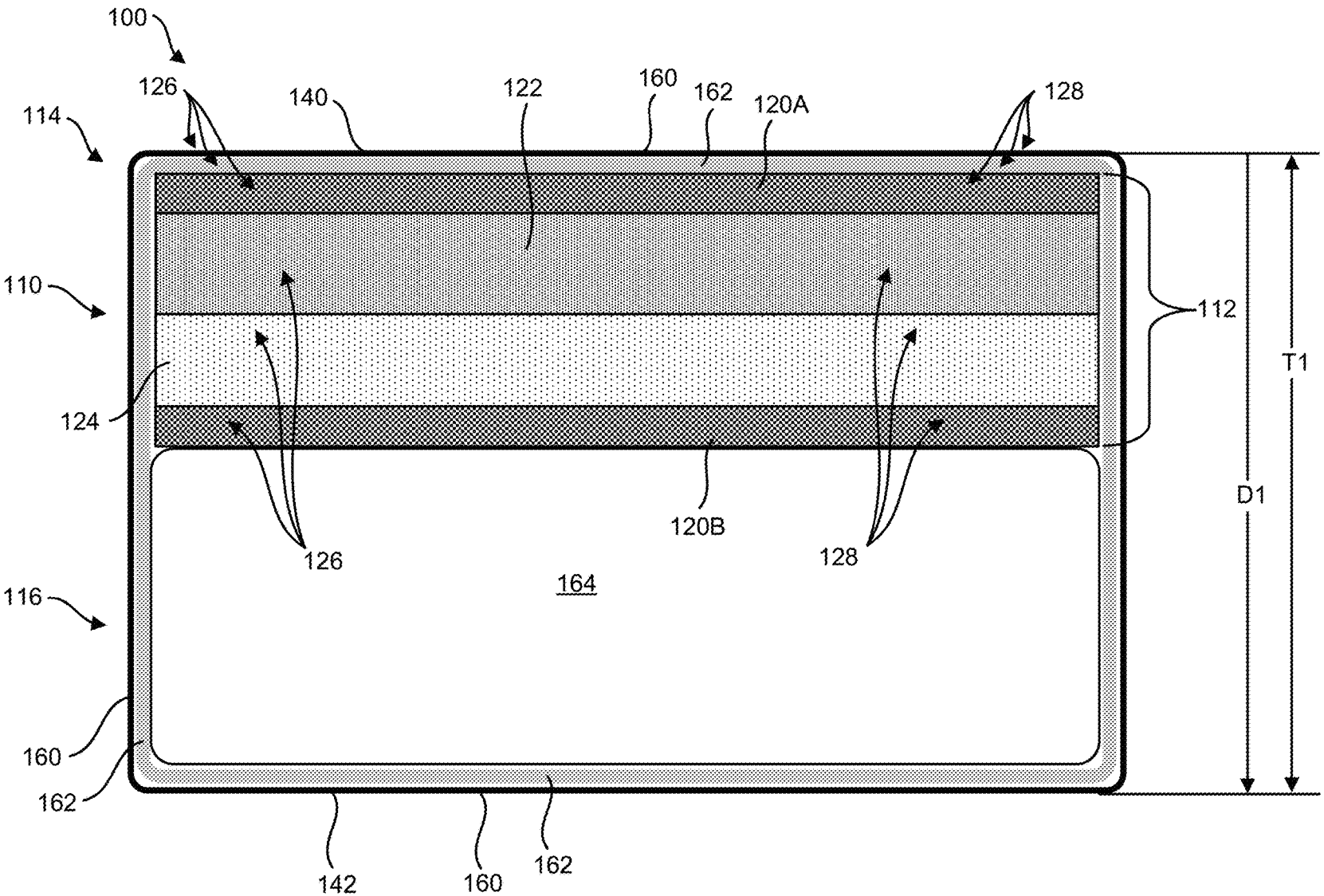
FIG. 10 illustrates a cross-sectional view of the exemplary cooling mattress of FIG. 6.

As shown in FIGS. 6 and 10, the mattress 100 includes or defines a width W1, a length L1 and a thickness T1. As also shown in FIGS. 6 and 10, the depth direction D1 extends along the along the thickness T1 of the mattress 100 from an outer proximal side portion or surface 140 that is proximate to a user (i.e., a user rests thereon) to a distal inner side portion or surface 144 that is distal to the user (i.e., spaced from the user, and potentially opposing the proximal side 140).

Figure 8:
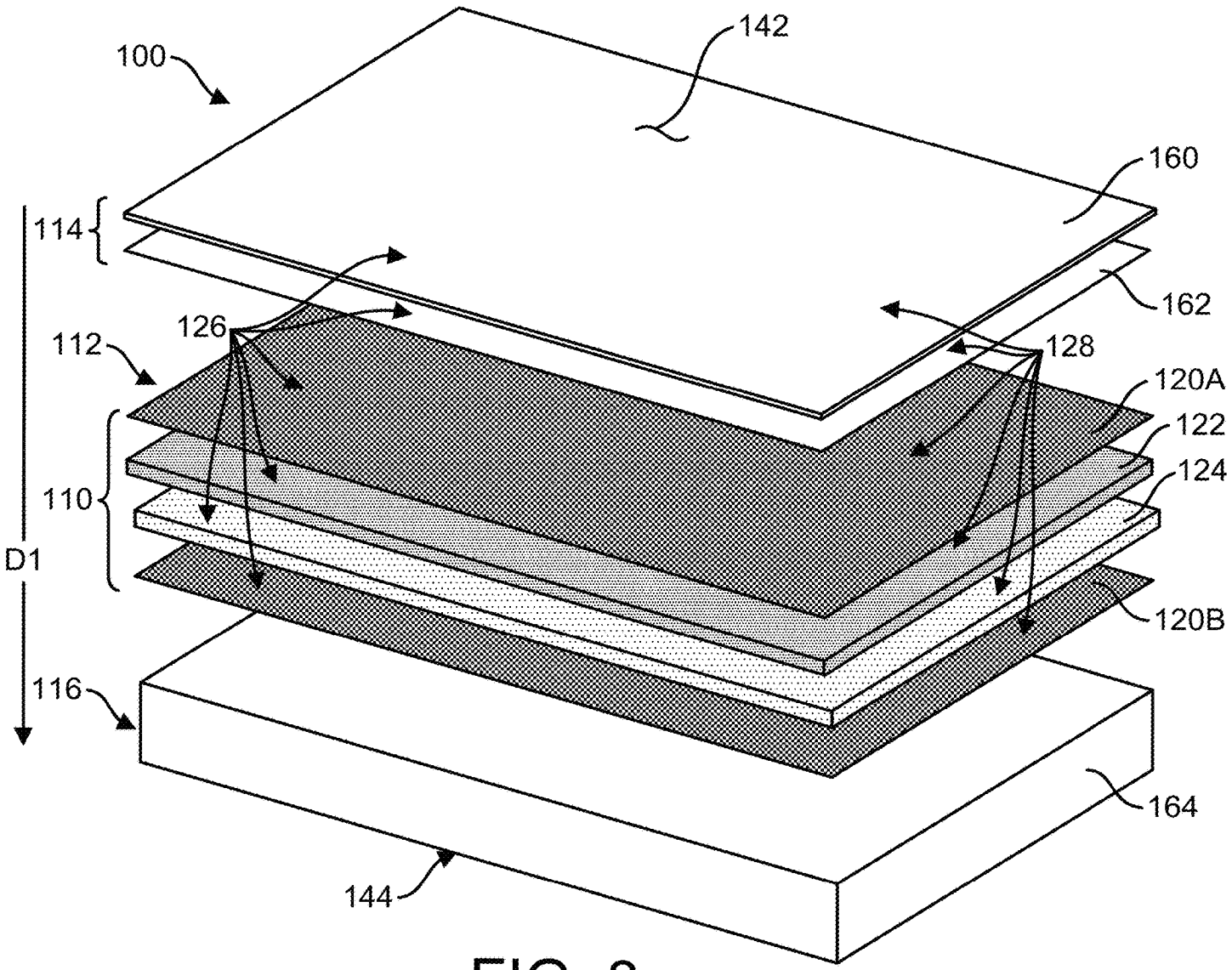
FIG. 8 illustrates an exploded elevational perspective view of the exemplary cooling mattress of FIG. 6.
Figure 9:
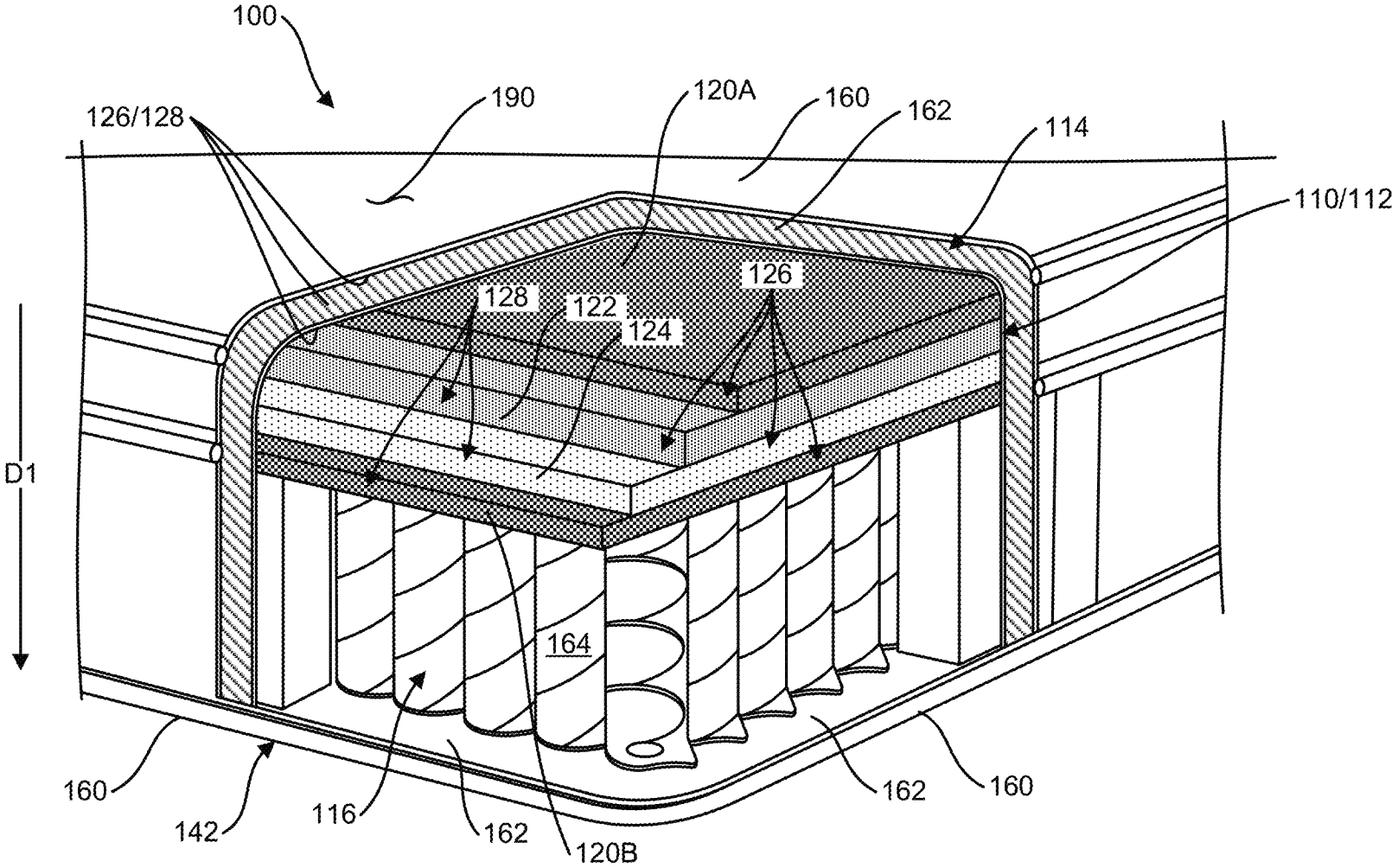
FIG. 9 illustrates an exploded elevational perspective view of an exemplary cartridge portion of the exemplary cooling mattress of FIG. 6.

As shown in FIGS. 8-10, the mattress 100 includes a plurality of separate and distinct portions or layers overlying each other or arranged in the depth direction D1 that make up or define the thickness T1 of the mattress 100. The mattress 100 includes a proximal or top cover portion 114 that forms a cover of the mattress 100. The mattress 100 further includes a cooling cartridge portion 110 of a plurality of consecutive cooling layers each including the PCM 126 and/or the TEEM 128 that underlies (e.g., directly or indirectly) the proximal top portion 114 in the depth direction D1, as shown in FIG. 6. Underlying (e.g., directly or indirectly) the cooling portion 110, the mattress 100 includes a base portion 116 that physically supports the proximal top portion 114 and the cooling portion 110. As shown in FIGS. 8-10, each of the proximal top portion 114, the cooling cartridge portion 110 and the base portion 116 may comprise a plurality of consecutive layers overlying each other in the depth direction D1 (i.e., thickness T1 of the mattress). In some alternative embodiments, at least one of the proximal top portion 114, the cooling cartridge portion 110 and the base portion 116 may comprise a single layer.

At least a plurality of consecutive layers 112 of the cooling cartridge portion 110 include the inter-layer gradient distribution of the PCM 126 and the TEEM 128 of the mattress 100 that increases in the depth direction D1. Further, at least one of the layers 112 of the cooling cartridge portion 110 also include the intra-layer gradient distribution of the PCM 126 and/or the TEEM 128 thereof that increases in the depth direction D1. In some embodiments, the proximal top portion 114 also includes the PCM 126 and/or the TEEM 128 such that the cooling cartridge portion 110 comprises a greater total mass (or total latent heat potential) of the PCM 126 than the proximal top portion 114 and/or the cooling cartridge portion 110 comprises a greater total amount (mass and/or volume) (or total thermal effusivity) of the TEEM 128 than the proximal top portion 114 such that the inter-layer gradient distribution of the PCM 126 and/or the TEEM 128 of the mattress 100 that increases in the depth direction D1 is maintained. In such embodiments, the distal-most layer or portion of the proximal top portion 114 including the PCM 126 and/or the TEEM 128 thereby includes a lesser total mass (or total latent heat potential) of the PCM 126 and/or a lesser total amount (mass and/or volume) (or total thermal effusivity) of the TEEM 128 than the most-proximal layer or portion of the proximal top portion 114 including the PCM 126 and/or the TEEM 128. In some embodiments, at least one layer of the cooling cartridge portion 110 further comprises the intra-layer gradient distribution of the PCM 126 and/or the TEEM 128 thereof that increases in the depth direction D1.

The distal base portion 116 may define the outer distal side portion or surface 142 of the mattress 100, as shown in FIGS. 6, 9 and 10. The distal side surface 142 may be substantially planar and/or configured to lay on a bed base or support member or structure, such as a bed frame and/or box-spring for example. In some embodiments, the bed base and/or the distal base portion 116 is configured to raise the height of the mattress 100 (along thickness T1 dimension) to make it more comfortable for a user to get on and/or off the mattress 100. In some embodiments, the bed base and/or the distal base portion 116 is configured to absorb forces, shock and/or weight along the depth direction D1 and/or to reduce wear to the mattress 100. In some embodiments, the bed base and/or the distal base portion 116 is configured to create a substantially flat (i.e., planar) and firm structure for the mattress 100 to lie upon and/or to configure the mattress 100 itself as a substantially flat and firm structure. For example, the outer distal side portion or surface 142 may be a substantially stiff and planar surface portion.

The distal base portion 116 may be configured of any structure and/or material that at least partially physically supports the cooling portion 110, the proximal top portion 114 and a user laying thereon or thereover. For example, the distal base portion 116 may comprise at least one layer 164 of springs and/or resilient members, one or more layers of foam (e.g., one or more layers of pressure-relieving foam, memory foam, supportive foam, combinations of foam layers, etc.), a structural framework (e.g., a wooden, metal and/or plastic framework) or a combination thereof, as shown in FIGS. 7-10

In the exemplary illustrative embodiment, the distal base portion 116 is void of the PCM 126 and/or the TEEM 128. However, in alternative embodiments, at least a portion of the distal base portion 116 immediately adjacent to the cooling cartridge portion 110 in the depth direction D1 (i.e., directly underlying the cooling cartridge portion 110) comprises the PCM 126 and/or the TEEM 128. In distal base portion 116 embodiments that include the PCM 126 and/or the TEEM 128, the PCM 126 and/or the TEEM 128 of the layer or portion of the distal base portion 116 immediately adjacent to the cooling cartridge portion 110 in the depth direction D1 includes a greater mass (or total latent heat potential) of the PCM 126 and/or a greater amount (e.g., mass and/or volume) of the TEEM 128 (and/or total thermal effusivity) than the immediately adjacent layer or portion of the cooling cartridge portion 110 including the PCM 126 and/or TEAM 128 (such as the second batting layer 120B as described below). In this way, an inter-layer gradient distribution of the PCM 126 and/or the TEEM 128 that increases in the depth direction D1 of the mattress 100 is maintained (as explained further below). Further, in some embodiments, the distal base portion 116 may include at least one layer or portion with an intra-layer distribution of the PCM 126 and/or the TEEM 128 thereof that increases in the depth direction D1.

As shown in FIGS. 8-10 in some embodiments the proximal top portion 114 may extend directly over the cooling cartridge portion 110, and thereby indirectly over the distal base portion 116. In some embodiments, the proximal top portion 114 may extend over or about the lateral sides of the width of the cooling cartridge portion 110 and the distal base portion 116 and the longitudinal lateral sides of the width of the cooling cartridge portion 110 and the distal base portion 116. In some such embodiments, the proximal top portion 114 may extend over the distal side or side surface of the distal base portion 116 and define the distal side portion or surface 142, as shown in FIGS. 8-10. The proximal top portion 114 may thereby form an enclosure or sleeve that surrounds or encases (e.g., fully or at least along one dimension (e.g., width W1 and/or length L1)).

As shown in FIGS. 6 and 8-10, in some embodiments, the proximal top portion 114 may comprise an outer cover layer 160 and an underlying (directly or indirectly) fire resistant sock/cap layer 164. The cover layer 160 may thereby define the outer proximal side portion or surface 140 of the mattress 100 on which a user lays (directly or indirectly) to utilize the mattress 100. It is noted that a user may utilize one or more sheets, a mattress protector, a mattress pad or any other layer or material, or combination thereof, over the proximal side surface 140 of the mattress 100. The cover layer 160 and the fire resistant sock/cap layer 162 may be contiguous consecutive layers. The cover layer 160 and the fire resistant sock/cap layer 162 may be coupled together (e.g., sewn, glued, buttoned or otherwise affixed together), or the cover layer 160 and the fire resistant sock/cap layer 162 may loosely or freely be arranged in the stacked or overlying/underlying arrangement. For example, the outer cover layer 160 may extend about and/or be affixed to the distal base portion 116, and the fire resistant sock/cap layer 164 may be trapped or contained between the fire resistant sock/cap layer 164 and the cooling cartridge portion 110 in the depth direction D1.

The cover layer 160 may comprise any base material(s) and configuration, and be comprised of a single layer or a plurality of layers (which may be coupled together). In some embodiments, the cover layer 160 comprises a compressible fabric layer, such a woven or non-woven fabric layer. In some embodiments, the cover layer 160 comprises a quilted compressible fabric layer. In one exemplary embodiment, the cover layer 160 comprises a cotton or cotton blend fabric. In some embodiments, the cover layer 160 may define a thickness and a loft that are less than a thickness and a loft, respectively, of a first scrim layer 120A and a second scrim layer 120B of the cooling cartridge portion 110. The cover layer 160 may comprise a fabric weight that is greater than a fabric weight of the first scrim layer 120A and the second scrim layer 120B. In some embodiments, the cover layer 160 comprises a fabric weight that is greater than or equal to than about 220 GMS. In some embodiments, the cover layer 160 comprises a moisture-proofing material (e.g., vinyl and/or polyurethane (such as a thermoplastic polyurethane)) configured to prevent or resist liquid and/or moisture from passing through the cover layer 160 in the depth direction D1.

The fire resistant sock/cap layer 162 may be configured as a fire proof or resistant layer that prevents, or at least resists, the mattress 100 from burning (i.e., resist catching on fire, igniting and/or remaining on fire). The fire resistant sock/cap layer 162 may comprise any base material(s) and configuration, and be comprised of a single layer or a plurality of layers (which may be coupled together). The fire resistant sock/cap layer 162 comprises a fire proof or resistant material (i.e., is formed of fire resistant material and/or is treated (e.g., coated or impregnated) with fire proof or resistant material). For example, the fire resistant sock/cap layer 162 may comprise one or more layers and/or coatings of wool (e.g., sheep's wool), glass fibers (e.g., fiberglass), ceramic (potentially ceramic fibers), silica (potentially silica fibers), Kevlar®, nylon, boric acid, antimony, chlorine, bromine, decabromodiphenyl oxide, any other fire proof, fire resistant or fire retardant material, or a combination thereof. In some embodiments, the fire resistant sock/cap layer 162 may be formed of the fire proof or resistant material. In some other embodiments, the fire resistant sock/cap layer 162 may be formed of a base material (e.g., cotton or a cotton blend) and the fireproof or resistant material may be coupled or otherwise integrated therewith.

In some embodiments, the cover layer 160 and the fire resistant sock/cap 162 include the PCM 126 (solid-to-liquid phase change material with a phase change temperature within the range of about 6 to about 45 degrees Celsius) and the TEEM 128 (material with a thermal effusivity greater than or equal to 2,500 $Ws^{0.5}/(m^2K)$), as shown in FIGS. 9 and 10. In such embodiments, the cover layer 160 and the fire resistant sock/cap 162 include an inter-layer gradient distribution of the PCM 126 and the TEEM 128 thereof that increases in the depth direction D1, with the fire resistant sock/cap layer 162 including a greater total amount (e.g., mass) of the PCM 126 (and/or total latent heat potential) and a greater total amount (e.g., mass or volume) (and/or total thermal effusivity) of the TEEM 128 as compared to the cover layer 160. In some such embodiments, the total mass (and/or total latent heat potential/capacity) of the PCM 126 of the fire resistant sock/cap layer 162 is greater than that of the cover layer 160 by at least 3%, by about 3% to about 100%, or by about 10% to about 50%. In some embodiments, the total mass (and/or total thermal effusivity) of the TEEM 128 of the fire resistant sock/cap layer 162 is greater than that of the cover layer 160 by at least 3%, by about 3% to about 100%, or by about 10% to about 50%.

In some embodiments, the cover layer 160 may include an intra-layer gradient distribution of the PCM 126 and/or TEEM 128 thereof. For example, the PCM 126 and/or the TEEM 128 of the cover layer 160 may be coupled or provided on a distal side portion of the cover layer 160 (via any method) that faces distally along the depth direction D1 and is positioned proximate to the fire resistant sock/cap layer 162, and a medial portion of the thickness T1 of the cover layer 160 proximally-adjacent to the distal side portion thereof. In some such embodiments, the distal side or face of the cover layer 160 may include a total mass (and/or total latent heat potential/capacity) of the PCM 126 of the cover layer 160 and/or a total mass (and/or total thermal effusivity) of the TEEM 128 of the cover layer 160 that is greater (e.g., by at least 3%, by about 3% to about 100%, or by about 10% to about 50%) than that of the medial portion of the cover layer 160. However, the PCM 126 and/or the TEEM 128 of the cover layer 160 may be provided anywhere in/on the cover layer 160, and the cover layer 160 may not include an intra-layer gradient distribution of the PCM 126 and/or the TEEM 128 thereof.

Similarly, in some embodiments, the fire resistant sock/cap 162 may include an intra-layer gradient distribution of the PCM 126 and/or TEEM 128 thereof. For example, the PCM 126 and/or the TEEM 128 of the fire resistant sock/cap 162 may be coupled or provided on a proximal side portion thereof (via any method) that faces proximally and is positioned distally-adjacent to the cover layer 160 along the depth direction D1, and a distal side portion thereof (via any method) that faces distally and is positioned proximately-adjacent to the cooling cartridge 110 along the depth direction D1. In some such embodiments, the distal side portion of the fire resistant sock/cap 162 may include a total mass (and/or total latent heat potential/capacity) of the PCM 126 of the fire resistant sock/cap 162 and/or a total mass (and/or total thermal effusivity) of the TEEM 128 of the fire resistant sock/cap 162 that is greater (e.g., by at least 3%, by about 3% to about 100%, or by about 10% to about 50%) than that of the proximal side portion of the fire resistant sock/cap 162. However, the PCM 126 and/or the TEEM 128 of the fire resistant sock/cap 162 may be provided anywhere in/on the fire resistant sock/cap 162, and the fire resistant sock/cap 162 may not include an intra-layer gradient distribution of the PCM 126 and/or the TEEM 128 thereof.

As noted above, the mattress 100 includes a cooling cartridge portion 110 of a plurality of consecutive cooling layers 112 each including the PCM 126 (solid-to-liquid phase change material with a phase change temperature within the range of about 6 to about 45 degrees Celsius) and the TEEM 128 (material with a thermal effusivity greater than or equal to 2,500 $Ws^{0.5}/(m^2K)$), as shown in FIGS. 8-10. The consecutive cooling layers 112 comprise separate and distinct layers 120A, 122, 124, 120B arranged in the depth direction D1. The cooling cartridge portion 110 may be underlie (potentially directly) the proximal top portion 114 (if provided) and overly the base portion 116 (if provided) in the depth direction D1. As discussed above, the plurality of layers 112 of the cooling cartridge portion 110 comprise an inter-layer gradient distribution of the PCM 126 and TEEM 128 that increases in the depth direction D1, and at least one of the layers 112 includes an intra-layer gradient distribution of the PCM 126 and TEEM 128 that increases in the depth direction D1. In some embodiments, a plurality of the plurality of layers 112 of the cooling cartridge portion 110 includes the PCM 126 and/or the TEEM 128, or each of the plurality of layers 112 includes PCM 126 and/or the TEEM 128. In some embodiments, a plurality of the plurality of layers 112 of the cooling cartridge portion 110 includes the intra-layer gradient distribution of the PCM 126 and/or TEEM 128 thereof, or each of the plurality of layers 112 includes the intra-layer gradient distribution of the PCM 126 and/or TEEM 128 thereof.

As shown in FIGS. 6-10, the plurality of layers 112 of the cooling cartridge portion 110 comprises a proximal (potentially most-proximal) first scrim layer 120A underlying (e.g., directly underlying) the top proximal cover portion 114 (e.g., directly underlying the fire resistant sock/cap 162 thereof if provided, or the cover layer 160 if the fire resistant sock/cap 162 is not provided) in the depth direction D1, a first foam layer 122 (potentially viscoelastic foam) directly underlying the first scrim layer 120A in the depth direction D1, a non-viscoelastic second foam layer 124 directly underlying the first foam layer 122 in the depth direction D1, and a second scrim layer 120B directly underlying the second foam layer 124 in the depth direction D1.

In some embodiments, the first scrim layer 120A may comprises a fabric weight within the range of about 20 GSM and about 80 GSM. In some embodiments, the first scrim layer 120A comprises an air permeability of at least about 1½ $ft^3$/min.

If the top proximal cover portion 114 includes the PCM 126 and/or the TEEM 128, the first scrim layer 120A includes a greater total amount (e.g., mass) (and/or total latent heat potential) of the PCM 126 and/or a greater total amount (e.g., mass or volume) (and/or total thermal effusivity) of the TEEM 128 than that of the distal-most layer or portion of the top proximal cover portion 114 (and/or the top proximal cover portion 114 as a whole). In some such embodiments, the total mass (and/or total latent heat potential) of the PCM 126 of the first scrim layer 120A is greater than that of the distal-most layer or portion of the top proximal cover portion 114 (and/or the top proximal cover portion 114 as a whole) by at least 3%, by about 3% to about 100%, or by about 10% to about 50%. In some embodiments, the total mass (and/or total thermal effusivity) of the TEEM 128 of the first scrim layer 120A is greater than that of the distal-most layer or portion of the top proximal cover portion 114 (and/or the top proximal cover portion 114 as a whole) by at least 3%, by about 3% to about 100%, or by about 10% to about 50%.

The PCM 126 and/or the TEEM 128 of the first scrim layer 120A may be provided or arranged in the gradient distribution that increases in the depth direction D1 (i.e., the intra-layer gradient distribution that increases in the depth direction D1). For example, the first scrim layer 120A may include a proximal scrim portion (e.g., a proximal surface portion) that is positioned proximate to the top proximal cover portion 114 (if provided) having a first total mass portion (or first latent heat potential) of the total mass (or total latent heat potential) of the PCM 126 of the first scrim layer 120A, and a distal scrim portion (e.g., a distal surface portion) that is positioned distal to the top proximal cover portion 114 (if provided) and underlying the proximal scrim portion in the depth direction D1 having a second total mass portion (or second latent heat potential) of the total mass (or total latent heat potential) of the PCM 126 of the first scrim layer 120A, the second total mass portion (or second latent heat potential) of the PCM 126 being greater than the first total mass portion (or first latent heat potential) of the PCM 126. In some such embodiments, the second total mass portion (or second latent heat potential) of the PCM 126 of the first scrim layer 120A is greater than the first total mass portion (or first latent heat potential) of the PCM 122 of the of the first scrim layer 120A by at least 3%, by about 3% to about 100%, or by about 10% to about 50%. As another example, the proximal scrim portion may have a first total mass portion (or first thermal effusivity) of the total mass (or total thermal effusivity) of the TEEM 128 of the first scrim layer 120A, and the distal scrim portion 134 may have a second total mass portion (or second thermal effusivity) of the total mass (or total thermal effusivity) of the TEEM 128 of the first scrim layer 120A, the second total mass portion (or second thermal effusivity) of the TEEM 128 being greater than the first total mass portion (or first thermal effusivity) of the TEEM 128. In some such embodiments, the second total mass portion (or second thermal effusivity) of the TEEM 128 of the first scrim layer 120A is greater than the first total mass portion (or first thermal effusivity) of the TEEM 128 of the of the first scrim layer 120A by at least 3%, by about 3% to about 100%, or by about 10% to about 50%.

In some such embodiments, the first scrim layer 120A may include a medial scrim portion positioned between the proximal and distal scrim portion in the depth direction D1, such as at or proximate to a medial portion of the thickness T1 of the first scrim layer 120A. The medial scrim portion may include a third total mass portion (or third latent heat potential) of the total mass (or total latent heat potential) of the PCM 126 of the first scrim layer 120A, the third total mass portion (or third latent heat potential) of the PCM 126 being greater than the first total mass portion (or first latent heat potential) of the PCM 126 and less than the second total mass portion (or second latent heat potential) of the PCM 126 of the first scrim layer 120A. For example, the third total mass portion (or third latent heat potential) of the PCM 126 may be greater than the first total mass portion (or first latent heat potential) of the PCM 126 of the first scrim layer 120A, and less than the second total mass portion (or second latent heat potential) of the PCM 126 of the first scrim layer 120A, by at least 3%, by about 3% to about 100%, or by about 10% to about 50%. The medial scrim portion 132 may also include a third total mass portion (or third total thermal effusivity) of the total mass (or total thermal effusivity) of the TEEM 128 of the first scrim layer 120A, the third total mass portion (or third total thermal effusivity) of the TEEM 128 of the first scrim layer 120A being greater than the first total mass portion (or first total thermal effusivity) of the TEEM 128 and less than the second total mass portion (or second total thermal effusivity) of the TEEM 128 of the first scrim layer 120A. For example, the third total mass portion (or third total thermal effusivity) of the TEEM 128 may be greater than the first total mass portion (or first total thermal effusivity) of the TEEM 128 of the first scrim layer 120A, and less than the second total mass portion (or second total thermal effusivity) of the TEEM 128 of the first scrim layer 120A, by at least 3%, by about 3% to about 100%, or by about 10% to about 50%. It is noted that the first scrim layer 120A may include any number of portions along the depth direction with differing loadings of the PCM 126 and/or the TEEM 128 thereof that increases in the depth direction D1, such as just two of the proximal, medial and distal portions, or at least one additional portion beyond the proximal, medial and distal portions.

As shown in FIGS. 8-10, the first foam layer 122 directly underlying the first scrim layer 120A in the depth direction D1 also may include the PCM 126 and/or the TEEM 128. As described above, the first foam layer 122 comprises the PCM 126 and the TEEM 128 in greater total amounts or loadings than the overlying layers of the cooling cartridge portion 110 (and the proximal top cover portion 114 if it includes the PCM 126 or the TEEM 128). For example, the total mass (or total latent heat potential) of the PCM 126 of the first foam layer 122 is greater than the total mass (or total latent heat potential) of the first scrim layer 120A, such as by at least 3%, by about 3% to about 100%, or by about 10% to about 50%. Similarly, the total mass (or total thermal effusivity) of the TEEM 128 of the first foam layer 122 is greater than the total mass (or total thermal effusivity) of the first scrim layer 120A, such as by at least 3%, by about 3% to about 100%, or by about 10% to about 50%.

The first foam layer 122 may also include an intra-layer gradient distribution of the PCM 126 and/or the TEEM 128 thereof that increases in the depth direction D1. For example, the first foam layer 122 may include a proximal foam portion having a first total mass portion (and/or first latent heat potential) of the total mass (and/or total latent heat potential) of the PCM 126 of the first foam layer 122 and a first total mass portion (and/or first thermal effusivity) of the second total mass (and/or total thermal effusivity) of the TEEM 128 of the first foam layer 122, and a distal foam portion having a second total mass portion (and/or second latent heat potential) of the total mass (and/or total latent heat potential) of the PCM 126 of the first foam layer 122 that is greater than the first total mass portion (and/or first latent heat potential) thereof and a second total mass portion (and/or second thermal effusivity) of the total mass (and/or total thermal effusivity) of the TEEM 128 of the first foam layer 122 that is greater than the first total mass portion (and/or first thermal effusivity) thereof. In some embodiments, the second total mass portion (and/or second latent heat potential) of the total mass (and/or total latent heat potential) of the PCM 126 of the first foam layer 122 may be greater than first portion (and/or first latent heat potential) thereof by at least 3%, by about 3% to about 100%, or by about 10% to about 50%. In some embodiments, the second total mass portion (and/or second thermal effusivity) of the total mass (and/or total thermal effusivity) of the TEEM 128 may be greater than first portion (and/or first thermal effusivity) thereof by at least 3%, by about 3% to about 100%, or by about 10% to about 50%.

In some such embodiments, the first foam layer 122 may further comprise a medial foam portion positioned between the proximal and distal foam portions in the depth direction D1, such as at or proximate to the medial portion of the thickness T1 of the first foam layer 122. The medial foam portion may have a third total mass portion of the total mass of the PCM 126 of the first foam layer 122, and a third total mass portion (and/or third latent heat potential) of the total mass (and/or total latent heat potential) of the TEEM 128 of the first foam layer 122. The third total mass portion (and/or third latent heat potential) of the total mass (and/or total latent heat potential) of the PCM 126 of the first foam layer 122 being greater than the first total mass portion (and/or first latent heat potential) and the less than the second mass portion (and/or second latent heat potential) of the total mass (and/or total latent heat potential) of the PCM 126 of the first foam layer 122, and third total mass portion (and/or third thermal effusivity) of the total mass (and/or total thermal effusivity) of the TEEM 128 of the first foam layer 122 being greater than the first total mass portion (and/or first thermal effusivity) and the less than the second mass portion (and/or second thermal effusivity) of the total mass (and/or total thermal effusivity) of the TEEM 128 of the first foam layer 122. In some embodiments, the third total mass portion (and/or latent heat potential) of the total mass (and/or total latent heat potential) of the PCM 126 may be greater than first total mass portion (and/or first latent heat potential) thereof and less than the second total mass portion (and/or second latent heat potential) thereof by at least 3%, by about 3% to about 100%, or by about 10% to about 50%. In some embodiments, the third total mass portion (and/or third thermal effusivity) of the total mass (and/or total thermal effusivity) of the TEEM 128 may be greater than first portion (and/or first thermal effusivity) thereof and less than the second total mass (and/or second thermal effusivity) portion by at least 3%, by about 3% to about 100%, or by about 10% to about 50%. It is noted that the first foam layer 122 may include any number of portions along the depth direction with differing loadings of the PCM 126 and/or the TEEM 128 thereof that increases in the depth direction D1, such as just two of the proximal, medial and distal portions, or at least one additional portion beyond the proximal, medial and distal portions.

As shown in FIGS. 8-10, the second foam layer 124 directly underlying the first foam layer 122 in the depth direction D1 also may include the PCM 126 and/or the TEEM 128. As described above, the second foam layer 124 comprises the PCM 126 and the TEEM 128 in greater total amounts or loadings than the overlying layers of the cooling cartridge portion 110 (and the proximal top cover portion 114 if it includes the PCM 126 or the TEEM 128). For example, the total mass (or total latent heat potential) of the PCM 126 of the second foam layer 124 is greater than the total mass (or total latent heat potential) of the first foam layer 122, such as by at least 3%, by about 3% to about 100%, or by about 10% to about 50%. Similarly, the total mass (or total thermal effusivity) of the TEEM 128 of the second foam layer 124 is greater than the total mass (or total thermal effusivity) of the first foam layer 122, such as by at least 3%, by about 3% to about 100%, or by about 10% to about 50%.

The second foam layer 124 may also include an intra-layer gradient distribution of the PCM 126 and/or the TEEM 128 thereof that increases in the depth direction D1. For example, the second foam layer 124 may include a proximal foam portion having a first total mass portion (and/or first latent heat potential) of the total mass (and/or total latent heat potential) of the PCM 126 of the second foam layer 124 and a first total mass portion (and/or first thermal effusivity) of the second total mass (and/or total thermal effusivity) of the TEEM 128 of the second foam layer 124, and a distal foam portion having a second total mass portion (and/or second latent heat potential) of the total mass (and/or total latent heat potential) of the PCM 126 of the second foam layer 124 that is greater than the first total mass portion (and/or first latent heat potential) thereof and a second total mass portion (and/or second thermal effusivity) of the total mass (and/or total thermal effusivity) of the TEEM 128 of the second foam layer 124 that is greater than the first total mass portion (and/or first thermal effusivity) thereof. In some embodiments, the second total mass portion (and/or second latent heat potential) of the total mass (and/or total latent heat potential) of the PCM 126 of the second foam layer 124 may be greater than first portion (and/or first latent heat potential) thereof by at least 3%, by about 3% to about 100%, or by about 10% to about 50%. In some embodiments, the second total mass portion (and/or second thermal effusivity) of the total mass (and/or total thermal effusivity) of the TEEM 128 may be greater than first portion (and/or first thermal effusivity) thereof by at least 3%, by about 3% to about 100%, or by about 10% to about 50%.

In some such embodiments, the second foam layer 124 may further comprise a medial foam portion positioned between the proximal and distal foam portions thereof in the depth direction D1, such as at or proximate to the medial portion of the thickness T1 of the second foam layer 124. The medial foam portion may have a third total mass portion of the total mass of the PCM 126 of the second foam layer 124, and a third total mass portion (and/or third latent heat potential) of the total mass (and/or total latent heat potential) of the TEEM 128 of the second foam layer 124. The third total mass portion (and/or third latent heat potential) of the total mass (and/or total latent heat potential) of the PCM 126 of the second foam layer 124 being greater than the first total mass portion (and/or first latent heat potential) and the less than the second mass portion (and/or second latent heat potential) of the total mass (and/or total latent heat potential) of the PCM 126 of the second foam layer 124, and third total mass portion (and/or third thermal effusivity) of the total mass (and/or total thermal effusivity) of the TEEM 128 of the second foam layer 124 being greater than the first total mass portion (and/or first thermal effusivity) and the less than the second mass portion (and/or second thermal effusivity) of the total mass (and/or total thermal effusivity) of the TEEM 128 of the second foam layer 124. In some embodiments, the third total mass portion (and/or latent heat potential) of the total mass (and/or total latent heat potential) of the PCM 126 may be greater than first total mass portion (and/or first latent heat potential) thereof and less than the second total mass portion (and/or second latent heat potential) thereof by at least 3%, by about 3% to about 100%, or by about 10% to about 50%. In some embodiments, the third total mass portion (and/or third thermal effusivity) of the total mass (and/or total thermal effusivity) of the TEEM 128 may be greater than first portion (and/or first thermal effusivity) thereof and less than the second total mass (and/or second thermal effusivity) portion by at least 3%, by about 3% to about 100%, or by about 10% to about 50%. It is noted that the second foam layer 124 may include any number of portions along the depth direction with differing loadings of the PCM 126 and/or the TEEM 128 thereof that increases in the depth direction D1, such as just two of the proximal, medial and distal portions, or at least one additional portion beyond the proximal, medial and distal portions.

As shown in FIGS. 8-10, the first foam layer 122 and the second foam layer 124 comprise distinct compressible foam layers that are separate and distinct from each other and the other layers of the plurality of layers 112 of the cooling cartridge portion 110 of the mattress 100, including any other foam layer(s). In some embodiments, the first foam layer 122 comprises a layer of viscoelastic polyurethane foam (or memory foam), and the second foam layer 124 comprises a layer of latex polyurethane foam (or vice versa). In some embodiments, the foam of the first foam layer 122 and/or the second foam layer 124 may be an open cell foam.

As shown in FIGS. 8-10, the second scrim layer 120B directly underlying the second foam layer 124 in the depth direction D1 also may include the PCM 126 and/or the TEEM 128. As described above, the second scrim layer 120B comprises the PCM 126 and the TEEM 128 in greater total amounts or loadings than the overlying layers of the cooling cartridge portion 110 (and the proximal top cover portion 114 if it includes the PCM 126 or the TEEM 128). For example, the total mass (or total latent heat potential) of the PCM 126 of the second scrim layer 120B is greater than the total mass (or total latent heat potential) of the second foam layer 124, such as by at least 3%, by about 3% to about 100%, or by about 10% to about 50%. Similarly, the total mass (or total thermal effusivity) of the TEEM 128 of the second scrim layer 120B is greater than the total mass (or total thermal effusivity) of the second foam layer 124, such as by at least 3%, by about 3% to about 100%, or by about 10% to about 50%.

The PCM 126 and/or the TEEM 128 of the second scrim layer 120B may be provided or arranged in the gradient distribution that increases in the depth direction D1 (i.e., the intra-layer gradient distribution that increases in the depth direction D1). For example, the second scrim layer 120B may include a proximal scrim portion (e.g., a proximal surface portion) having a first total mass portion (or first latent heat potential) of the total mass (or total latent heat potential) of the PCM 126 of the second scrim layer 120B, and a distal scrim portion (e.g., a distal surface portion) and underlying the proximal scrim portion in the depth direction D1 having a second total mass portion (or second latent heat potential) of the total mass (or total latent heat potential) of the PCM 126 of the second scrim layer 120B, the second total mass portion (or second latent heat potential) of the PCM 126 being greater than the first total mass portion (or first latent heat potential) of the PCM 126. In some such embodiments, the second total mass portion (or second latent heat potential) of the PCM 126 of the second scrim layer 120B is greater than the first total mass portion (or first latent heat potential) of the PCM 122 of the of the second scrim layer 120B by at least 3%, by about 3% to about 100%, or by about 10% to about 50%. As another example, the proximal scrim portion may have a first total mass portion (or first thermal effusivity) of the total mass (or total thermal effusivity) of the TEEM 128 of the second scrim layer 120B, and the distal scrim portion 134 may have a second total mass portion (or second thermal effusivity) of the total mass (or total thermal effusivity) of the TEEM 128 of the second scrim layer 120B, the second total mass portion (or second thermal effusivity) of the TEEM 128 being greater than the first total mass portion (or first thermal effusivity) of the TEEM 128. In some such embodiments, the second total mass portion (or second thermal effusivity) of the TEEM 128 of the second scrim layer 120B is greater than the first total mass portion (or first thermal effusivity) of the TEEM 128 of the of the second scrim layer 120B by at least 3%, by about 3% to about 100%, or by about 10% to about 50%.

In some such embodiments, the second scrim layer 120B may include a medial scrim portion positioned between the proximal and distal scrim portion in the depth direction D1, such as at or proximate to a medial portion of the thickness T1 of the second scrim layer 120B. The medial scrim portion may include a third total mass portion (or third latent heat potential) of the total mass (or total latent heat potential) of the PCM 126 of the second scrim layer 120B, the third total mass portion (or third latent heat potential) of the PCM 126 being greater than the first total mass portion (or first latent heat potential) of the PCM 126 and less than the second total mass portion (or second latent heat potential) of the PCM 126 of the second scrim layer 120B. For example, the third total mass portion (or third latent heat potential) of the PCM 126 may be greater than the first total mass portion (or first latent heat potential) of the PCM 126 of the second scrim layer 120B, and less than the second total mass portion (or second latent heat potential) of the PCM 126 of the second scrim layer 120B, by at least 3%, by about 3% to about 100%, or by about 10% to about 50%. The medial scrim portion 132 may also include a third total mass portion (or third total thermal effusivity) of the total mass (or total thermal effusivity) of the TEEM 128 of the second scrim layer 120B, the third total mass portion (or third total thermal effusivity) of the TEEM 128 of the second scrim layer 120B being greater than the first total mass portion (or first total thermal effusivity) of the TEEM 128 and less than the second total mass portion (or second total thermal effusivity) of the TEEM 128 of the second scrim layer 120B. For example, the third total mass portion (or third total thermal effusivity) of the TEEM 128 may be greater than the first total mass portion (or first total thermal effusivity) of the TEEM 128 of the second scrim layer 120B, and less than the second total mass portion (or second total thermal effusivity) of the TEEM 128 of the second scrim layer 120B, by at least 3%, by about 3% to about 100%, or by about 10% to about 50%. It is noted that the second scrim layer 120B may include any number of portions along the depth direction with differing loadings of the PCM 126 and/or the TEEM 128 thereof that increases in the depth direction D1, such as just two of the proximal, medial and distal portions, or at least one additional portion beyond the proximal, medial and distal portions.

As shown in FIGS. 8-10, the first and second scrim layers 120A, 120B 122 comprise separate and distinct scrim layers that are separate and distinct from each other and the other layers of the plurality of layers 112 of the cooling cartridge portion 110 of the mattress 100. In some embodiments, the entirety of the first scrim layer 120A is spaced from the entirety of the second scrim layer 120B in the depth direction via the thicknesses of the first and second foam layers 122, 124. In some embodiments, the material and/or configuration (but for the loading of the PCM 126 and/or TEEM 128 thereof) of the second scrim layer 120A is substantially the same or similar to the first scrim layer 120. For example, in some embodiments, the second scrim layer 120B may comprises a fabric weight within the range of about 20 GSM and about 80 GSM, and/or an air permeability of at least about 1½ ft3/min. In some other embodiments, the material and/or configuration (including the loading of the PCM 126 and/or TEEM 128 thereof) of the second scrim layer 120A differs from that of the first scrim layer 120.

Figure 11:
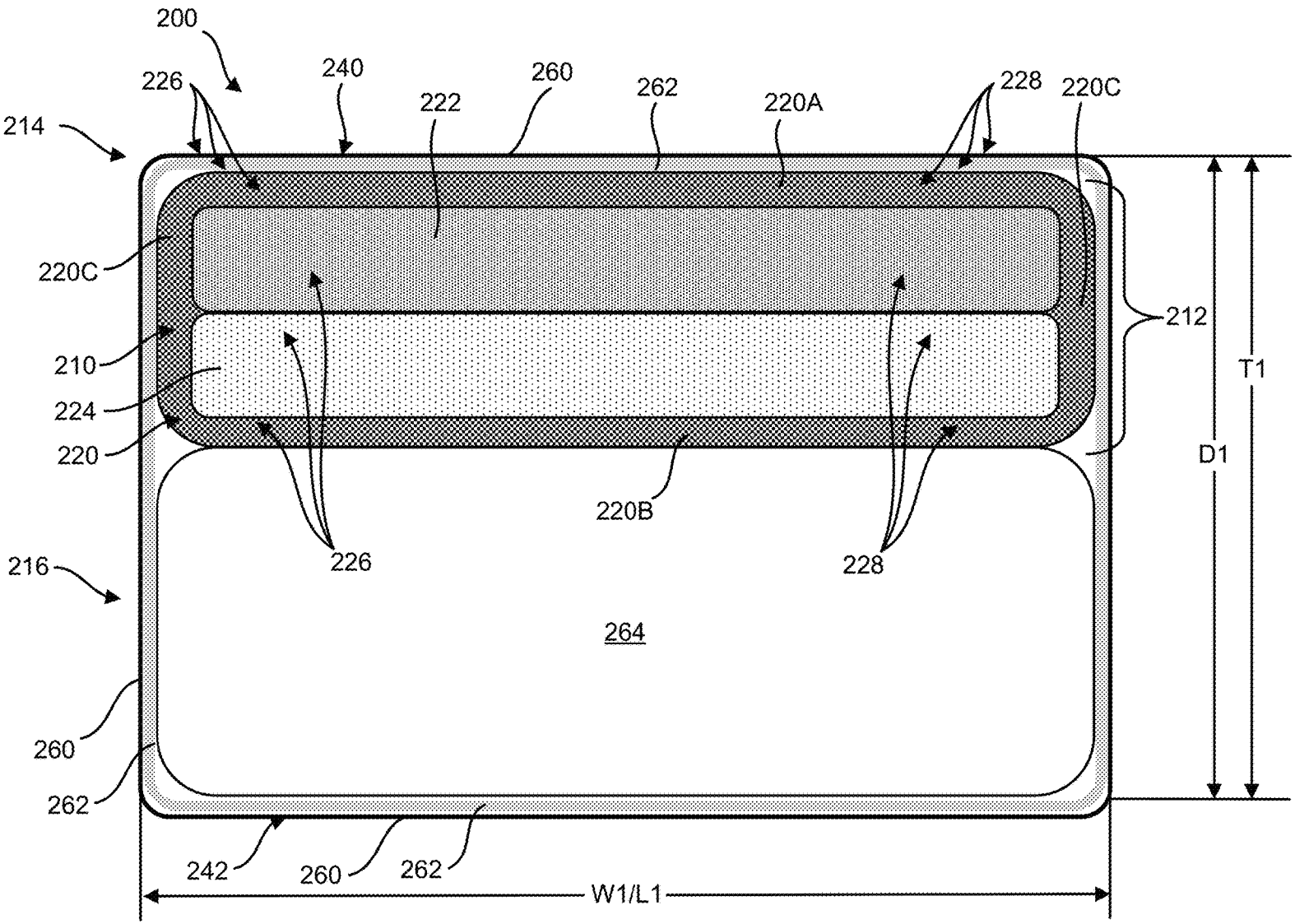
FIG. 11 illustrates a cross-sectional view of another exemplary cooling mattress according to the present disclosure.

FIG. 11 illustrates another cooling mattress 200 according to the present disclosure. The cooling mattress 200 incorporates a cooling cartridge portion 210 comprising a plurality of consecutive separate and distinct layers 210 that absorbs or draws an unexpectedly large amount of heat away from a user for an unexpectedly long timeframe. The mattress 200 may comprise and/to be similar to the cushion described above with respect to FIGS. 3-5, and is substantially similar to the mattress 100 described above with respect to FIGS. 6-10, and therefore the description contained herein directed thereto equally applies to the mattress 200 of FIG. 11 but may not be repeated herein below for brevity sake. Like components and aspects of the mattress 200, and the cooling cartridge portion 210 to the cushion of FIGS. 3-5 and the mattress 100 of FIGS. 6-10, are thereby indicated by like reference numerals preceded with "2."

As shown in FIG. 11, the mattress 200 differs from the mattress 100 in that the cooling cartridge portion 210 contains a scrim layer 220 that extends about the width W1 and/or length L1 of the first and second foam layers 222, 224. The scrim layer 220 may form an enclosure, sleeve or bag that contains the first and second foam layers 222, 224, for example. The first scrim layer 220A may thereby compromise a first portion of the scrim layer 220 (directly) overlying the first foam layer 222, and the second scrim layer 120B may thereby comprise a second portion of the scrim layer 220 (directly) underlying the second foam layer 224 in the depth direction D1, as shown in FIG. 11. The first and second scrim layer portions 220A, 220B of the scrim layer 220 may include different differing loadings of the PCM 226 and or TEEM 128, as described above. The first and second scrim layer portions 220A, 220B may be formed via differing processes or operations (or with different parameters thereof) such that their PCM 226 and/or TEEM 128 loadings differ.

As also shown in FIG. 11, the scrim layer 220 may include lateral and/or longitudinal side portions 220C extending between the first and second scrim layer portions 220A, 220B in the thickness T1 along the width W1 and/or length L1 of the mattress 200. In the illustrated exemplary embodiment shown in FIG. 11, the lateral and/or longitudinal side portions 220C of the scrim layer 220 portion are void of the PCM 226 and or TEEM 228. However, in alternative embodiments (not shown), the lateral and/or longitudinal side portions 220C of the scrim layer 220 may include the PCM 226 and or TEEM 228.

Figure 12:
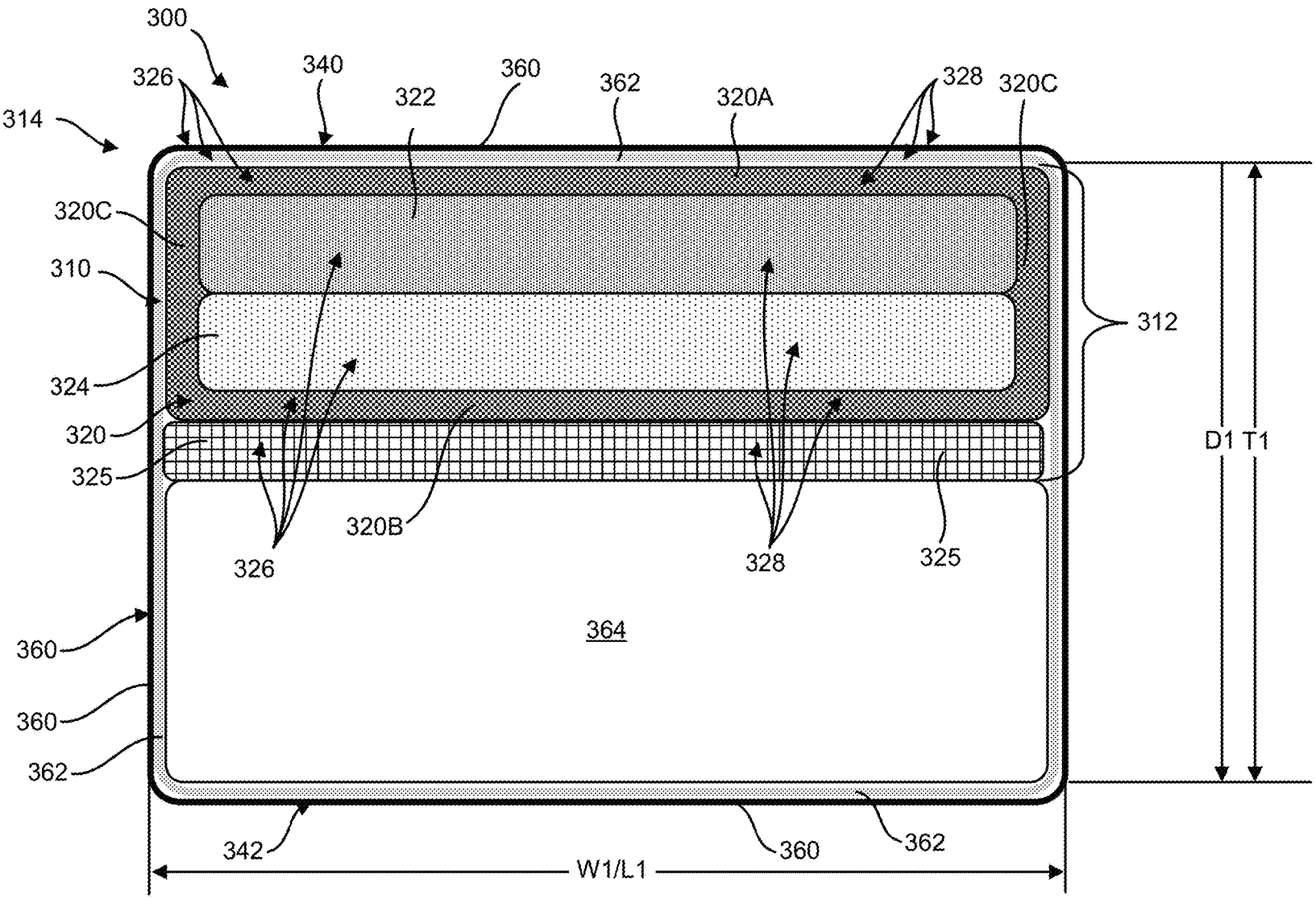
FIG. 12 illustrates a cross-sectional view of another exemplary cooling mattress according to the present disclosure.

FIG. 12 illustrates another cooling mattress 300 according to the present disclosure. The cooling mattress 300 incorporates a cooling cartridge portion 310 comprising a plurality of consecutive separate and distinct layers 310 that absorbs or draws an unexpectedly large amount of heat away from a user for an unexpectedly long timeframe. The mattress 300 may comprise and/to be similar to the cushion described above with respect to FIGS. 3-5, and is substantially similar to the mattress 100 of FIGS. 6-10 and the mattress 200 of FIG. 11, and therefore the description contained herein directed thereto equally applies to the mattress 300 of FIG. 12 but may not be repeated herein below for brevity sake. Like components and aspects of the mattress 300 and the cooling cartridge portion 310 thereof to the cushion of FIGS. 3-5, the mattress 100 of FIGS. 6-10 and/or the mattress 200 of FIG. 11 are thereby indicated by like reference numerals preceded with "3."

As shown in FIG. 12, the mattress 300 differs from the mattress 100 and the mattress 200 in that the cooling cartridge portion 310 comprises a distal batting layer 325 overlying (e.g., directly overlying) the base portion 364 and/or underlying (e.g., directly underlying) the second scrim layer/portion 120B in the depth direction D1. The batting layer 325 may be comprised of any matting material, such as a woven or non-woven fiber batting. The batting layer 325 may be comprised of one or more batting layers loosely overlying each other in the depth direction D1 or coupled together.

In some embodiments, the batting layer 325 may define a thickness along the thickness T1 of the mattress 300 that is greater than a thickness of the first scrim layer/portion 320A and/or a thickness of the second scrim layer/portion 320B. In some embodiments, the batting layer 325 may comprise a loft along the depth direction D1 that is greater than that of the first scrim layer/portion 320A and/or that of the second scrim layer/portion 320B. In some embodiments, the batting layer 325 may comprise a volumetric airflow (i.e., CFM) along the depth direction D1 that is less than that of the first scrim layer/portion 320A and/or that of the second scrim layer/portion 320B.

As shown in FIGS. 8-10, the batting layer 325 may include the PCM 326 and/or the TEEM 328. As described above, the batting layer 325 may comprise the PCM 326 and the TEEM 328 in greater total amounts or loadings than the overlying layers of the cooling cartridge portion 310 (and the proximal top cover portion 314 if it includes the PCM 326 or the TEEM 328). For example, the total mass (or total latent heat potential) of the PCM 326 of the batting layer 325 may be greater than the total mass (or total latent heat potential) of the second scrim layer/portion 320B, such as by at least 3%, by about 3% to about 100%, or by about 10% to about 50%. Similarly, the total mass (or total thermal effusivity) of the TEEM 328 of the batting layer 32 may be greater than the total mass (or total thermal effusivity) of the second scrim layer 320B, such as by at least 3%, by about 3% to about 100%, or by about 10% to about 50%.

The PCM 326 and/or the TEEM 328 of the batting layer 325 may be provided or arranged in the gradient distribution that increases in the depth direction D1 (i.e., the intra-layer gradient distribution that increases in the depth direction D1). For example, the batting layer 325 may include a proximal batting portion (e.g., a proximal surface portion) having a first total mass portion (or first latent heat potential) of the total mass (or total latent heat potential) of the PCM 326 of the batting layer 325, and a distal batting portion (e.g., a distal surface portion) and underlying the proximal batting portion in the depth direction D1 having a second total mass portion (or second latent heat potential) of the total mass (or total latent heat potential) of the PCM 326 of the batting layer 325, the second total mass portion (or second latent heat potential) of the PCM 326 being greater than the first total mass portion (or first latent heat potential) of the PCM 326. In some such embodiments, the second total mass portion (or second latent heat potential) of the PCM 326 of the batting layer 325 is greater than the first total mass portion (or first latent heat potential) of the PCM 326 of the of the batting layer 325 by at least 3%, by about 3% to about 100%, or by about 10% to about 50%. As another example, the proximal batting portion may have a first total mass portion (or first thermal effusivity) of the total mass (or total thermal effusivity) of the TEEM 328 of the batting layer 325, and the distal batting portion 134 may have a second total mass portion (or second thermal effusivity) of the total mass (or total thermal effusivity) of the TEEM 328 of the batting layer 325, the second total mass portion (or second thermal effusivity) of the TEEM 328 being greater than the first total mass portion (or first thermal effusivity) of the TEEM 328. In some such embodiments, the second total mass portion (or second thermal effusivity) of the TEEM 328 of the batting layer 325 is greater than the first total mass portion (or first thermal effusivity) of the TEEM 328 of the of the batting layer 325 by at least 3%, by about 3% to about 100%, or by about 10% to about 50%.

In some such embodiments, the batting layer 325 may include a medial batting portion positioned between the proximal and distal batting portions in the depth direction D1, such as at or proximate to a medial portion of the thickness T1 of the batting layer 325. The medial batting portion may include a third total mass portion (or third latent heat potential) of the total mass (or total latent heat potential) of the PCM 326 of the batting layer 325, the third total mass portion (or third latent heat potential) of the PCM 326 being greater than the first total mass portion (or first latent heat potential) of the PCM 326 and less than the second total mass portion (or second latent heat potential) of the PCM 326 of the batting layer 325. For example, the third total mass portion (or third latent heat potential) of the PCM 326 may be greater than the first total mass portion (or first latent heat potential) of the PCM 326 of the batting layer 325, and less than the second total mass portion (or second latent heat potential) of the PCM 326 of the batting layer 325, by at least 3%, by about 3% to about 100%, or by about 10% to about 50%. The medial batting portion may also include a third total mass portion (or third total thermal effusivity) of the total mass (or total thermal effusivity) of the TEEM 328 of the batting layer 325, the third total mass portion (or third total thermal effusivity) of the TEEM 328 of the batting layer 325 being greater than the first total mass portion (or first total thermal effusivity) of the TEEM 328 and less than the second total mass portion (or second total thermal effusivity) of the TEEM 328 of the batting layer 325. For example, the third total mass portion (or third total thermal effusivity) of the TEEM 328 may be greater than the first total mass portion (or first total thermal effusivity) of the TEEM 328 of the batting layer 325, and less than the second total mass portion (or second total thermal effusivity) of the TEEM 328 of the batting layer 325, by at least 3%, by about 3% to about 100%, or by about 10% to about 50%. It is noted that the batting layer 325 may include any number of portions along the depth direction with differing loadings of the PCM 326 and/or the TEEM 328 thereof that increases in the depth direction D1, such as just two of the proximal, medial and distal portions, or at least one additional portion beyond the proximal, medial and distal portions.

Figure 13:
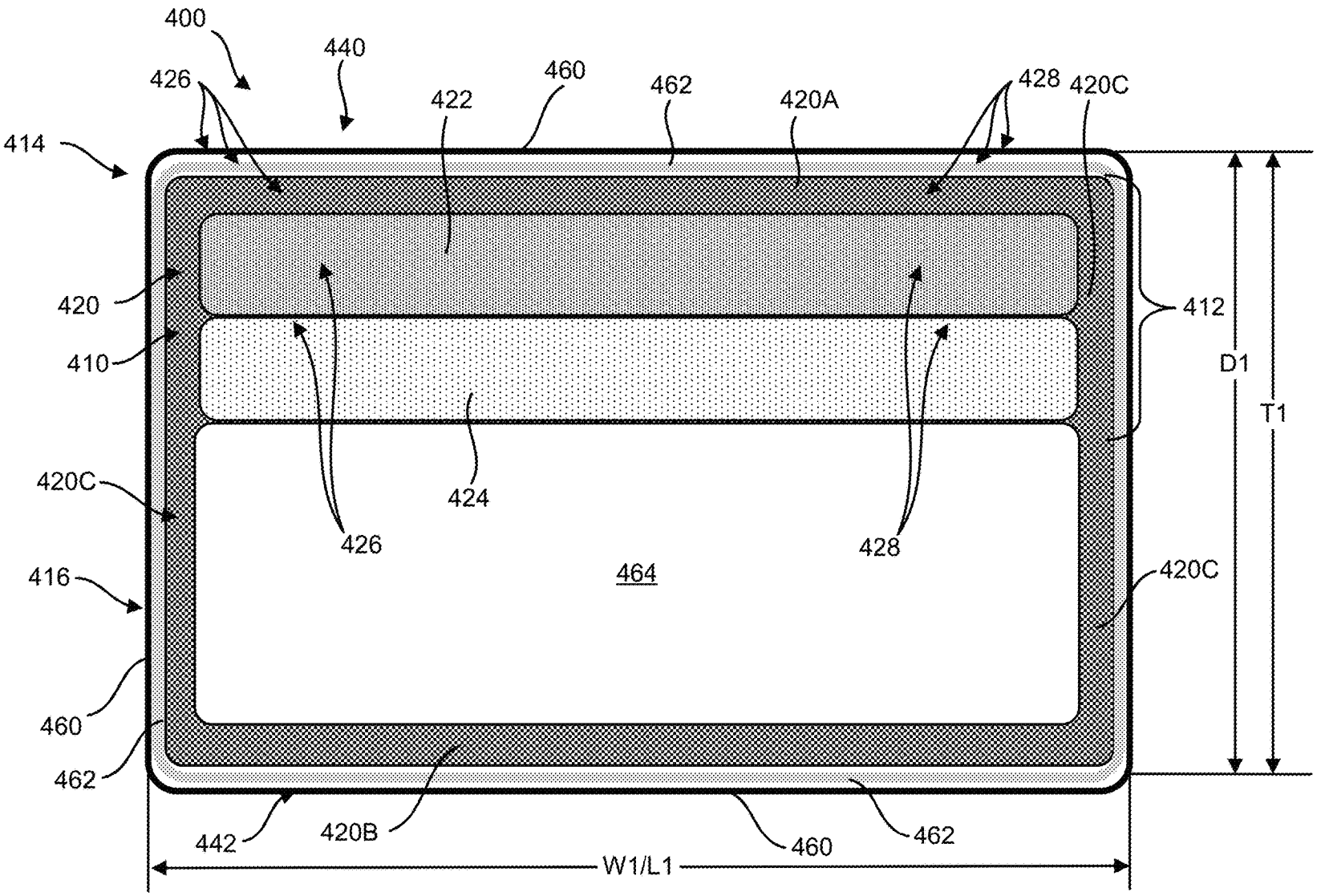
FIG. 13 illustrates a cross-sectional view of another exemplary cooling mattress according to the present disclosure.

FIG. 13 illustrates another cooling mattress 400 according to the present disclosure. The cooling mattress 400 incorporates a cooling cartridge portion 410 comprising a plurality of consecutive separate and distinct layers 412 that absorbs or draws an unexpectedly large amount of heat away from a user for an unexpectedly long timeframe. The mattress 400 may comprise and/to be similar to the cushion described above with respect to FIGS. 3-5, and is substantially similar to the mattress 100 of FIGS. 6-10, the mattress 200 of FIG. 11 and the mattress 300 of FIG. 12, and therefore the description contained herein directed thereto equally applies to the mattress 400 of FIG. 13 but may not be repeated herein below for brevity sake. Like components and aspects of the mattress 400 and the cooling cartridge portion 410 thereof to the cushion of FIGS. 3-5, the mattress 100 of FIGS. 6-10, the mattress 200 of FIG. 11 and/or the mattress 300 of FIG. 12 are thereby indicated by like reference numerals preceded with "4."

As shown in FIG. 13, the mattress 400 differs from the mattress 100, the mattress 200 and the mattress 300 in that the second scrim layer/portion 420B of the scrim layer 420 is underlying (e.g., directly underlying) the base portion 416 in the depth direction D1. As shown in FIG. 13, the scrim layer 420 of the mattress 400 may extend about the width W1 and/or length L1 of the first and second foam layers 422, 424 and the base portion 416 (and the batting layer, if provided). The scrim layer 420 may thereby form an enclosure, sleeve or bag that contains the first and second foam layers 422, 424 and the base portion 416 (and the batting layer, if provided), for example. The first scrim layer 420A may thereby compromise a first portion of the scrim layer 420 (directly) overlying the first foam layer 422, and the second scrim layer 420B may thereby comprise a second portion of the scrim layer 420 (directly) underlying the base portion 416 in the depth direction D1, as shown in FIG. 13. As also shown in FIG. 13, in some embodiments, the second scrim layer/portion 420B may overlay (e.g., directly overlay) the fire resistant sock/cap 462 (if provided) and/or the cover layer 460 (if provided) in the depth direction D1.

In the illustrated exemplary embodiment, the second scrim layer/portion 420B is void the PCM 426 and/or the TEEM 428. However, in some alternative embodiments (not shown), the second scrim layer/portion 420B may include the PCM 426 and/or the TEEM 428.

Figure 14:
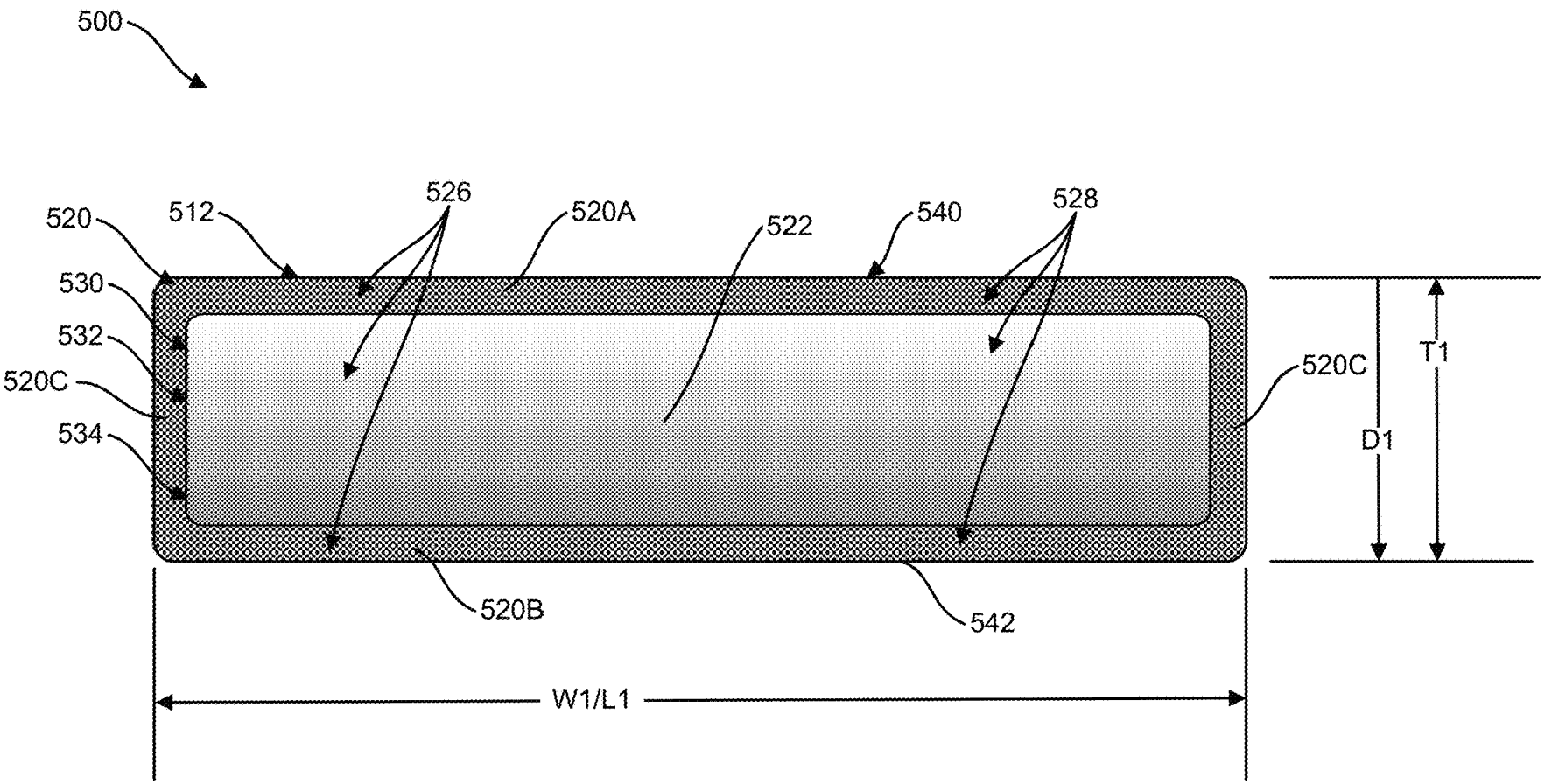
FIG. 14 illustrates a cross-sectional view of an exemplary cooling pad according to the present disclosure.

FIG. 14 illustrates a cooling pad or mat 500 according to the present disclosure. The cooling pad or mat 500 incorporates a plurality of consecutive separate and distinct layers 512 that absorbs or draws an unexpectedly large amount of heat away from a user for an unexpectedly long timeframe. The pad or mat 500 may comprise and/or be similar to the cushion described above with respect to FIGS. 3-5, the cooling cartridge portion 110 of FIGS. 6-10, the cooling cartridge portion 210 of FIG. 11, the cooling cartridge portion 310 of FIG. 12, and the cooling cartridge portion 410 of FIG. 13, and therefore the description contained herein directed thereto equally applies to the cooling pad or mat 500 of FIG. 14 but may not be repeated herein below for brevity sake. Like components and aspects of the cooling pad or mat 500 to the cushion of FIGS. 3-5, the cooling cartridge portion 110 of FIGS. 6-10, the cooling cartridge portion 210 of FIG. 11, the cooling cartridge portion 310 of FIG. 12, and the cooling cartridge portion 410 of FIG. 13 are thereby indicated by like reference numerals preceded with "5."

As shown in FIG. 14, the cooling pad or mat 500 may define a width W1, length L1 and thickness T1 extending between a proximal side portion or surface 540 and a distal side portion or surface 540 along the depth direction D1. The cooling pad or mat 500 may be sized and otherwise configured to overly a bed, chair, couch, seat, ground/floor, bench, or any other surface or structure that supports at least a portion of a user to add (or enhance) a cooling function/mechanism thereto.

As shown in FIG. 14, the cooling pad or mat 500 may comprise a proximal fabric layer 520A, a medial layer 522 underlying (e.g., directly underlying) the proximal fabric layer 520A, and a distal fabric layer 520B underlying (e.g., directly underlying) the medial layer 522. The proximal fabric layer 520A, medial layer 522 and the distal fabric layer 520B each include the PCM 526 and the TEEM 528, as shown in FIG. 14. The cooling pad or mat 500 includes the inter-layer gradient distribution of the PCM 526 and the TEEM 528 that increases in the depth direction D1, and the intra-layer gradient distribution of the PCM 526 and the TEEM 528 of at least one layer thereof that increases in the depth direction D1.

In some embodiments, the proximal fabric layer 520A may not include the intra-layer gradient distribution of the PCM 526 and the TEEM 528. For example, only a distal portion of the proximal fabric layer 520A may include a mass of the PCM 526 and/or the TEEM 528. In some other embodiment, the PCM 526 and/or the TEEM 528 of the proximal fabric layer 520A may be provided or arranged in the gradient distribution that increases in the depth direction D1 (i.e., the intra-layer gradient distribution that increases in the depth direction D1).

For example, the proximal fabric layer 520A may include a proximal fabric portion (e.g., a proximal surface portion) that is positioned at or proximate to the top proximal surface 540 having a first total mass portion (or first latent heat potential) of the total mass (or total latent heat potential) of the PCM 526 of the proximal fabric layer 520A, and a distal fabric portion (e.g., a distal surface portion) that is positioned distal to the top proximal surface 540 and underlying the proximal fabric portion in the depth direction D1 having a second total mass portion (or second latent heat potential) of the total mass (or total latent heat potential) of the PCM 526 of the proximal fabric layer 520A, the second total mass portion (or second latent heat potential) of the PCM 526 being greater than the first total mass portion (or first latent heat potential) of the PCM 526. In some such embodiments, the second total mass portion (or second latent heat potential) of the PCM 526 of the proximal fabric layer 520A is greater than the first total mass portion (or first latent heat potential) of the PCM 122 of the of the proximal fabric layer 520A by at least 3%, by about 3% to about 100%, or by about 10% to about 50%. As another example, the proximal fabric portion of the proximal fabric layer 520A may have a first total mass portion (or first thermal effusivity) of the total mass (or total thermal effusivity) of the TEEM 528 of the proximal fabric layer 520A, and the distal fabric portion 134 may have a second total mass 528 (or second thermal effusivity) of the total mass (or total thermal effusivity) of the TEEM 128 of the proximal fabric layer 520A, the second total mass portion (or second thermal effusivity) of the TEEM 528 being greater than the first total mass portion (or first thermal effusivity) of the TEEM 528. In some such embodiments, the second total mass portion (or second thermal effusivity) of the TEEM 528 of the proximal fabric layer 520A is greater than the first total mass portion (or first thermal effusivity) of the TEEM 528 of the proximal fabric layer 520A by at least 3%, by about 3% to about 100%, or by about 10% to about 50%.

In some such embodiments, the proximal fabric layer 520A may include a medial fabric portion positioned between the proximal and distal fabric portions in the depth direction D1, such as at or proximate to a medial portion of the thickness T1 of the proximal fabric layer 520A. The medial fabric portion may include a third total mass portion (or third latent heat potential) of the total mass (or total latent heat potential) of the PCM 526 of the proximal fabric layer 520A, the third total mass portion (or third latent heat potential) of the PCM 526 being greater than the first total mass portion (or first latent heat potential) of the PCM 526 and less than the second total mass portion (or second latent heat potential) of the PCM 526 of the proximal fabric layer 520A. For example, the third total mass portion (or third latent heat potential) of the PCM 526 may be greater than the first total mass portion (or first latent heat potential) of the PCM 526 of the proximal fabric layer 520A, and less than the second total mass portion (or second latent heat potential) of the PCM 526 of the proximal fabric layer 520A, by at least 3%, by about 3% to about 100%, or by about 10% to about 50%. The medial fabric portion 132 may also include a third total mass portion (or third total thermal effusivity) of the total mass (or total thermal effusivity) of the TEEM 528 of the proximal fabric layer 520A, the third total mass portion (or third total thermal effusivity) of the TEEM 528 of the proximal fabric layer 520A being greater than the first total mass portion (or first total thermal effusivity) of the TEEM 528 and less than the second total mass portion (or second total thermal effusivity) of the TEEM 528 of the proximal fabric layer 520A. For example, the third total mass portion (or third total thermal effusivity) of the TEEM 528 may be greater than the first total mass portion (or first total thermal effusivity) of the TEEM 528 of the proximal fabric layer 520A, and less than the second total mass portion (or second total thermal effusivity) of the TEEM 528 of the proximal fabric layer 520A, by at least 3%, by about 3% to about 100%, or by about 10% to about 50%. It is noted that the proximal fabric layer 520A may include any number of portions along the depth direction with differing loadings of the PCM 526 and/or the TEEM 528 thereof that increases in the depth direction D1, such as just two of the proximal, medial and distal portions, or at least one additional portion beyond the proximal, medial and distal portions.

As shown in FIG. 14, the medial layer 522 directly underlying the first scrim layer 520A in the depth direction D1 may also include the PCM 526 and/or the TEEM 528. As described above, the medial layer 522 comprises the PCM 526 and the TEEM 528 in greater total amounts or loadings than the first scrim layer 520A. For example, the total mass (or total latent heat potential) of the PCM 526 of the medial layer 522 is greater than the total mass (or total latent heat potential) of the first scrim layer 520A, such as by at least 3%, by about 3% to about 100%, or by about 10% to about 50%. Similarly, the total mass (or total thermal effusivity) of the TEEM 528 of the medial layer 522 is greater than the total mass (or total thermal effusivity) of the first scrim layer 520A, such as by at least 3%, by about 3% to about 100%, or by about 10% to about 50%.

The medial layer 522 may also include an intra-layer gradient distribution of the PCM 526 and/or the TEEM 528 thereof that increases in the depth direction D1. For example, the medial layer 522 may include a proximal portion having a first total mass portion (and/or first latent heat potential) of the total mass (and/or total latent heat potential) of the PCM 526 of the medial layer 522 and a first total mass portion (and/or first thermal effusivity) of the second total mass (and/or total thermal effusivity) of the TEEM 528 of the medial layer 522, and a distal foam portion having a second total mass portion (and/or second latent heat potential) of the total mass (and/or total latent heat potential) of the PCM 526 of the medial layer 522 that is greater than the first total mass portion (and/or first latent heat potential) thereof and a second total mass portion (and/or second thermal effusivity) of the total mass (and/or total thermal effusivity) of the TEEM 528 of the medial layer 522 that is greater than the first total mass portion (and/or first thermal effusivity) thereof. In some embodiments, the second total mass portion (and/or second latent heat potential) of the total mass (and/or total latent heat potential) of the PCM 526 of the medial layer 522 may be greater than first portion (and/or first latent heat potential) thereof by at least 3%, by about 3% to about 100%, or by about 10% to about 50%. In some embodiments, the second total mass portion (and/or second thermal effusivity) or the total mass (and/or total thermal effusivity) of the TEEM 528 may be greater than first portion (and/or first thermal effusivity) thereof by at least 3%, by about 3% to about 100%, or by about 10% to about 50%.

In some such embodiments, the medial layer 522 may further comprise a medial portion positioned between the proximal and distal portions thereof in the depth direction D1, such as at or proximate to the middle of the thickness T1 of the medial layer 522. The medial portion may have a third total mass portion of the total mass of the PCM 526 of the medial layer 522, and a third total mass portion (and/or third latent heat potential) of the total mass (and/or total latent heat potential) of the TEEM 528 of the medial layer 522. The third total mass portion (and/or third latent heat potential) of the total mass (and/or total latent heat potential) of the PCM 526 of the medial layer 522 being greater than the first total mass portion (and/or first latent heat potential) and the less than the second mass portion (and/or second latent heat potential) of the total mass (and/or total latent heat potential) of the PCM 526 of the medial layer 522, and third total mass portion (and/or third thermal effusivity) of the total mass (and/or total thermal effusivity) of the TEEM 528 of the medial layer 522 being greater than the first total mass portion (and/or first thermal effusivity) and the less than the second mass portion (and/or second thermal effusivity) of the total mass (and/or total thermal effusivity) of the TEEM 528 of the medial layer 522. In some embodiments, the third total mass portion (and/or latent heat potential) of the total mass (and/or total latent heat potential) of the PCM 526 may be greater than first total mass portion (and/or first latent heat potential) thereof and less than the second total mass portion (and/or second latent heat potential) thereof by at least 3%, by about 3% to about 100%, or by about 10% to about 50%. In some embodiments, the third total mass portion (and/or third thermal effusivity) of the total mass (and/or total thermal effusivity) of the TEEM 528 may be greater than first portion (and/or first thermal effusivity) thereof and less than the second total mass (and/or second thermal effusivity) portion by at least 3%, by about 3% to about 100%, or by about 10% to about 50%. It is noted that the medial layer 522 may include any number of portions along the depth direction with differing loadings of the PCM 526 and/or the TEEM 528 thereof that increases in the depth direction D1, such as just two of the proximal, medial and distal portions, or at least one additional portion beyond the proximal, medial and distal portions.

The medial layer 522 may comprise any material or configuration. For example, medial layer 522 may comprise one or more layers of batting, scrim, foam or a combination thereof, for example. In one exemplary embodiment, the medial layer 522 comprises a batting layer.

As shown in FIG. 14, the second scrim layer 520B directly underlying the medial layer 522 in the depth direction D1 also may include the PCM 526 and/or the TEEM 528. As described above, the second scrim layer 520B comprises the PCM 126 and the TEEM 528 in greater total amounts or loadings than the overlying layers of the cooling pad or mat 500. For example, the total mass (or total latent heat potential) of the PCM 526 of the second scrim layer 520B is greater than the total mass (or total latent heat potential) of the medial layer 522, such as by at least 3%, by about 3% to about 100%, or by about 10% to about 50%. Similarly, the total mass (or total thermal effusivity) of the TEEM 528 of the second scrim layer 520B is greater than the total mass (or total thermal effusivity) of the medial layer 522, such as by at least 3%, by about 3% to about 100%, or by about 10% to about 50%.

The PCM 526 and/or the TEEM 528 of the second scrim layer 520B may also be provided or arranged in the gradient distribution that increases in the depth direction D1 (i.e., the intra-layer gradient distribution that increases in the depth direction D1), as described above with respect to the first scrim layer 520A, for example.

As shown in FIG. 14, the first and second scrim layers 520A, 520B may be proximal and distal portions of a scrim layer 520. The scrim layer 520 may thereby extend about or around the medial layer 522 along the width W1 and/or length L1 directions. For example, the scrim layer 520 may include third portions 520C that extend between the first and second scrim layers 520A, 520B along the thickness T1 of the mat or pad 500. In some alternative embodiments (not shown), the first and second scrim layers 520A, 520B may be separate and distinct layers, which may be directly coupled to each other or indirectly coupled to each other (e.g., via the medial layer 522).

Figure 15:
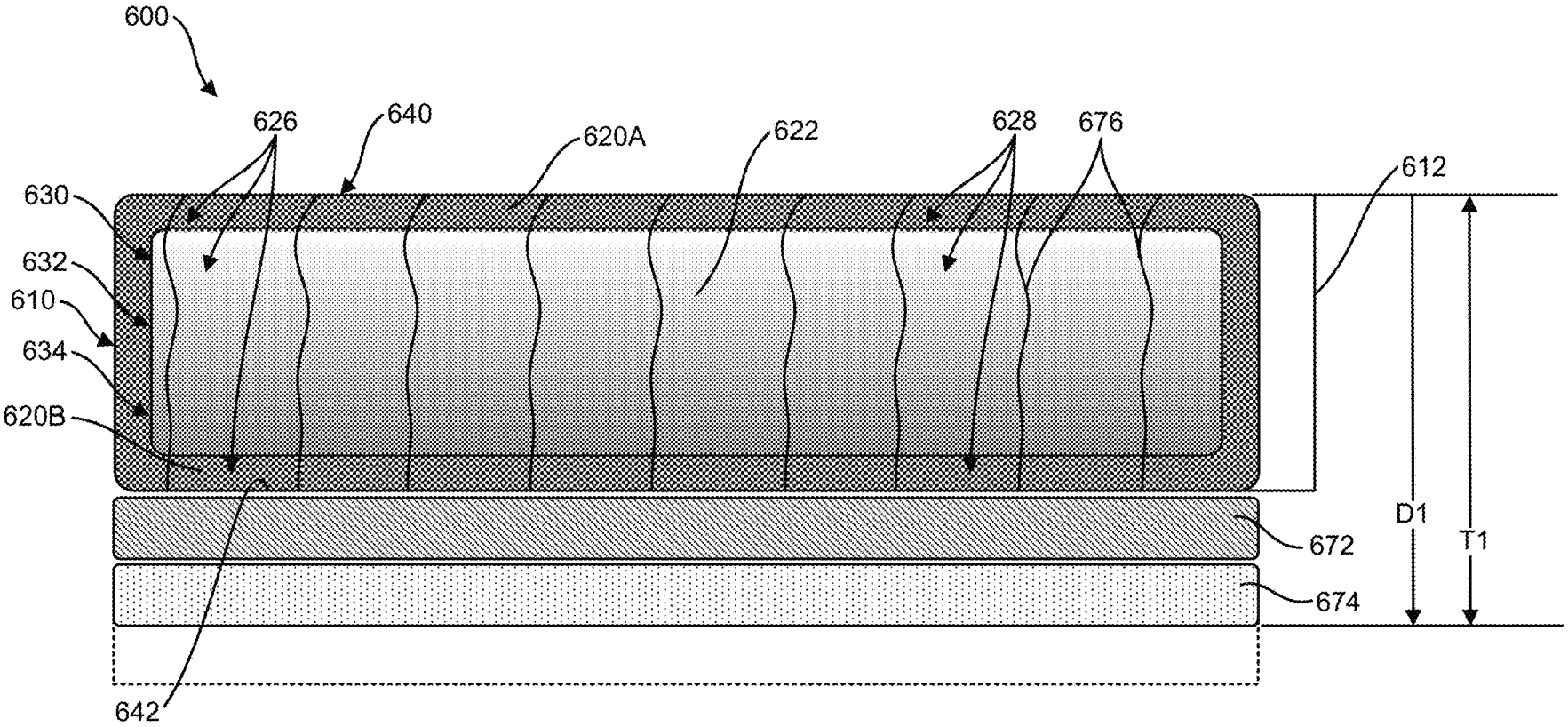
FIG. 15 illustrates a cross-sectional view of an exemplary quilted cooling pad according to the present disclosure.

FIG. 15 illustrates a quilted cooling pad or mat 600 according to the present disclosure. The quilted cooling pad or mat 600 incorporates a plurality of consecutive separate and distinct layers 612 that absorbs or draws an unexpectedly large amount of heat away from a user for an unexpectedly long timeframe. The pad or mat 600 may comprise and/or be similar to the cushion described above with respect to FIGS. 3-5, the cooling cartridge portion 110 of FIGS. 6-10, the cooling cartridge portion 210 of FIG. 11, the cooling cartridge portion 310 of FIG. 12, the cooling cartridge portion 410 of FIG. 13, and the cooling pad or mat 500 of FIG. 14, and therefore the description contained herein directed thereto equally applies to the cooling pad or mat 600 of FIG. 15 but may not be repeated herein below for brevity sake. Like components and aspects of the cooling pad or mat 600 to the cushion of FIGS. 3-5, the cooling cartridge portion 110 of FIGS. 6-10, the cooling cartridge portion 210 of FIG. 11, the cooling cartridge portion 310 of FIG. 12, the cooling cartridge portion 410 of FIG. 13, and the cooling pad or mat 500 of FIG. 14 are thereby indicated by like reference numerals preceded with "6."

As shown in FIG. 15, the cooling pad or mat 600 is substantially similar to the cooling pad or mat 500 of FIG. 14, but differs in that is includes quilting, stitching or the like 676 that forms or defines distinct areas or chambers of the pad or mat 600. The quilting, stitching or the like may extend through the first scrim layer 620A, the medial layer 622, and the second scrim layer 620B, as shown in FIG. 15.

As described above with respect to the cooling pad or mat 500 of FIG. 14, the proximal first fiber layer 620A (e.g., a woven fiber layer) may include the PCM 626 and/or the TEEM 628 provided or arranged in the gradient distribution that increases in the depth direction D1 (i.e., an intra-layer gradient distribution of the PCM 626 and/or the TEEM 628 that increases in the depth direction D1). For example, the proximal first fiber layer 620A may include a distal surface portion of the thickness T1 thereof that is adjacent to the medial layer 622 with a mass portion (and/or latent heat potential) of the PCM 626 and/or a mass portion (e.g., a thermal effusivity) of the TEEM 628 that is greater than that of a medial portion and/or proximal portion of the proximal first fiber layer 620A.

Similarly, as also described above, the distal second fiber layer 620B (e.g., a woven fiber layer) may include the PCM 626 and/or the TEEM 628 provided or arranged in the gradient distribution that increases in the depth direction D1 (i.e., an intra-layer gradient distribution of the PCM 626 and/or the TEEM 628 that increases in the depth direction D1). For example, the distal second fiber layer 620B may include a distal surface portion of the thickness T1 thereof that is adjacent to the medial layer 622 with a mass portion (and/or latent heat potential) of the PCM 626 and/or a mass portion (e.g., a thermal effusivity) of the TEEM 628 that is greater than that of a medial portion and/or proximal portion of the distal second fiber layer 620B.

As shown in FIG. 14, the cooling pad or mat 600 may be configured to removably or selectively couple, or fixedly couple, to a first base fiber layer 672. For example, the distal side portion 642 and/or the distal second fiber layer 620B may be configured to couple to, or be coupled to, the first base fiber layer 672 underlying the distal second fiber layer 620B in the depth direction D1, as shown in FIG. 14. In some such embodiments, the distal second fiber layer 620B may be configured to removably couple with the first base fiber layer 672, such as via at least one zipper, hook-and-loop fastener, button fastener, another removable or selective coupling mechanism, or a combination thereof, for example. In some other embodiments, the distal second fiber layer 620B may be fixedly coupled with the first base fiber layer 67, such as via stitching and/or glue/adhesive, for example.

In some embodiments, the first base fiber layer 672 may be configured to couple to a portion of a base structure (e.g., a mattress, cushion or the like) or a second distal base fiber layer 674 underlying the first base fiber layer 672 in the depth direction D1, as shown in FIG. 14. The second fiber layer 674 may be configured to couple to, or be coupled to, (fixedly or removably) a base structure (e.g., a mattress, cushion or the like) underlying the second fiber layer 674 in the depth direction D1, as shown in FIG. 14. For example, in one exemplary embodiment, the first base fiber layer 672 may comprise a fabric top mattress sheet, and the second fiber layer 674 may comprise a fabric bed or mattress skirt configured to couple to a mattress and/or a mattress base structure. In some such embodiments, the first base fiber layer 672 and the second fiber layer 674 may be configured to removably couple together via at least one first zipper, and/or the second fiber layer 674 may be configured to removably couple to a mattress or mattress base structure via at least one other/second zipper.

As shown in FIG. 14, the first base fiber layer 672 and/or the second fiber layer 674 may be void of the PCM 626 and/or the TEEM 628. In some other embodiments (not shown), the first base fiber layer 672 and/or the second fiber layer 674 may comprise the PCM 626 and/or the TEEM 628 such that the inter-layer gradient distribution of the PCM 626 and/or the TEEM 628 that increases in the depth direction D1 is maintained. In such embodiments, the first base fiber layer 672 and/or the second fiber layer 674 may comprise the intra-layer gradient distribution of the PCM 626 and/or the TEEM 628 that increases in the depth direction D1.

Figure 16:
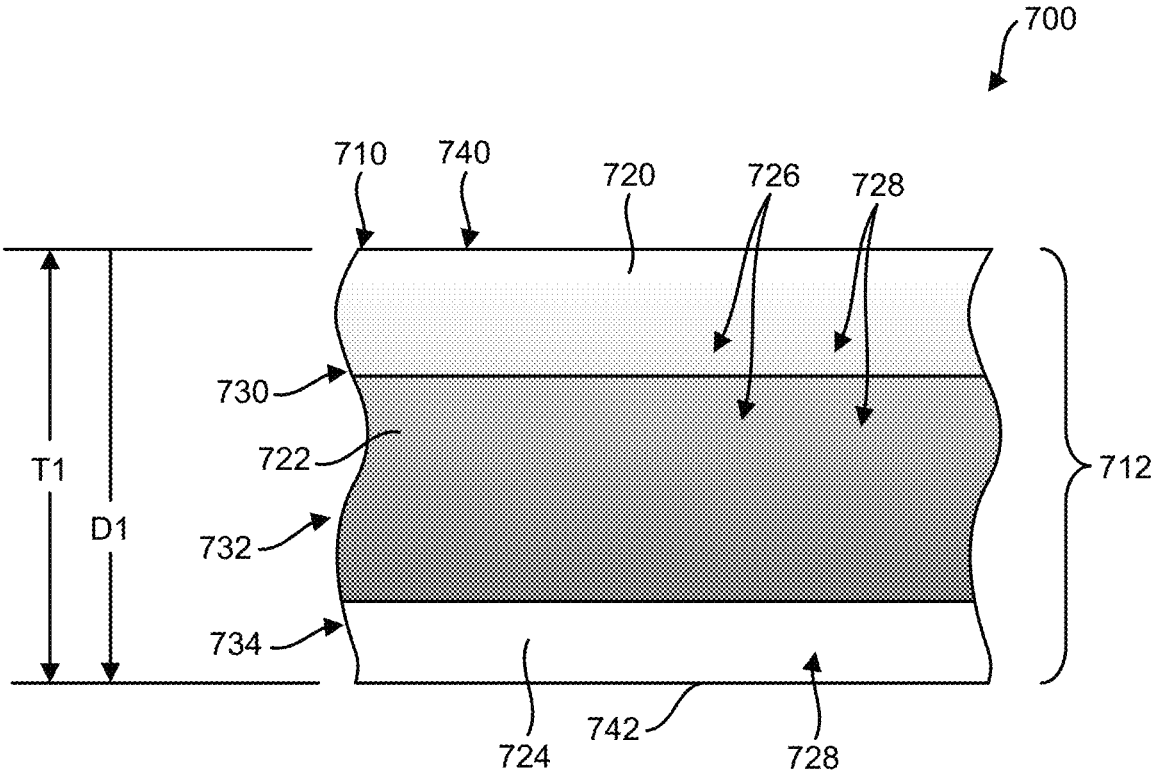
FIG. 16 illustrates a cross-sectional view of an exemplary cooling mattress protector according to the present disclosure.

FIG. 16 illustrates a cooling cushion protector 700 according to the present disclosure. The cooling cushion protector 700 incorporates a plurality of cooling layers 710 that include a plurality of consecutive separate and distinct cooling layers 612 that absorb or draw an unexpectedly large amount of heat away from a user for an unexpectedly long timeframe. The cooling cushion protector 700 may comprise and/or be similar to the cushion described above with respect to FIGS. 3-5, the cooling cartridge portion 110 of FIGS. 6-10, the cooling cartridge portion 210 of FIG. 11, the cooling cartridge portion 310 of FIG. 12, the cooling cartridge portion 410 of FIG. 13, the cooling pad or mat 500 of FIG. 14, and the quilted cooling pad or mat 600 of FIG. 15, and therefore the description contained herein directed thereto equally applies to the cooling cushion protector 700 but may not be repeated herein below for brevity sake. Like components and aspects of the cooling cushion protector 700 to the cushion of FIGS. 3-5, the cooling cartridge portion 110 of FIGS. 6-10, the cooling cartridge portion 210 of FIG. 11, the cooling cartridge portion 310 of FIG. 12, the cooling cartridge portion 410 of FIG. 13, the cooling pad or mat 500 of FIG. 14 and/or the quilted cooling pad or mat 500 of FIG. 15 are thereby indicated by like reference numerals preceded with "7."

The cooling cushion protector 700 may define a width, length and thickness T1 extending between a proximal side portion or surface 740 and a distal side portion or surface 742 along the depth direction D1. The cooling cushion protector 700 may be sized and otherwise configured to overly a mattress/bed, chair, couch, seat, ground/floor, bench, or any other surface or structure that supports at least a portion of a user to add (or enhance) a cooling function/mechanism thereto. In some embodiments, the cooling cushion protector 700 is configured as a cooling mattress protector that overlies a mattress to protect the mattress and provide (or enhance) a cooling function/mechanism therefor. In some embodiments, the cooling cushion protector 700 is configured as washable cushion protector such that the cooling effectiveness is not significantly decreased or lessened (e.g., by less than about 10%, or less than about 5%, or less than about 2%) by the washing of the protector 700, such as in a traditional washing machine. For example, the cooling cushion protector 700 may configured to retain a substantially amount (e.g., at least about 90%, or at least about 95%, or less than about at least about 97%) of the mass of the PCM 726 and/or TEEM 728 during washing of the protector 700, such as in a traditional washing machine.

As shown in FIG. 16, the plurality of consecutive separate and distinct cooling layers 612 comprise at least one top proximal fabric cover layer 720, and at least one medial scrim layer 722 underlying (e.g., directly underlying) the proximal fabric cover layer 720 in the depth direction D1. As also shown in FIG. 16, at least the proximal fabric cover layer 720 and the scrim layer 722 comprise the PCM 726 and/or the TEEM 728 such that the scrim layer 722 comprises a greater mass (or total latent heat potential) of the PCM 726 and/or a greater mass (or total thermal effusivity) of the TEEM 728 than that of the proximal fabric cover layer 720. As such, the cooling cushion protector 700 includes the intra-layer gradient distribution of the PCM 726 and/or the TEEM 728 that increases in the depth direction D1. For example, in some embodiments, the total mass (or total latent heat potential) of the PCM 726 of the scrim layer 722 is greater than the total mass (or total latent heat potential) of the PCM 726 of the proximal fabric cover layer 720, such as by at least 3%, by about 3% to about 100%, or by about 10% to about 50%. Similarly, in some embodiments, the total mass (or total thermal effusivity) of the TEEM 728 of the scrim layer 722 is greater than the total mass (or total thermal effusivity) of the TEEM 728 of the proximal fabric cover layer 720, such as by at least 3%, by about 3% to about 100%, or by about 10% to about 50%.

Further, as also shown in FIG. 16, each of the proximal fabric cover layer 720 and the scrim layer 722 include the intra-layer gradient distribution of the PCM 726 and/or the TEEM 728 thereof that increases in the depth direction D1. For example, in some embodiments, the proximal fabric cover layer 720 includes an intra-layer gradient distribution of the PCM 726 and the TEEM 728 thereof that increases in the depth direction D1. For example, the proximal fabric cover layer 720 may include at least a proximal portion 730 of the thickness of the layer 720 along the depth direction D1 having a first total mass portion (and/or first latent heat potential) of the total mass (and/or total latent heat potential) of the PCM 726 thereof and a first total mass portion (and/or first thermal effusivity) of the second total mass (and/or total thermal effusivity) of the TEEM 728 thereof, and a distal portion 734 of the thickness of the layer 720 along the depth direction D1 having a second total mass portion (and/or second latent heat potential) of the total mass (and/or total latent heat potential) of the PCM 726 of the layer 720 that is greater than the first total mass portion (and/or first latent heat potential) thereof and a second total mass portion (and/or second thermal effusivity) of the total mass (and/or total thermal effusivity) of the TEEM 728 of the layer 720 that is greater than the first total mass portion (and/or first thermal effusivity) thereof. In some embodiments, the second total mass portion (and/or second latent heat potential) of the total mass (and/or total latent heat potential) of the PCM 726 of the proximal fabric cover layer 720 may be greater than first portion (and/or first latent heat potential) thereof by at least 3%, by about 3% to about 100%, or by about 10% to about 50%. In some embodiments, the second total mass portion (and/or second thermal effusivity) or the total mass (and/or total thermal effusivity) of the TEEM 728 of the proximal fabric cover layer 720 may be greater than first portion (and/or first thermal effusivity) thereof by at least 3%, by about 3% to about 100%, or by about 10% to about 50%.

In some such embodiments, the proximal fabric cover layer 720 may further comprise a medial portion 734 of the thickness thereof positioned between the proximal and distal portions thereof in the depth direction D1, such as at or proximate to the middle of the thickness T1 of the layer 720, as shown in FIG. 16. The medial portion 732 may have a third total mass portion of the total mass of the PCM 726 of the proximal fabric cover layer 720, and a third total mass portion (and/or third latent heat potential) of the total mass (and/or total latent heat potential) of the TEEM 728 of the proximal fabric cover layer 720. The third total mass portion (and/or third latent heat potential) of the total mass (and/or total latent heat potential) of the PCM 726 of the proximal fabric cover layer 720 being greater than the first total mass portion (and/or first latent heat potential) and the less than the second mass portion (and/or second latent heat potential) of the total mass (and/or total latent heat potential) of the PCM 726 of the proximal fabric cover layer 720, and third total mass portion (and/or third thermal effusivity) of the total mass (and/or total thermal effusivity) of the TEEM 728 of the proximal fabric cover layer 720 being greater than the first total mass portion (and/or first thermal effusivity) and the less than the second mass portion (and/or second thermal effusivity) of the total mass (and/or total thermal effusivity) of the TEEM 728 of the proximal fabric cover layer 720. In some embodiments, the third total mass portion (and/or latent heat potential) of the total mass (and/or total latent heat potential) of the PCM 726 may be greater than first total mass portion (and/or first latent heat potential) thereof and less than the second total mass portion (and/or second latent heat potential) thereof by at least 3%, by about 3% to about 100%, or by about 10% to about 50%. In some embodiments, the third total mass portion (and/or third thermal effusivity) of the total mass (and/or total thermal effusivity) of the TEEM 728 may be greater than first portion (and/or first thermal effusivity) thereof and less than the second total mass (and/or second thermal effusivity) portion by at least 3%, by about 3% to about 100%, or by about 10% to about 50%. It is noted that the proximal fabric cover layer 720 may include any number of portions along the thickness/depth direction D1 with differing loadings of the PCM 726 and/or the TEEM 728 thereof that increase in the depth direction D1, such as just two of the proximal 730, medial 732 and distal portions 734, or at least one additional portion beyond the proximal 730, medial 732 and distal portions 734.

As shown in FIG. 16, the cooling cushion protector 700 further includes at least one moisture barrier layer 724 underlying (e.g., directly underlying) the scrim layer 722 in the depth direction D1. The moisture barrier layer 724 comprises a liquid and liquid vapor barrier layer (i.e., waterproofing layer or barrier) configured to prevent or resist liquid and/or liquid vapor (i.e., moisture) from passing through the moisture barrier layer 724 in the depth direction D1. For example, the moisture barrier layer 724 may be configured to prevent at least 99% vol. of water contacting the proximal surface thereof at atmospheric pressure for 12 hours from passing through the moisture barrier layer 724 in the depth direction D1.

The moisture barrier layer 724 may be formed of any material or combination of materials that prevents or resists moisture from passing therethrough in the depth direction D1. For example, in some embodiments the moisture barrier layer 724 may be formed of vinyl and/or polyurethane (e.g., a thermoplastic polyurethane), at least in part. The moisture barrier layer 724 may be substantially thin and flexible. For example, in some embodiments the moisture barrier layer 724 may define a thickness of less than about 3 mm, or less than about 2 mm, or less than about 1 mm, or less than about ½ mm, or less than about 1/10 mm. In one exemplary embodiment, the moisture barrier layer 724 define a thickness of about 25 microns.

The moisture barrier layer 724 may or may not include the PCM 726 and/or the TEEM 728. For example, in some embodiments, the moisture barrier layer 724 is void of the PCM 726, and/or is formed of the TEEM 728 (at least in part) or includes the TEEM 728 coupled or otherwise integrated therewith. In some other embodiments, a proximal side surface of the moisture barrier layer 724 includes a mass of the PCM 726 (a mass and/or total latent heat potential greater than that of the scrim layer 722) and is formed of the TEEM 728 (at least in part). The moisture barrier layer 724, the scrim layer 722 and the proximal fiber cover layer 720 may be coupled to each other, such as via an adhesive, stitching/quilting, thermal bonding or any other mechanism or mode.

Figure 17:
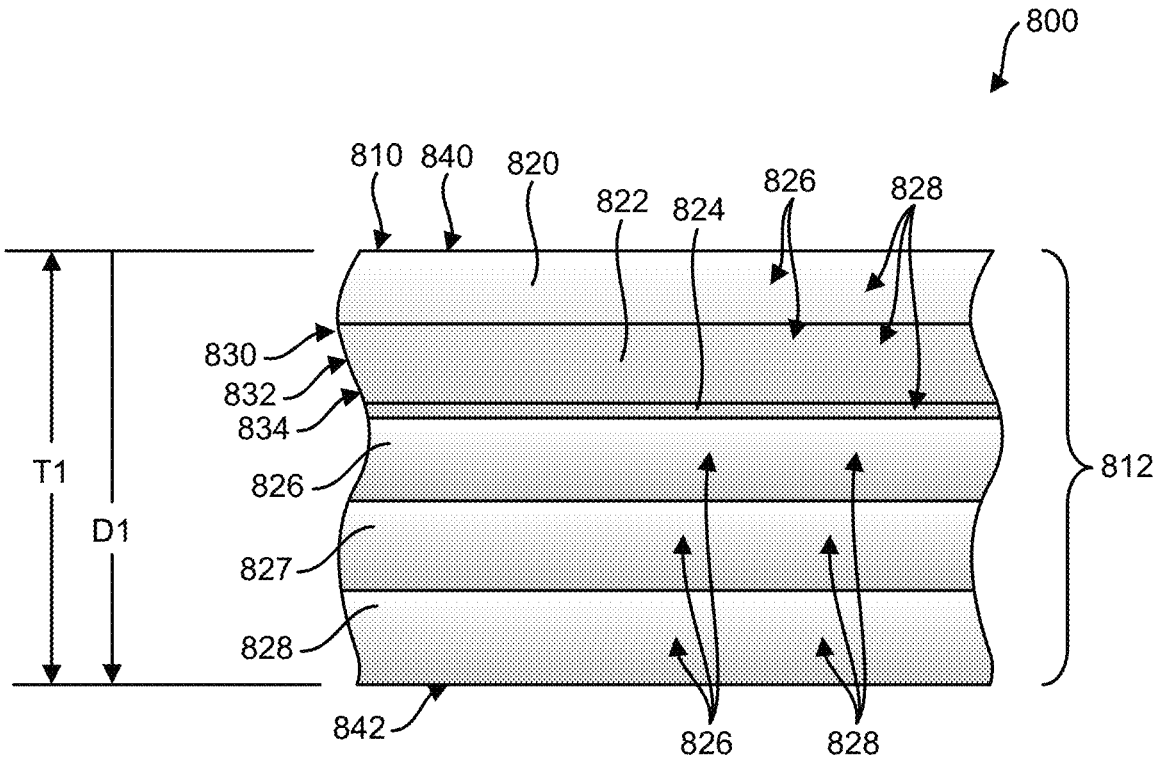
FIG. 17 illustrates a cross-sectional view of another exemplary cooling mattress protector according to the present disclosure.

FIG. 17 illustrates another cooling cushion protector 800 according to the present disclosure. The cooling cushion protector 800 incorporates a plurality of cooling layers 810 that include a plurality of consecutive separate and distinct cooling layers 812 that absorb or draw an unexpectedly large amount of heat away from a user for an unexpectedly long timeframe. The cooling cushion protector 800 may comprise and/or be similar to the cushion described above with respect to FIGS. 3-5, the cooling cartridge portion 110 of FIGS. 6-10, the cooling cartridge portion 210 of FIG. 11, the cooling cartridge portion 310 of FIG. 12, the cooling cartridge portion 410 of FIG. 13, the cooling pad or mat 500 of FIG. 14, the quilted cooling pad or mat 600 of FIG. 15, and the cooling cushion protector 700 of FIG. 16, and therefore the description contained herein directed thereto equally applies to the cooling cushion protector 800 but may not be repeated herein below for brevity sake. Like components and aspects of the cooling cushion protector 800 to the cushion of FIGS. 3-5, the cooling cartridge portion 110 of FIGS. 6-10, the cooling cartridge portion 210 of FIG. 11, the cooling cartridge portion 310 of FIG. 12, the cooling cartridge portion 410 of FIG. 13, the cooling pad or mat 500 of FIG. 14, the quilted cooling pad or mat 500 of FIG. 15 and/or the cooling cushion protector 700 of FIG. 16 are thereby indicated by like reference numerals preceded with "8."

As shown in FIG. 17, the cooling cushion protector 800 is substantially similar to the cooling cushion protector 700 of FIG. 16, but includes additional cooling layers underlying the moisture barrier layer 824 in the depth direction D1. As shown in FIG. 17, the cooling cushion protector 800 includes at least one second scrim layer 826 underlying (e.g., directly underlying) the moisture barrier layer 824 in the depth direction D1, at least one batting layer 827 underlying (e.g., directly underlying) the second scrim layer 826 in the depth direction D1, and at least one third scrim layer 828 underlying (e.g., directly underlying) the batting layer 827 in the depth direction D1. The second scrim layer 826, the batting layer 827 and the third scrim layer 828 may each comprise the PCM 826 and/or the TEEM 828, as shown in FIG. 17.

For example, in some embodiments, the total mass (or total latent heat potential) of the PCM 826 of the second scrim layer 826 is greater than the total mass (or total latent heat potential) of the PCM 826 of the moisture barrier layer 824 (if provided) and/or the scrim layer 824, such as by at least 3%, by about 3% to about 100%, or by about 10% to about 50%. Similarly, in some embodiments, the total mass (or total thermal effusivity) of the TEEM 828 of the second scrim layer 826 is greater than the total mass (or total thermal effusivity) of the TEEM 828 of the moisture barrier layer 824, such as by at least 3%, by about 3% to about 100%, or by about 10% to about 50%. In some embodiments, the total mass (or total latent heat potential) of the PCM 826 of the batting layer 827 is greater than the total mass (or total latent heat potential) of the PCM 826 of the second scrim layer 826, such as by at least 3%, by about 3% to about 100%, or by about 10% to about 50%. In some embodiments, the total mass (or total thermal effusivity) of the TEEM 828 of the batting layer 827 is greater than the total mass (or total thermal effusivity) of the TEEM 828 of the second scrim layer 826, such as by at least 3%, by about 3% to about 100%, or by about 10% to about 50%. In some embodiments, the total mass (or total latent heat potential) of the PCM 826 of the third scrim layer 828 is greater than the total mass (or total latent heat potential) of the PCM 826 of the batting layer 827, such as by at least 3%, by about 3% to about 100%, or by about 10% to about 50%. In some embodiments, the total mass (or total thermal effusivity) of the TEEM 828 of the third scrim layer 828 is greater than the total mass (or total thermal effusivity) of the TEEM 828 of the batting layer 827, such as by at least 3%, by about 3% to about 100%, or by about 10% to about 50%.

Further, as also shown in FIG. 17, at least one of the second scrim layer 826, the batting layer 827 and the third scrim layer 828 includes the intra-layer gradient distribution of the PCM 826 and/or the TEEM 828 thereof that increases in the depth direction D1. For example, in some embodiments, each of the second scrim layer 826, the batting layer 827 and the third scrim layer 828 may include an intra-layer gradient distribution of the PCM 826 and the TEEM 828 thereof that increases in the depth direction D1. For example, the second scrim layer 826, the batting layer 827 and/or the third scrim layer 828 may include at least a proximal portion of the thickness of the layer along the depth direction D1 having a first total mass portion (and/or first latent heat potential) of the total mass (and/or total latent heat potential) of the PCM 826 thereof and a first total mass portion (and/or first thermal effusivity) of the second total mass (and/or total thermal effusivity) of the TEEM 828 thereof, and a distal portion of the thickness of the layer along the depth direction D1 having a second total mass portion (and/or second latent heat potential) of the total mass (and/or total latent heat potential) of the PCM 826 of the layer that is greater than the first total mass portion (and/or first latent heat potential) thereof and a second total mass portion (and/or second thermal effusivity) of the total mass (and/or total thermal effusivity) of the TEEM 828 of the layer that is greater than the first total mass portion (and/or first thermal effusivity) thereof (such as by at least 3%, by about 3% to about 100%, or by about 10% to about 50%).

Figure 18:
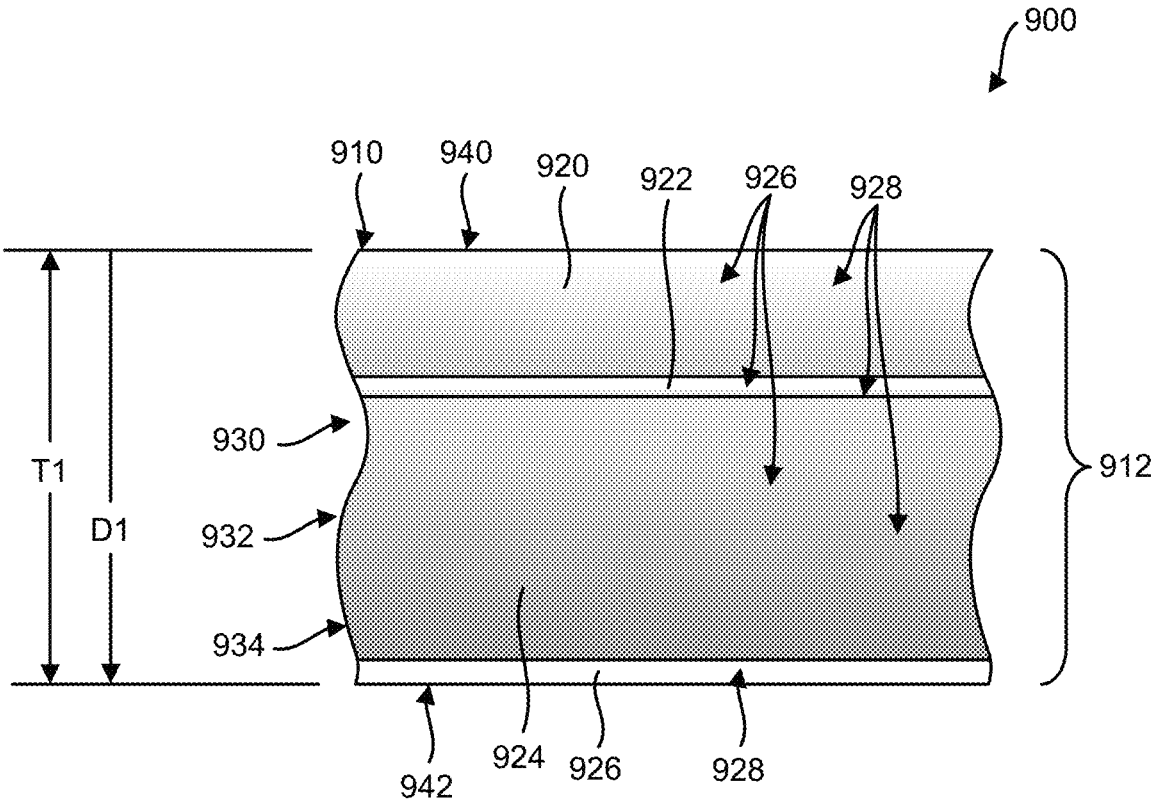
FIG. 18 illustrates a cross-sectional view of another exemplary cooling mattress protector according to the present disclosure.

FIG. 18 illustrates another cooling cushion protector 900 according to the present disclosure. The cooling cushion protector 900 incorporates a plurality of cooling layers 910 that include a plurality of consecutive separate and distinct cooling layers 912 that absorb or draw an unexpectedly large amount of heat away from a user for an unexpectedly long timeframe. The cooling cushion protector 900 may comprise and/or be similar to the cushion described above with respect to FIGS. 3-5, the cooling cartridge portion 110 of FIGS. 6-10, the cooling cartridge portion 210 of FIG. 11, the cooling cartridge portion 310 of FIG. 12, the cooling cartridge portion 410 of FIG. 13, the cooling pad or mat 500 of FIG. 14, the quilted cooling pad or mat 600 of FIG. 15, the cooling cushion protector 700 of FIG. 16, and the cooling cushion protector 800 of FIG. 17, and therefore the description contained herein directed thereto equally applies to the cooling cushion protector 900 but may not be repeated herein below for brevity sake. Like components and aspects of the cooling cushion protector 800 to the cushion of FIGS. 3-5, the cooling cartridge portion 110 of FIGS. 6-10, the cooling cartridge portion 210 of FIG. 11, the cooling cartridge portion 310 of FIG. 12, the cooling cartridge portion 410 of FIG. 13, the cooling pad or mat 500 of FIG. 14, the quilted cooling pad or mat 500 of FIG. 15, the cooling cushion protector 700 of FIG. 16 and/or the cooling cushion protector 800 of FIG. 17 are thereby indicated by like reference numerals preceded with "9."

The cooling cushion protector 900 is substantially similar to the cooling cushion protector 700 of FIG. 16 and the cooling cushion protector 800 of FIG. 17. As shown in FIG. 18, cooling cushion protector 900 differs from the cooling cushion protector 700 and the cooling cushion protector 800 in that it includes at least first and second moisture barrier layers 922, 926. As shown in FIG. 18, cooling cushion protector 900 comprises at least one proximal fiber cover layer 920, at least the first moisture barrier layer 922 underlying (e.g., directly underlying) the proximal fiber cover layer 920 in the depth direction D1, at least one batting layer 924 underlying (e.g., directly underlying) the first moisture barrier layer 922 in the depth direction D1, and at least the second moisture barrier layer 926 underlying (e.g., directly underlying) the batting layer 924 in the depth direction D1.

As also shown in FIG. 18, the proximal fiber cover layer 920, the first moisture barrier layer 922, the batting layer 924 and the second moisture barrier layer 926 may each comprise the PCM 926 and/or the TEEM 928. For example, in some embodiments, the total mass (or total latent heat potential) of the PCM 926 of the first moisture barrier layer 922 is greater than the total mass (or total latent heat potential) of the PCM 926 of the proximal fiber cover layer 920, such as by at least 3%, by about 3% to about 100%, or by about 10% to about 50%. Similarly, in some embodiments, the total mass (or total thermal effusivity) of the TEEM 928 of the first moisture barrier layer 922 is greater than the total mass (or total thermal effusivity) of the TEEM 928 of the proximal fiber cover layer 920, such as by at least 3%, by about 3% to about 100%, or by about 10% to about 50%. In some embodiments, the total mass (or total latent heat potential) of the PCM 926 of the batting layer 924 is greater than the total mass (or total latent heat potential) of the PCM 926 of the second moisture barrier layer 926, such as by at least 3%, by about 3% to about 100%, or by about 10% to about 50%. In some embodiments, the total mass (or total thermal effusivity) of the TEEM 928 of the batting layer 924 is greater than the total mass (or total thermal effusivity) of the TEEM 928 of the second moisture barrier layer 926, such as by at least 3%, by about 3% to about 100%, or by about 10% to about 50%. In some embodiments, the total mass (or total latent heat potential) of the PCM 926 of the second moisture barrier layer 926 (if provided) is greater than the total mass (or total latent heat potential) of the PCM 926 of the batting layer 924, such as by at least 3%, by about 3% to about 100%, or by about 10% to about 50%. In some embodiments, the total mass (or total thermal effusivity) of the TEEM 928 of the second moisture barrier layer 926 is greater than the total mass (or total thermal effusivity) of the TEEM 928 of the batting layer 924, such as by at least 3%, by about 3% to about 100%, or by about 10% to about 50%.

Further, as also shown in FIG. 18, at least one of the proximal fiber cover layer 920 and the batting layer 924 includes the intra-layer gradient distribution of the PCM 926 and/or the TEEM 928 thereof that increases in the depth direction D1. For example, in some embodiments, each of the proximal fiber cover layer 920 and the batting layer 924 may include an intra-layer gradient distribution of the PCM 926 and the TEEM 928 thereof that increases in the depth direction D1. For example, the proximal fiber cover layer 920 and the batting layer 924 may include at least a proximal portion of the thickness of the layer along the depth direction D1 having a first total mass portion (and/or first latent heat potential) of the total mass (and/or total latent heat potential) of the PCM 926 thereof and a first total mass portion (and/or first thermal effusivity) of the total mass (and/or total thermal effusivity) of the TEEM 928 thereof, and a distal portion of the thickness of the layer along the depth direction D1 having a second total mass portion (and/or second latent heat potential) of the total mass (and/or total latent heat potential) of the PCM 926 of the layer that is greater than the first total mass portion (and/or first latent heat potential) thereof (such as by at least 3%, by about 3% to about 100%, or by about 10% to about 50%), and a second total mass portion (and/or second thermal effusivity) of the total mass (and/or total thermal effusivity) of the TEEM 928 of the layer that is greater than the first total mass portion (and/or first thermal effusivity) thereof (such as by at least 3%, by about 3% to about 100%, or by about 10% to about 50%).

In some embodiments, the underside or distal side surface of the first moisture barrier layer 922 may include a mass of the PCM 926 coupled thereto. As discussed above, the first moisture barrier layer 922 and/or the second moisture barrier layer 926 may be formed of the TEEM 828 (at least in part). The proximal fiber cover layer 920, the first moisture barrier layer 922, the batting layer 924 and the second moisture barrier layer 926 may be coupled to each other, such as via an adhesive, stitching/quilting, thermal bonding or any other mechanism or mode. It is noted that the PCM 926 of the batting layer 924 may be trapped between the first moisture barrier layer 922 and the second moisture barrier layer 926, and thereby prevented from dislodging or otherwise translating from the protector 900.

Figure 19:
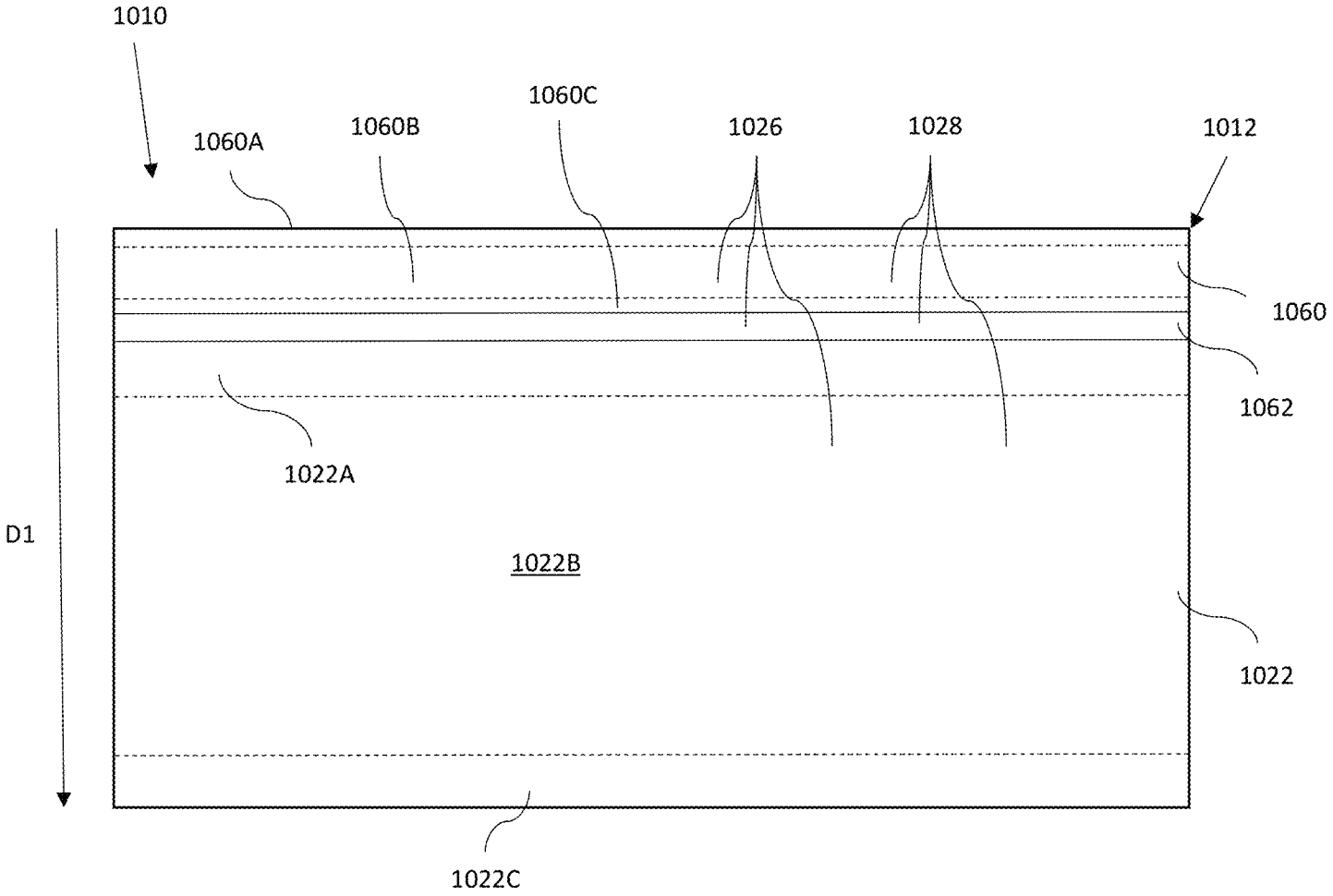
FIG. 19 illustrates a cross-sectional view of a plurality of consecutive layers of another exemplary cooling cushion according to the present disclosure.
Figure 20:
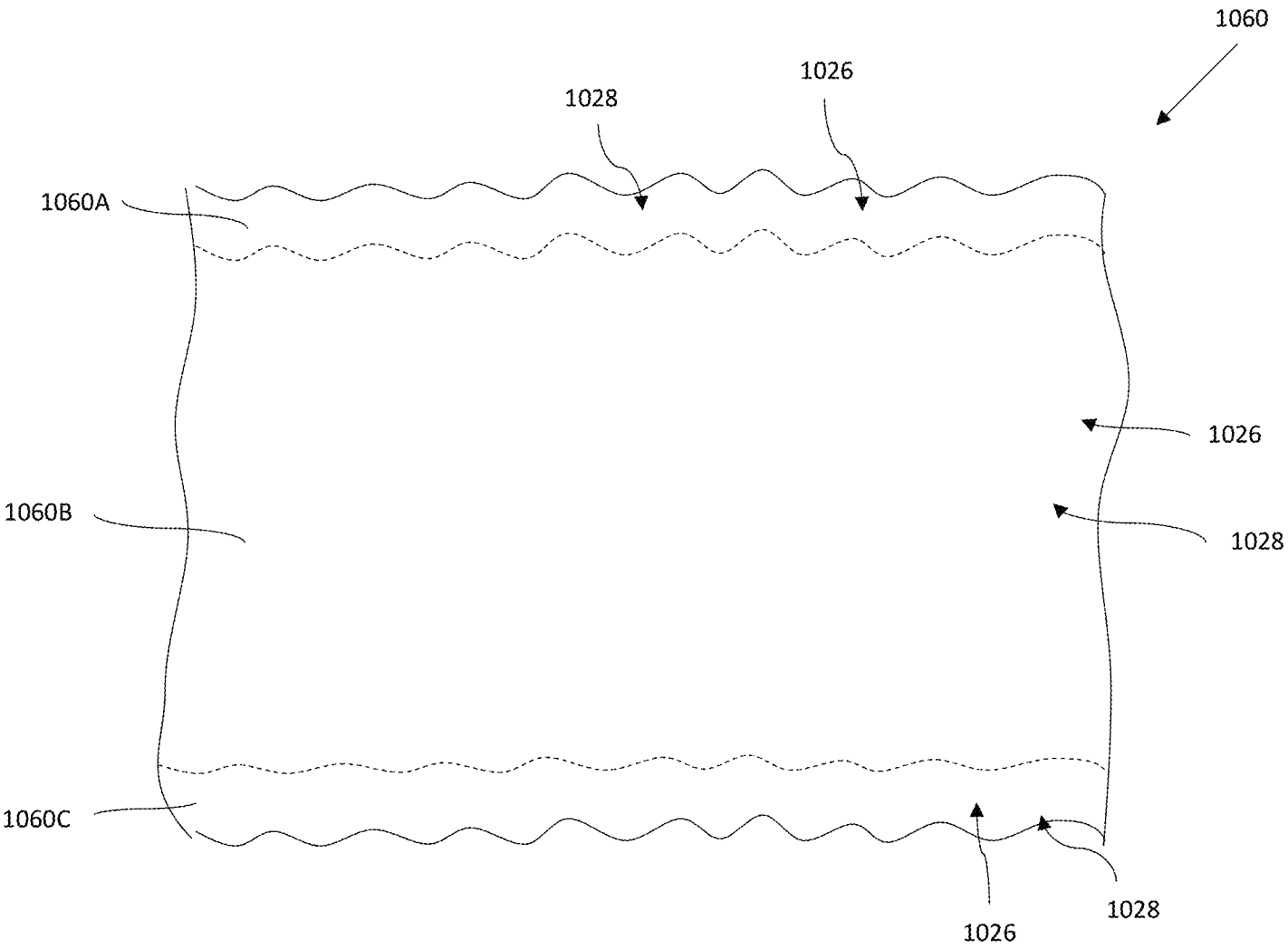
FIG. 20 illustrates a magnified cross-sectional view of a cover layer of the plurality of consecutive layers of FIG. 19 according to the present disclosure.
Figure 21:
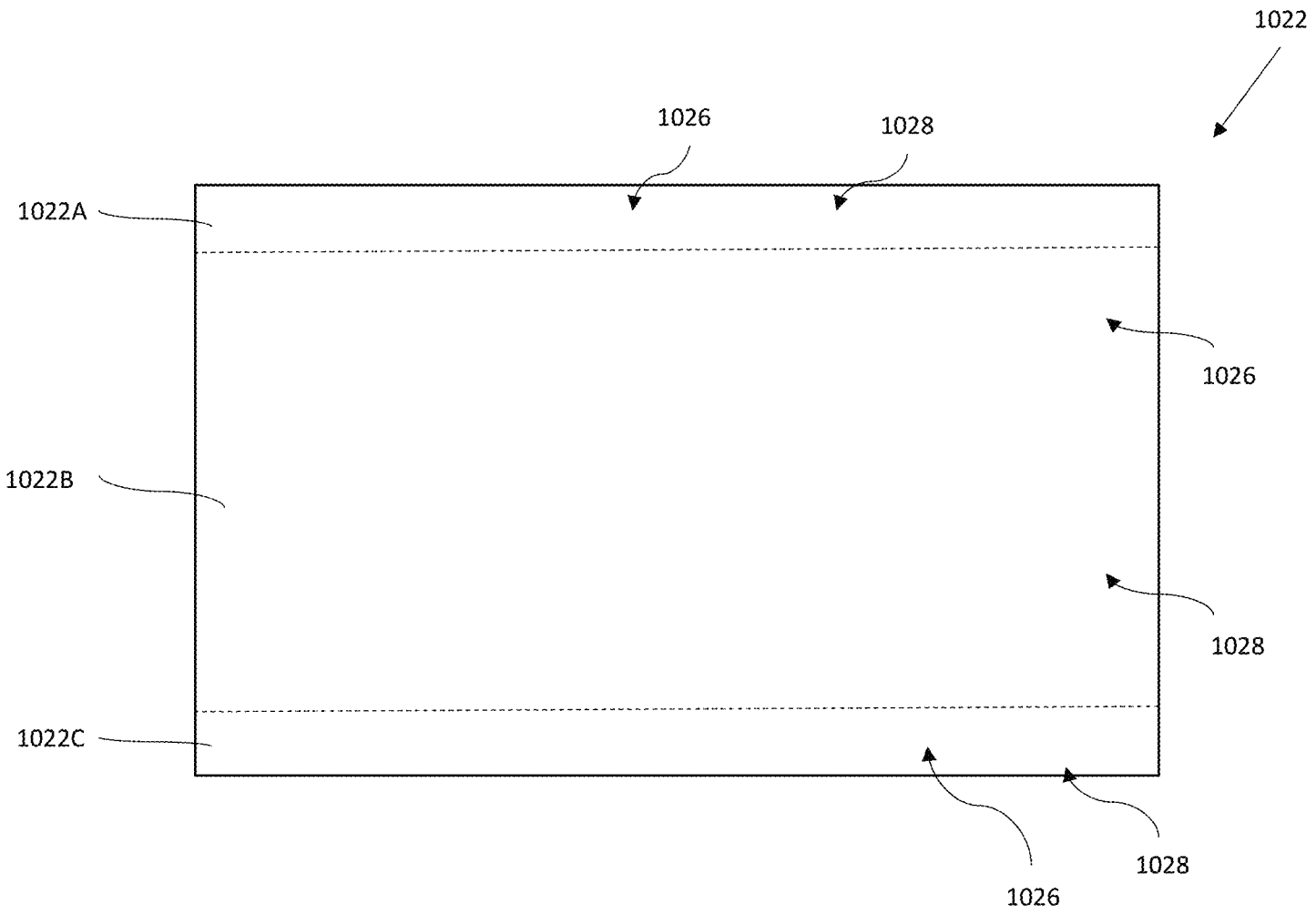
FIG. 21 illustrates a magnified cross-sectional view of a foam layer of the plurality of consecutive layers of FIG. 19 according to the present disclosure.

FIGS. 19-21 illustrates another embodiment of a plurality of consecutive layers 1010 of a cushion according to the present disclosure. The plurality of cooling layers 1010 include a plurality of consecutive separate and distinct cooling layers 1012 that absorb or draw an unexpectedly large amount of heat away from a user for an unexpectedly long timeframe. The plurality of cooling layers 1010 may comprise and/or be similar to the plurality of cooling layers described above with respect to FIGS. 3-5, the plurality of cooling layers of the cooling cartridge portion 110 of FIGS. 6-10, the plurality of cooling layers of the cooling cartridge portion 210 of FIG. 11, the plurality of cooling layers of the cooling cartridge portion 310 of FIG. 12, the plurality of cooling layers of the cooling cartridge portion 410 of FIG. 13, the plurality of cooling layers of the cooling pad or mat 500 of FIG. 14, the plurality of cooling layers of the quilted cooling pad or mat 600 of FIG. 15, the plurality of cooling layers of the cooling cushion protector 700 of FIG. 16, the plurality of cooling layers of the cooling cushion protector 800 of FIG. 17, and/or the plurality of cooling layers of the cooling cushion protector 900 of FIG. 18, and therefore the description contained herein directed thereto may equally apply to the plurality of cooling layers 1010 but may not be repeated herein below for brevity sake. Like components and aspects of the plurality of cooling layers of the cushion of FIGS. 3-5, the plurality of cooling layers of the cooling cartridge portion 110 of FIGS. 6-10, the plurality of cooling layers of the cooling cartridge portion 210 of FIG. 11, the plurality of cooling layers of the cooling cartridge portion 310 of FIG. 12, the plurality of cooling layers of the cooling cartridge portion 410 of FIG. 13, the plurality of cooling layers of the cooling pad or mat 500 of FIG. 14, the plurality of cooling layers of the quilted cooling pad or mat 500 of FIG. 15, the plurality of cooling layers of the cooling cushion protector 700 of FIG. 16, the plurality of cooling layers of the cooling cushion protector 800 of FIG. 17 and/or the plurality of cooling layers of the cooling cushion protector 900 of FIG. 18 are thereby indicated by like reference numerals preceded with "10."

The plurality of consecutive cooling layers 1012 may comprise or form part of a bedding product, such as a mattress, mattress insert or mattress topper, for example. As explained further below, the plurality of consecutive layers 1012 include an inter-layer gradient distribution of PCM 1026 and TEEM 1028 that increases in the depth direction as described above (i.e., the total mass of the PCM 1026 and TEEM 1028 of each layer of the consecutive layers 1012 increases from layer to layer in the depth direction). Further, each layer of the plurality of consecutive layers 1012 also includes an intra-layer gradient distribution of the PCM 1026 and TEEM 1028 thereof that increases in the depth direction D1 as described above (i.e., each layer includes a plurality of portions or bands thereof that include differing total masses of the PCM 1026 and TEEM 1028 that increases in the depth direction. Further, each layer of the plurality of consecutive layers 1012 may include some mass of the PCM 1026 and TEEM 1028 thereof throughout the entire thickness thereof along the depth direction D1.

As shown in FIGS. 19-21, the plurality of consecutive layers 1012 include an outer fabric cover layer 1060 a fire resistant (FR) sock/cap layer 1062 directly underlying the cover layer 1060, and a foam layer 1022 directly underlying the FR sock/cap layer 1062. As noted above, the cover layer 1060, the FR sock/cap layer 1062 and the foam layer 1022 each include microcapsule PCM 1026 and TEEM 1028.

The outer fabric cover layer 1060 may be the same as or similar to the cover layer 160, the cover layer 460, the cover layer 720 and/or the cover layer 920 described above. In some embodiments, the cover layer 1060 may extend about the FR sock/cap layer 1062 and/or the foam layer 1022. In some embodiments, at least the portion of the cover layer

1060 overlying the FR sock/cap layer 1062 may include a thickness within the range of about ¼ to about 1 inch along the depth direction D1, and/or include a weight within the range of about 400 to about 800 gsm (e.g., about 600 gsm). In some embodiments, at least the portion of the cover layer 1060 overlying the FR sock/cap layer 1062 may be formed of polyester fiber/yarn, e.g. 100% polyester. In some such embodiments, the cover layer 1060 may be formed of a blend of at least 75% polyester fiber/yarn and fiber/yarn formed of a differing material, such as elastic polyurethane e.g., Lycra®). In some embodiments, at least the portion of the cover layer 1060 overlying the FR sock/cap layer 1062 may comprise a double knit fabric. In some embodiments, at least the portion of the cover layer 1060 overlying the FR sock/cap layer 1062 may comprise fabric style MT101291-A from supplier Tricot Leisse. In some embodiments, at least the portion of the cover layer 1060 overlying the FR sock/cap layer 1062 may comprise fabric style MT101493-F from supplier Culp Inc.

As shown in FIGS. 19 and 20, the cover layer 1060 includes an intra-layer gradient distribution of the PCM 1026 (and/or the TEEM 1028) that increases in the depth direction D1 that includes an outer/upper band, portion or layer 1060A, a medial band, portion or later 1060B directly underlying the outer band 1060A in the depth direction D1, and an inner/bottom band, portion or layer 1060C directly underlying the medial band 1060B in the depth direction D1. The medial band 1060B includes a higher total mass of the PCM 1026 (and/or the TEEM 1028) than the outer band 1060A, and the inner band 1060C includes a higher total mass of the PCM 1026 (and/or the TEEM 1028) than the medial band 1060B. In some embodiments, the medial band 1060B may include at least 3% more total mass of the PCM 1026 (and/or the TEEM 1028) than the outer band 1060A, and the inner band 1060C may include at least 3% more total mass of the PCM 1026 (and/or the TEEM 1028) than the medial band 1060B. In some embodiments, the medial band 1060B may include at least 20% more total mass of the PCM 1026 (and/or the TEEM 1028) than the outer band 1060A, and the inner band 1060C may include at least 20% more total mass of the PCM 1026 (and/or the TEEM 1028) than the medial band 1060B. In some embodiments, the medial band 1060B may include at least 40% more total mass of the PCM 1026 (and/or the TEEM 1028) than the outer band 1060A, and the inner band 1060C may include at least 40% more total mass of the PCM 1026 (and/or the TEEM 1028) than the medial band 1060B. In some embodiments, the cover layer 1060 may include a total of the PCM 1026 within the range of about 5,000 to about 16,000 J/m2, or within the range of about 8,000 to about 13,000 J/m2, or within the range of about 9,000 to about 12,000 J/m2, about 11,500 J/m2, or about 10,500 J/m2.

The outer band 1060A may form the outer surface of the cover layer 1060, and may be formed on and extend over an outer surface of fabric of the cover layer 1060. Similarly, the inner band 1060A may form the inner surface of the cover layer 1060, and may be formed on and extend over an inner surface of the fabric of the cover layer 1060.

In some embodiments, the outer band 1060A and the medial band 1060B may be formed by spraying a coating comprising the PCM 1026 (and potentially the TEEM 1028) and a binding agent onto the outer surface of the fabric of the cover layer 1060. In some such embodiments, more mass of the sprayed coating (e.g., about ⅔ or 60%) may pass and/or absorb into the medial portion of the fabric to form the medial band 1060B, while a lesser mass of the sprayed coating (e.g., about ⅓ or 30%) may collect on the outer surface of the fabric to form the outer band 1060A. However, in some such embodiments the outer band 1060A and the medial band 1060B may be formed via a differing formation process than such a spraying process (either via the same process or via differing processes). In some embodiments, the inner band 1060C may be formed by roll coating a coating comprising the PCM 1026 (and potentially the TEEM 1028) and a binding agent onto the inner surface of the fabric of the cover layer 1060. However, in some such embodiments the outer band 1060A and the medial band 1060B may be formed via a differing formation process than such a roll coating process.

The FR sock/cap layer 1062 may the same as or similar to the fire resistant layer 162 or the fire resistant layer 462 as previously described. In some embodiments, the FR sock/cap layer 1062 may extend about the foam layer 1022. In some embodiments, at least the portion of the FR sock/cap layer 1062 underlying the cover layer 1060 and/or overlying the foam layer 1022 may include a thickness within the range of about 3 to about 6 mm along the depth direction D1, and/or include a weight within the range of about 250 to about 500 gsm (e.g., about 370 gsm). In some embodiments, at least the portion of the FR sock/cap layer 1062 underlying the cover layer 1060 and/or overlying the foam layer 1022 may be formed of a fabric and/or fiber/yarn that is treated with or others includes fire resistant material. In some such embodiments, the FR sock/cap layer 1062 may be formed of cotton fabric/fiber, e.g. 100% cotton, with fire resistant material integrated therein or coupled thereto. In some embodiments, the FR sock/cap layer 1062 may comprise an open width rib fire resistant sock. In some embodiments, at least the portion of the FR sock/cap layer 1062 may comprise FR resistant material product XT101226 from supplier XTinguish.

The FR sock/cap layer 1062 may include an intra-layer gradient distribution of the PCM 1026 (and/or the TEEM 1028) that increases in the depth direction D1 that includes an outer/upper band, portion or layer, a medial band, portion or later 1060 directly underlying the outer band in the depth direction D1, an inner/bottom band, portion or layer 1060C directly underlying the medial band 1060B in the depth direction D1, or a portion thereof. The medial band may include a higher total mass of the PCM 1026 (and/or the TEEM 1028) than the outer band, and the inner band may include a higher total mass of the PCM 1026 (and/or the TEEM 1028) than the medial band. In some embodiments, the FR sock/cap layer 1062 may include a total of the PCM 1026 within the range of about 7,000 to about 18,000 J/m2, or within the range of about 9,000 to about 15,000 J/m2, or within the range of about 10,000 to about 14,000 J/m2, or about 12,000 J/m2.

The foam layer 1022 may the same as or similar to the foam layer 122, the foam layer 222 and/or the foam layer 422 described above. In some embodiments, the foam layer 122 may comprise a single discrete layer of foam. In some other embodiments, the foam layer 122 may comprise a plurality of layers of foam.

In some embodiments, the foam layer 122 may include a thickness within the range of about ½ to about 5 inches (e.g., about 1½ inches) along the depth direction D1, and/or include a density within the range of about 2 to about 5 lb./ft^3 (e.g., about 3.6 lb./ft^3) (about 11 to about 12 lb. force). In some embodiments, the foam layer 122 may be formed from urethane foam. In some such embodiments, the foam layer 122 may be formed polyurethane viscoelastic foam.

As shown in FIGS. 19 and 21, the foam layer 1022 includes an intra-layer gradient distribution of the PCM 1026 (and/or the TEEM 1028) that increases in the depth direction D1 that includes an outer/upper band, portion or layer 1022A, a medial band, portion or later 1022B directly underlying the outer band 1022A in the depth direction D1, and an inner/bottom band, portion or layer 1022C directly underlying the medial band 1022B in the depth direction D1. The medial band 1060B includes a higher total mass of the PCM 1026 (and/or the TEEM 1028) than the outer band 1022A, and the inner band 1060C includes a higher total mass of the PCM 1026 (and/or the TEEM 1028) than the medial band 1022B. In some embodiments, the medial band 1022B may include at least 3% more total mass of the PCM 1026 (and/or the TEEM 1028) than the outer band 1022A, and the inner band 1022C may include at least 3% more total mass of the PCM 1026 (and/or the TEEM 1028) than the medial band 1022B. In some embodiments, the medial band 1022B may include at least 20% more total mass of the PCM 1026 (and/or the TEEM 1028) than the outer band 1022A, and the inner band 1022C may include at least 20% more total mass of the PCM 1026 (and/or the TEEM 1028) than the medial band 1022B. In some embodiments, the medial band 1022B may include at least 40% more total mass of the PCM 1026 (and/or the TEEM 1028) than the outer band 1022A, and the inner band 1022C may include at least 40% more total mass of the PCM 1026 (and/or the TEEM 1028) than the medial band 1022B. In some embodiments, the foam layer 1022 may include a total of the PCM 1026 within the range of about 50,000 to about 130,000 J/m2, or within the range of about 70,000 to about 120,000 J/m2, or within the range of about 80,000 to about 110,000 J/m2, or about 90,700 J/m2. According to one specific embodiment, the foam layer 1022 may include a total of the PCM 1026 of about 67,000 J/m2. In some embodiments, the foam layer 1022 may include one of the following product numbers from supplier Latexco: 5802312-0010, 5802312-0020, 5802312-0030, 5802312-0050, 5802312-0060, 5802312-0070.

The outer band 1022A may form the outer surface of the foam layer 1022, and may be formed on and extend over an outer surface of the foam material of the foam layer 1022. Similarly, the inner band 1022A may form the inner surface of the foam layer 1022, and may be formed on and extend over an inner surface of the foam material of the foam layer 1022.

In some embodiments, the medial band 1022B may be formed by infusing the PCM 1026 (and potentially the TEEM 1028) into an uncured foam composition material before it is cured or dried to from the foam material. In other embodiments, the medial band 1022B may be formed by passing the PCM 1026 (and potentially the TEEM 1028) into/onto the medial portion of the foam material after it is formed. In some embodiments, the outer band 1022A and/or the inner band 1022C may be formed by roll coating a coating comprising the PCM 1026 (and potentially the TEEM 1028) and a binding agent onto the outer and/or inner surfaces, respectively, of the foam material of the foam layer 1022. However, in some such embodiments the outer band 1022A and the inner band 1022C may be formed via a differing formation process than such a roll coating process.

According to various embodiments the total amount of PCM 1026 for the total/entire system of the plurality of consecutive layers 1012 may be within the range of about 150,000 to about 210,000 J/m2, or within the range of about 167,000 to about 203,038 J/m2.

Heat absorption tests conducted on the cover layer 1060 when incorporated into the plurality of consecutive layers 1012 provided unexpected results. In particular, the specific heat flux between 15 minutes and 120 minutes dropped from within the range of about 49.33 $W/m^2$ to about 61.38 $W/m^2$ at 15 minutes to within the range of about 14.97 $Wm^2$ to about 19.18 $W/m^2$ at 120 minutes. Under these testing conditions, the corresponding heat absorption during that time increased from within the range of about 91,862 $J/m^2$ to about 102,913 $J/m^2$ at 15 minutes to within the range of about 232,951 $J/m^2$ to about 275,387 $J/m^2$ at 120 minutes. The magnitude of these results were unexpected and surprising, given that the cooling capabilities of the cover lay 1060 when incorporated into the plurality of consecutive layers 1012 vastly improved upon any known mattress, pad or mat, or mattress protector cooling systems that would be known to a person having ordinary skill in the art.

Mattress fire tests conducted on the plurality of consecutive layers 1012 provided unexpected results. In particular, when the plurality of consecutive layers 1012 included an FR sock/cap layer 1062 having a total of the PCM 1026, at the heat conductivity levels disclosed herein, between 12,400 J/m2 and 15,100 J/m2 had a horizontal burn rate of between 1.4-1.7 in/min and all tests self-extinguished. This result was unexpected and surprising given that that materials used in the PCM 1026 are often considered highly flammable, as would be known to a person having ordinary skill in the art. Further, the range of thermal effusivity detected during the fire tests detected a range of 166-188 $Ws^{0.5}/(m^2K)$, with an average thermal effusivity detected being approximately 175 $Ws^{0.5}/(m^2K)$ or 176 $Ws^{0.5}/(m^2K)$.

EXAMPLES

Certain embodiments are illustrated by the following non-limiting examples.

Example A. A mattress including a plurality of separate and distinct consecutive cooling layers overlying over each other in a depth direction that extends from a proximal portion of the mattress that is proximate to a user to a distal portion of the mattress that is distal to the user, wherein each layer of the cooling layers includes thermal effusivity enhancing material (TEEM) with a thermal effusivity greater than or equal to 2,500 $Ws^{0.5}/(m^2K)$ and a solid-to-liquid phase change material (PCM) with a phase change temperature within the range of about 6 to about 45 degrees Celsius, wherein the total thermal effusivity of each of the cooling layers increases with respect to each other in the depth direction, wherein the total mass of the PCM of each of the cooling layers increases with respect to each other along the depth direction, and wherein at least one layer of the cooling layers includes a gradient distribution of the mass of the PCM and the amount of the TEEM thereof that increases in the depth direction.

Example B. The mattress of Example A, wherein a plurality of the cooling layers include the gradient distribution of the mass of the PCM thereof.

Example C. The mattress of Example A, wherein each of the cooling layers includes the gradient distribution of the mass of the PCM thereof.

Example D. The mattress according to any of Examples A-C, wherein a plurality of the cooling layers include the gradient distribution of the mass of the TEEM thereof.

Example E. The mattress according to any of Examples A-C, wherein each of the cooling layers includes the gradient distribution of the mass of the TEEM thereof.

Example F. The mattress according to any of the preceding Examples A-E, wherein the at least one layer of the cooling layers that includes the gradient distribution of the mass of the PCM and the amount of the TEEM thereof that increases in the depth direction comprises: a proximal portion proximate to the proximal portion of the mattress having a first total mass of the PCM and a first total mass of the TEEM of the layer; and a distal portion proximate to the distal portion of the mattress having a second total mass of the PCM and a second total mass of the TEEM of the layer, the second total mass of the PCM being greater than the first total mass of the PCM, and the second total mass of the TEEM being greater than the first total mass of the TEEM.

Example G. The mattress according to Example F, wherein the second total mass of the PCM is at least 3% greater than the first total mass of the PCM, and the second total mass of the TEEM is at least 3% greater than the first total mass of the TEEM.

Example H. The mattress according to Example F, wherein the second total mass of the PCM is at least 20% greater than the first total mass of the PCM, and the second total mass of the TEEM is at least 10% greater than the first total mass of the TEEM.

Example I. The mattress according to Example F, wherein the second total mass of the PCM is at least 40% greater than the first total mass of the PCM, and the second total mass of the TEEM is at least 20% greater than the first total mass of the TEEM.

Example J. The mattress according to any of Examples F-I, wherein the at least one layer of the cooling layers that includes the gradient distribution of the mass of the PCM and the amount of the TEEM thereof that increases in the depth direction further includes: a medial portion positioned between the proximal and distal portions of the layer in the depth direction having a third total mass of the PCM and a third total mass of the TEEM of the layer, the third total mass of the PCM being greater than the first total mass of the PCM and less than the second total mass of the PCM, and the third total mass of the TEEM being greater than the first total mass of the TEEM and less than the second total mass of the TEEM.

Example K. The mattress according to Example J, wherein the third total mass of the PCM is at least 3% greater than the first total mass of the PCM and at least 3% less than the second total mass of the PCM, and the third total mass of the TEEM is at least 3% greater than the first total mass of the TEEM and at least 3% less than the second total mass of the TEEM.

Example L. The mattress according to Example J, wherein the third total mass of the PCM is at least greater than the first total mass of the PCM and less than the second total mass of the PCM by at least 20% thereof, and the third total mass of the TEEM is greater than the first total mass of the TEEM and less than the second total mass of the TEEM by at least 10% thereof.

Example M. The mattress according to Example J, wherein the third total mass of the PCM is at least greater than the first total mass of the PCM and less than the second total mass of the PCM by at least 40% thereof, and the third total mass of the TEEM is greater than the first total mass of the TEEM and less than the second total mass of the TEEM by at least 20% thereof.

Example N. The mattress according to any of the preceding Examples, A-M, wherein the gradient distribution of the mass of the PCM and the amount of the TEEM of at least one layer of the cooling layers comprises an irregular gradient distribution of the mass of the PCM and the amount of the TEEM along the depth direction.

Example O. The mattress according to any of the preceding Examples, A-N, wherein the gradient distribution of the mass of the PCM and the amount of the TEEM of at least one layer of the cooling layers comprises a consistent gradient distribution of the mass of the PCM and the amount of the TEEM along the depth direction.

Example P. The mattress according to any of the preceding Examples, A-O, wherein the total mass of the PCM of each of the cooling layers increases with respect to each other along the depth direction by at least 3%.

Example Q. The mattress according to any of the preceding Examples, A-P, wherein the total mass of the PCM of each of the cooling layers increases with respect to each other along the depth direction by an amount within the range of about 3% to about 100%.

Example R. The mattress according to any of the preceding Examples, A-Q, wherein the total mass of the PCM of each of the cooling layers increases with respect to each other along the depth direction by an amount within the range of about 10% to about 50%.

Example S. The mattress according to any of the preceding Examples, A-R, wherein the total thermal effusivity of each of the cooling layers increases with respect to each other in the depth direction by about at least about 3%.

Example T. The mattress according to any of the preceding Examples, A-S, wherein the total thermal effusivity of each of the cooling layers increases with respect to each other in the depth direction by an amount within the range of about 3% to about 100%.

Example U. The mattress according to any of the preceding Examples, A-T, wherein the total thermal effusivity of each of the cooling layers increases with respect to each other in the depth direction by an amount within the range of about 10% to about 50%.

Example V. The mattress according to any of the preceding Examples, A-U, wherein the TEEM comprises a thermal effusivity greater than or equal to 5,000 $Ws^{0.5}/(m^2K)$.

Example W. The mattress according to any of the preceding Examples, A-V, wherein the TEEM comprises a thermal effusivity greater than or equal to 7,500 $Ws^{0.5}/(m^2K)$.

Example X. The mattress according to any of the preceding Examples, A-W, wherein the TEEM comprises a thermal effusivity greater than or equal to 15,000 $Ws^{0.5}/(m^2K)$.

Example Y. The mattress according to any of the preceding Examples, A-X, wherein each of the plurality of plurality of consecutive layers is formed of a respective base material having a thermal effusivity, and wherein the thermal effusivity of the TEEM is at least 100% greater than the thermal effusivity of the respective base material.

Example Z. The mattress according to any of the preceding Examples, A-Y, wherein each of the plurality of plurality of consecutive layers is formed of a respective base material having a first thermal effusivity, and wherein the thermal effusivity of the TEEM is at least 1,000% greater than the first thermal effusivity.

Example AA. The mattress according to any of the preceding Examples, A-Z, wherein the TEEM comprises pieces of one or more minerals.

Example BB. The mattress according to any of the preceding Examples, A-AA, wherein the cooling layers each include a coating that couples the PCM and the TEEM to a base material thereof.

Example CC. The mattress according to Example BB, wherein the PCM comprises about 50% to about 80% of the mass of the coating and the TEEM comprises about 5% to about 8% of the mass of the coating.

Example DD. The mattress according to any of the preceding Examples, A-CC, wherein a furthest proximal layer of the cooling layers comprises at least 3,000 J/m$^2$ of the PCM.

Example EE. The mattress according to any of the preceding Examples, A-DD, wherein a furthest proximal layer of the cooling layers comprises at least 5,000 J/m$^2$ of the PCM.

Example FF. The mattress according to any of the preceding Examples, A-EE, wherein the cooling layers are configured to absorb at least 24 W/m2/hr. from a portion of a user that is physically supported by the mattress.

Example GG. The mattress according to any of the preceding Examples, A-FF, wherein the PCM comprises at least one of a hydrocarbon, wax, beeswax, oil, fatty acid, fatty acid ester, stearic anhydride, long-chain alcohol or a combination thereof.

Example HH. The mattress according to any of the preceding Examples, A-GG, wherein the PCM comprises paraffin.

Example II. The mattress according to any of the preceding Examples, A-HH, wherein the PCM comprises microsphere PCM.

Example JJ. The mattress according to any of the preceding Examples, A-II, wherein the cooling layers are fixedly coupled to each other.

Example KK. The mattress according to any of the preceding Examples, A-JJ, wherein the cooling layers form a mattress cartridge or insert.

Example LL. The mattress according to any of the preceding Examples, A-KK, wherein the cooling layers comprise an outer fabric cover layer, a fire resistant sock layer directly underlying the cover layer in the depth direction, and a foam layer directly underlying the fire resistant sock layer in the depth direction.

Example MM. The mattress according to Example LL, wherein the foam layer comprises a single viscoelastic polyurethane foam layer.

Example NN. The mattress according to Example LL or Example MM, wherein the cover layer defines a proximal side surface of the mattress.

Example OO. The mattress according to Examples LL-NN, wherein the fire resistant sock layer comprises a fire resistant or fireproof material.

Example PP. The mattress according to Examples LL-OO, wherein the fire resistant sock layer is formed of the TEEM.

Example QQ. The mattress according to any of Examples LL-PP, wherein the cover layer includes the gradient distribution of the mass of the PCM and the amount of the TEEM thereof that increases in the depth direction, and comprises: a first proximal portion proximate to the proximal portion of the mattress having a first total mass of the PCM and a first total mass of the TEEM of the layer; a first distal portion proximate to the distal portion of the mattress having a second total mass of the PCM and a second total mass of the TEEM of the layer, the second total mass of the PCM being greater than the first total mass of the PCM, and the second total mass of the TEEM being greater than the first total mass of the TEEM; and a first medial portion positioned between the first proximal and first distal portions of the layer in the depth direction having a third total mass of the PCM and a third total mass of the TEEM of the layer, the third total mass of the PCM being greater than the first total mass of the PCM and less than the second total mass of the PCM, and the third total mass of the TEEM being greater than the first total mass of the TEEM and less than the second total mass of the TEEM.

Example RR. The mattress according to any of Examples LL-QQ, wherein the foam layer includes the gradient distribution of the mass of the PCM and the amount of the TEEM thereof that increases in the depth direction, and comprises: a second proximal portion proximate to the proximal portion of the mattress having a fourth total mass of the PCM and a fourth total mass of the TEEM of the layer; a second distal portion proximate to the distal portion of the mattress having a fifth total mass of the PCM and a fifth total mass of the TEEM of the layer, the fifth total mass of the PCM being greater than the fourth total mass of the PCM, and the fifth total mass of the TEEM being greater than the fourth total mass of the TEEM; and a second medial portion positioned between the second proximal and second distal portions of the layer in the depth direction having a sixth total mass of the PCM and a sixth total mass of the TEEM of the layer, the sixth total mass of the PCM being greater than the fourth total mass of the PCM and less than the fifth total mass of the PCM, and the sixth total mass of the TEEM being greater than the fourth total mass of the TEEM and less than the fifth total mass of the TEEM.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), "contain" (and any form contain, such as "contains" and "containing"), and any other grammatical variant thereof, are open-ended linking verbs. As a result, a method or article that "comprises", "has", "includes" or "contains" one or more steps or elements possesses those one or more steps or elements, but is not limited to possessing only those one or more steps or elements. Likewise, a step of a method or an element of an article that "comprises", "has", "includes" or "contains" one or more features possesses those one or more features, but is not limited to possessing only those one or more features.

As used herein, the terms "comprising," "has," "including," "containing," and other grammatical variants thereof encompass the terms "consisting of" and "consisting essentially of."

The phrase "consisting essentially of" or grammatical variants thereof when used herein are to be taken as specifying the stated features, integers, steps or components but do not preclude the addition of one or more additional features, integers, steps, components or groups thereof but only if the additional features, integers, steps, components or groups thereof do not materially alter the basic and novel characteristics of the claimed compositions or methods.

All publications cited in this specification are herein incorporated by reference as if each individual publication were specifically and individually indicated to be incorporated by reference herein as though fully set forth.

Subject matter incorporated by reference is not considered to be an alternative to any claim limitations, unless otherwise explicitly indicated.

Where one or more ranges are referred to throughout this specification, each range is intended to be a shorthand format for presenting information, where the range is understood to encompass each discrete point within the range as if the same were fully set forth herein.

While several aspects and embodiments of the present invention have been described and depicted herein, alternative aspects and embodiments may be affected by those skilled in the art to accomplish the same objectives. Accordingly, this disclosure and the appended claims are intended to cover all such further and alternative aspects and embodiments as fall within the true spirit and scope of the invention.

The invention claimed is:

1. A mattress, comprising:

a plurality of separate and distinct consecutive cooling layers overlying over each other in a depth direction that extends from a proximal portion of the mattress that is proximate to a user to a distal portion of the mattress that is distal to the user;

wherein each layer of the plurality of separate and distinct consecutive cooling layers includes (i) thermal effusivity enhancing material (TEEM) with a thermal effusivity greater than or equal to 2,500 $Ws^{0.5}/(m^2K)$ and (ii) a solid-to-liquid phase change material (PCM) with a phase change temperature within the range of about 6 to about 45 degrees Celsius;

wherein total thermal effusivity of each layer of the plurality of separate and distinct consecutive cooling layers increases with respect to each other in the depth direction;

wherein total mass of the PCM of each layer of the plurality of separate and distinct consecutive cooling layers increases with respect to each other along the depth direction; and wherein at least one layer of the plurality of separate and distinct consecutive cooling layers includes a gradient distribution of both: (a) mass of the PCM thereof and (b) an amount of the TEEM thereof, wherein the gradient distribution increases in the depth direction.

2. The mattress of claim 1, wherein multiple cooling layers of the plurality of cooling layers include the gradient distribution of the mass of the PCM thereof.

3. The mattress of claim 1, wherein each layer of the plurality of cooling layers includes the gradient distribution of the mass of the PCM thereof.

4. The mattress of claim 1, wherein multiple cooling layers of the plurality of cooling layers include the gradient distribution of the mass of the TEEM thereof.

5. The mattress of claim 1, wherein each layer of the plurality of cooling layers includes the gradient distribution of the mass of the TEEM thereof.

6. The mattress of claim 1, wherein the at least one layer of the cooling layers that includes the gradient distribution of the mass of the PCM and the amount of the TEEM thereof that increases in the depth direction comprises:

a proximal segment that is proximate to the proximal portion of the mattress, the proximal segment having a first total mass of the PCM and a first total mass of the TEEM of the at least one layer; and a distal segment that is proximate to the distal portion of the mattress, the distal segment having a second total mass of the PCM and a second total mass of the TEEM of the at least one layer, the second total mass of the PCM being greater than the first total mass of the PCM, and the second total mass of the TEEM being greater than the first total mass of the TEEM.

7. The mattress according to claim 6, wherein the second total mass of the PCM is at least 3% greater than the first total mass of the PCM, and the second total mass of the TEEM is at least 3% greater than the first total mass of the TEEM.

8. The mattress according to claim 6, wherein the second total mass of the PCM is at least 20% greater than the first total mass of the PCM, and the second total mass of the TEEM is at least 10% greater than the first total mass of the TEEM.

9. The mattress according to claim 6, wherein the second total mass of the PCM is at least 40% greater than the first total mass of the PCM, and the second total mass of the TEEM is at least 20% greater than the first total mass of the TEEM.

10. The mattress of claim 6, wherein the at least one layer of the cooling layers that includes the gradient distribution of both (a) the mass of the PCM thereof and (b) the amount of the TEEM thereof, wherein the gradient distribution increases in the depth direction, further comprises:

a medial segment that is positioned between the proximal segment and distal segment of the at least one layer of the cooling layers, the medial segment having a third total mass of the PCM of the at least one layer and a third total mass of the TEEM of the at least one layer, the third total mass of the PCM being greater than the first total mass of the PCM and less than the second total mass of the PCM, and the third total mass of the TEEM being greater than the first total mass of the TEEM and less than the second total mass of the TEEM.

11. The mattress according to claim 10, wherein the third total mass of the PCM is at least 3% greater than the first total mass of the PCM and at least 3% less than the second total mass of the PCM, and the third total mass of the TEEM is at least 3% greater than the first total mass of the TEEM and at least 3% less than the second total mass of the TEEM.

12. The mattress according to claim 10, wherein the third total mass of the PCM is at least greater than the first total mass of the PCM and less than the second total mass of the PCM by at least 20% thereof, and the third total mass of the TEEM is greater than the first total mass of the TEEM and less than the second total mass of the TEEM by at least 10% thereof.

13. The mattress according to claim 10, wherein the third total mass of the PCM is at least greater than the first total mass of the PCM and less than the second total mass of the PCM by at least 40% thereof, and the third total mass of the TEEM is greater than the first total mass of the TEEM and less than the second total mass of the TEEM by at least 20% thereof.

14. The mattress of claim 1, wherein the gradient distribution of the mass of the PCM and the amount of the TEEM of the at least one layer of the cooling layers comprises an irregular gradient distribution of the mass of the PCM and the amount of the TEEM along the depth direction.

15. The mattress of claim 1, wherein the gradient distribution of the mass of the PCM and the amount of the TEEM of at least one layer of the cooling layers comprises a consistent gradient distribution of the mass of the PCM and the amount of the TEEM along the depth direction.

16. The mattress of claim 1, wherein the total mass of the PCM of each of the cooling layers increases with respect to each other along the depth direction by at least 3%.

17. The mattress of claim 1, wherein the total mass of the PCM of each of the cooling layers increases with respect to each other along the depth direction by an amount within the range of about 3% to about 100%.

18. The mattress of claim 1, wherein the total mass of the PCM of each layer of the plurality of cooling layers increases with respect to each other along the depth direction by an amount within the range of about 10% to about 50%.

19. The mattress of claim 1, wherein the total thermal effusivity of each layer of the plurality of cooling layers increases with respect to each other in the depth direction by about at least about 3%.

20. The mattress of claim 1, wherein the total thermal effusivity of each layer of the plurality cooling layers increases with respect to each other in the depth direction by an amount within the range of about 3% to about 100%.

21. The mattress of claim 1, wherein the total thermal effusivity of each layer of the plurality of cooling layers increases with respect to each other in the depth direction by an amount within the range of about 10% to about 50%.

22. The mattress of claim 1, wherein the TEEM comprises a thermal effusivity greater than or equal to 5,000 $Ws^{0.5}/(m^2K)$.

23. The mattress of claim 1, wherein the TEEM comprises a thermal effusivity greater than or equal to 7,500 $Ws^{0.5}/(m^2K)$.

24. The mattress of claim 1, wherein the TEEM comprises a thermal effusivity greater than or equal to 15,000 $Ws^{0.5}/(m^2K)$.

25. The mattress of claim 1, wherein each layer of the plurality of separate and distinct consecutive cooling layers is formed of a respective base material that has a respective thermal effusivity, and wherein the thermal effusivity of the TEEM is at least 100% greater than the respective thermal effusivity of the respective base material.

26. The mattress of claim 1, wherein each layer of the plurality of separate and distinct consecutive cooling layers is formed of a respective base material having a first thermal effusivity, and wherein the thermal effusivity of the TEEM is at least 1,000% greater than the first thermal effusivity.

27. The mattress of claim 1, wherein the TEEM comprises pieces of one or more minerals.

28. The mattress of claim 1, wherein each layer of the plurality of cooling layers includes a coating that couples the PCM and the TEEM to a base material thereof.

29. The mattress according to claim 28, wherein the PCM comprises about 50% to about 80% of the mass of the coating and the TEEM comprises about 5% to about 8% of the mass of the coating.

30. The mattress of claim 1, wherein a furthest proximal layer of the plurality of cooling layers comprises at least 3,000 J/m2 of the PCM.

31. The mattress of claim 1, wherein a furthest proximal layer of the plurality of cooling layers comprises at least 5,000 J/m2 of the PCM.

32. The mattress of claim 1, wherein the plurality of cooling layers are configured to absorb at least 24 W/m2/hr. from a portion of a user that is physically supported by the mattress.

33. The mattress of claim 1, wherein the PCM comprises at least one of a hydrocarbon, wax, beeswax, oil, fatty acid, fatty acid ester, stearic anhydride, long-chain alcohol or a combination thereof.

34. The mattress of claim 1, wherein the PCM comprises paraffin.

35. The mattress of claim 1, wherein the PCM comprises microsphere PCM.

36. The mattress of claim 1, wherein the plurality of cooling layers are fixedly coupled to each other.

37. The mattress of claim 1, wherein the plurality of cooling layers form a mattress cartridge or insert.

38. The mattress of claim 1, wherein the plurality of cooling layers comprise an outer fabric cover layer, a fire resistant sock layer directly underlying the cover layer in the depth direction, and a foam layer directly underlying the fire resistant sock layer in the depth direction.

39. The mattress of claim 38, wherein the foam layer comprises a single viscoelastic polyurethane foam layer.

40. The mattress of claim 38, wherein the cover layer defines a proximal side surface of the mattress.

41. The mattress of claim 38, wherein the fire resistant sock layer comprises a fire resistant or fire proof material.

42. The mattress of claim 38, wherein the fire resistant sock layer is formed of the TEEM.

43. The mattress of claim 38, wherein the cover layer includes the gradient distribution of both: (a) the mass of the PCM thereof and (b) the amount of the TEEM thereof, wherein the gradient distribution increases in the depth direction, and the cover layer comprises:

a first proximal portion proximate to the proximal portion of the mattress having a first total mass of the PCM and a first total mass of the TEEM of the cover layer;

a first distal portion proximate to the distal portion of the mattress having a second total mass of the PCM and a second total mass of the TEEM of the cover layer, the second total mass of the PCM being greater than the first total mass of the PCM, and the second total mass of the TEEM being greater than the first total mass of the TEEM; and a first medial portion positioned between the first proximal and first distal portions of the cover layer in the depth direction, the first medial portion having a third total mass of the PCM and a third total mass of the TEEM of the layer, the third total mass of the PCM being greater than the first total mass of the PCM and less than the second total mass of the PCM, and the third total mass of the TEEM being greater than the first total mass of the TEEM and less than the second total mass of the TEEM.

44. The mattress of claim 38, wherein the foam layer includes the gradient distribution of both: (a) the mass of the PCM thereof and (b) the amount of the TEEM thereof, wherein the gradient distribution increases in the depth direction, and the foam layer comprises:

a second proximal portion proximate to the proximal portion of the mattress having a fourth total mass of the PCM and a fourth total mass of the TEEM of the foam layer;

a second distal portion proximate to the distal portion of the mattress having a fifth total mass of the PCM and a fifth total mass of the TEEM of the foam layer, the fifth total mass of the PCM being greater than the fourth total mass of the PCM, and the fifth total mass of the TEEM being greater than the fourth total mass of the TEEM; and a second medial portion positioned between the second proximal and second distal portions of the foam layer in the depth direction having a sixth total mass of the PCM and a sixth total mass of the TEEM of the foam layer, the sixth total mass of the PCM being greater than the fourth total mass of the PCM and less than the fifth total mass of the PCM, and the sixth total mass of the TEEM being greater than the fourth total mass of the TEEM and less than the fifth total mass of the TEEM.

* * * * *